US011361617B2

(12) United States Patent
Colvin et al.

(10) Patent No.: US 11,361,617 B2
(45) Date of Patent: Jun. 14, 2022

(54) SYSTEMS AND METHODS FOR PROVIDING PROMOTIONAL GAMES AND GAMING AWARDS

(71) Applicant: Gaming Arts, LLC, Las Vegas, NV (US)

(72) Inventors: David Colvin, Las Vegas, NV (US); Eric D. Colvin, Las Vegas, NV (US); Moises Navarrete, Las Vegas, NV (US)

( * ) Notice: Subject to any disclaimer, the term of this patent is extended or adjusted under 35 U.S.C. 154(b) by 0 days.

(21) Appl. No.: 16/557,598

(22) Filed: Aug. 30, 2019

(65) Prior Publication Data

US 2020/0105099 A1 Apr. 2, 2020

Related U.S. Application Data

(60) Provisional application No. 62/739,786, filed on Oct. 1, 2018.

(51) Int. Cl.
*G07F 17/32* (2006.01)

(52) U.S. Cl.
CPC ..... *G07F 17/3255* (2013.01); *G07F 17/3213* (2013.01); *G07F 17/329* (2013.01); *G07F 17/3209* (2013.01); *G07F 17/3237* (2013.01); *G07F 17/3288* (2013.01)

(58) Field of Classification Search
CPC ..... G07F 17/3255; G07F 17/3213; G07F 17/3209; G07F 17/3237; G07F 17/3288; G07F 17/329
See application file for complete search history.

(56) References Cited

U.S. PATENT DOCUMENTS

2006/0217199 A1* 9/2006 Adcox ..... G07F 17/3223 463/40
2007/0202941 A1* 8/2007 Miltenberger ..... G07F 17/3255 463/25
2007/0243928 A1* 10/2007 Iddings ..... G07F 17/3239 463/26
2009/0253501 A1* 10/2009 LeBaron ..... G07F 17/3232 463/30
2010/0120490 A1* 5/2010 McLaughlin ..... G07F 17/3244 463/20

(Continued)

FOREIGN PATENT DOCUMENTS

AU 2013312163 3/2015
AU 2017217552 8/2018

(Continued)

*Primary Examiner* — Omkar A Deodhar
*Assistant Examiner* — Shauna-Kay Hall
(74) *Attorney, Agent, or Firm* — FisherBroyles, LLP; Rob L. Phillips

(57) ABSTRACT

A system includes providing a plurality of promotional games of chance, a randomization device configured to randomly select a result for the promotional game of chance, and a computing device programmed to determine the winning prize based on the results of the promotional game of chance. The promotional game of chance being played by the selected player on a player tablet via a game interface and viewable on a plurality of displays throughout the casino. The promotional game of chance operable for promotional games of chance, providing awards for casino games, and providing primary or secondary awards for casino side bets.

24 Claims, 22 Drawing Sheets

(56) References Cited

U.S. PATENT DOCUMENTS

2011/0045889 A1 2/2011 Khal
2011/0045890 A1 2/2011 Khal
2012/0122539 A1 5/2012 Khal et al.
2012/0122558 A1* 5/2012 Lyons ..... G05B 15/02 463/25
2013/0060641 A1* 3/2013 Al Gharabally ..... H04H 60/63 705/14.66
2013/0096996 A1* 4/2013 Tabor ..... G06Q 30/0207 705/14.1
2013/0331165 A1* 12/2013 Rosenheimer ..... G06Q 30/02 463/17
2014/0073393 A1 3/2014 Colvin et al.
2014/0073394 A1 3/2014 Colvin et al.
2014/0073395 A1 3/2014 Colvin et al.
2014/0073396 A1 3/2014 Colvin et al.
2014/0073397 A1 3/2014 Colvin et al.
2014/0073398 A1 3/2014 Colvin et al.
2014/0073399 A1 3/2014 Colvin et al.
2014/0073400 A1 3/2014 Colvin et al.
2014/0073401 A1 3/2014 Colvin et al.
2014/0073402 A1 3/2014 Colvin et al.
2014/0256393 A1 9/2014 Navarrete
2015/0005059 A1* 1/2015 Johnson ..... G07F 17/3255 463/25
2015/0011288 A1 1/2015 Colvin et al.
2015/0011289 A1 1/2015 Colvin et al.
2015/0031435 A1 1/2015 Colvin et al.
2015/0031442 A1 1/2015 Colvin et al.
2015/0031443 A1 1/2015 Colvin et al.
2015/0031444 A1 1/2015 Colvin et al.
2015/0031445 A1 1/2015 Colvin et al.
2015/0087371 A1* 3/2015 Hill ..... G07F 17/3223 463/11
2016/0107075 A1 4/2016 Colvin et al.
2016/0107076 A1 4/2016 Colvin et al.
2016/0110946 A1 4/2016 Colvin et al.
2017/0046918 A1 2/2017 Colvin et al.
2017/0053473 A1 2/2017 Colvin et al.
2017/0053474 A1 2/2017 Harris et al.
2017/0053489 A1 2/2017 Colvin et al.
2017/0236382 A1 8/2017 Colvin et al.
2017/0278340 A1 9/2017 Khal et al.
2018/0075699 A1 3/2018 Colvin et al.
2018/0122188 A1 5/2018 Colvin et al.

FOREIGN PATENT DOCUMENTS

CA 2884377 3/2014
CN 104737193 6/2015
EP 2904575 8/2015
EP 2933786 10/2015
EP 3413987 12/2018
WO WO 2017/139438 8/2017

* cited by examiner

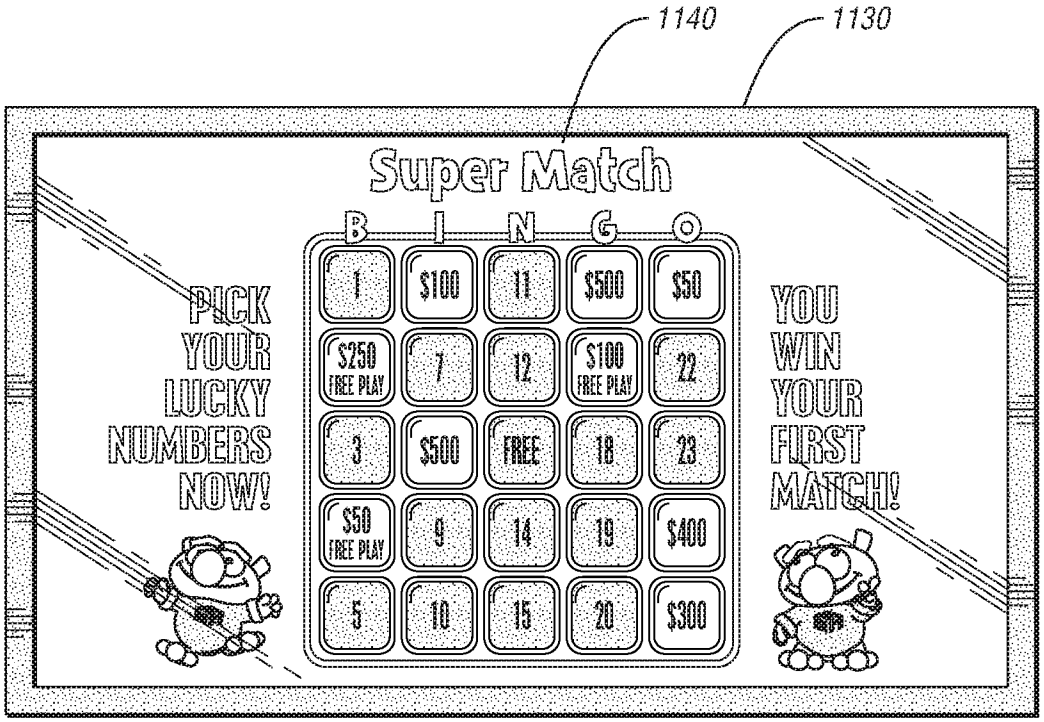
Fig. 11B
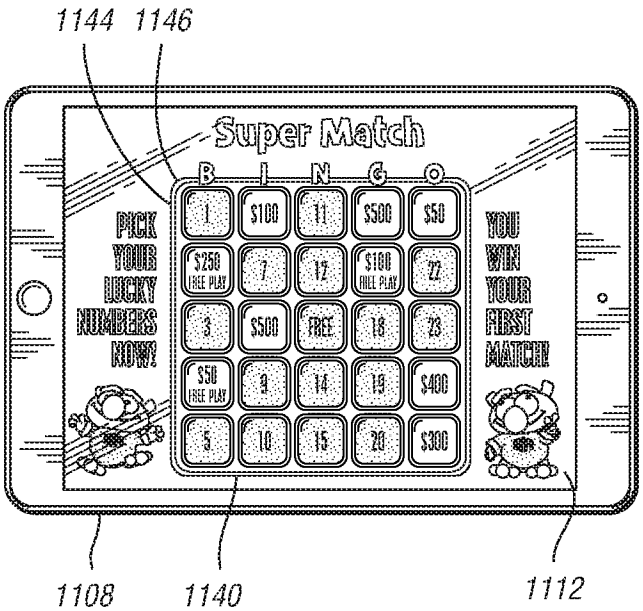

*Super Promo*™ is a first-of-its-kind innovative and fully customizable interactive gaming system offering four unique game suite formats adaptable to virtually all promotions on your casino floor.

This easy to use form will help you create your customized promotional game is just a few easy steps.

1604

Name of your promotion

1618

Name: Property:

Phone: Email:

1608

Create Your Customized Promotion

Step 1: Select Game Type

1610

Super Spin | Super Match | Super Pick & Win | Super Scratch

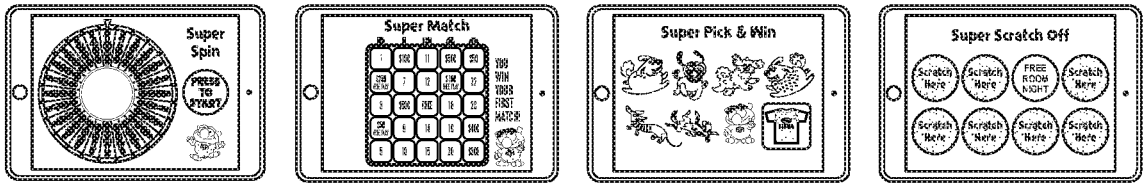

Spinning Wheel game based on the tried and true promo favorite.

Match & Win game - players select until they match a prize.

Pick & Win game - player select their favorite animated character.

Scratch-off game - players scratch-off their win.

RECOMMENDED USE

☐ 24 Slice Wheel Best for cash/free play

☒ 12 Slice Wheel Best for merchandise

☐

☐

☐

1612

Step 2: Select Promotion

| | | | |
|---|---|---|---|
| ☒ Weekly Drawings | ☐ High Value Player | ☐ Pool & Spa | ☐ Craps |
| ☐ Hot Seat Drawings | ☐ Handpay | ☐ Video Poker | ☐ Roulette |
| ☐ Senior Drawings | ☐ Hotel Check-in | ☐ Bingo | ☐ Pai Gow |
| ☐ Player Sign-up | ☐ Bounce Back | ☐ Keno | ☐ Three Card Poker |
| ☐ Slot Tournament | ☐ Food & Beverage | ☐ Table Games | ☐ Sports Book |
| ☐ Paycheck Cashing | ☐ Club | ☐ Blackjack | Other _____ |

1614

1616 CONTINUE

*Fig. 16A*

Create Your Customized Promotion

1626

1620

Step 4:Target cost per game

1624

All Tiers $

Tier 1 $

Tier 2 $

Tier 3 $

Tier 4 $

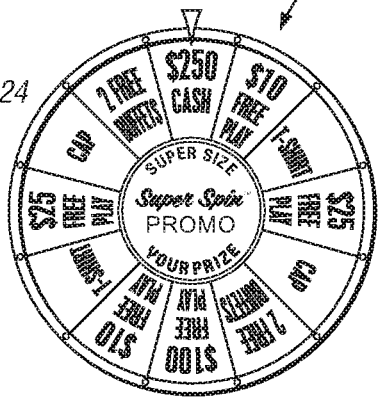

12 Slice Wheel

1630

Step 5: Select standard background

Please note: If multiple promotions are running on the system, all must have the same backgrounds selected from the options below.

BACKGROUND 1 | BACKGROUND 2 | BACKGROUND 3 | BACKGROUND 4

BACKGROUND 5 | BACKGROUND 6 | BACKGROUND 7 | BACKGROUND 8

1634

OR select a holiday or special event

| | | |
|---|---|---|
| New Years Day | St.Patty's Day | Labor Day |
| President's Day | Valentines Day | Thanksgiving |
| Columbus Day | Memorial Day | Christmas |
| MLK Day | Veteran's Day | Anniversary |
| Easter | 4th of July | Other |

BACK CONTINUE

1636

*Fig. 16B*

SYSTEMS AND METHODS FOR PROVIDING PROMOTIONAL GAMES AND GAMING AWARDS

FIELD OF THE INVENTION

The present application relates generally to promotional casino games and games of chance and, more particularly, to systems and methods for providing promotional and gaming awards or prizes.

BACKGROUND OF THE INVENTION

Gaming establishments have long understood the need to raise patron awareness levels and have instituted promotions, player loyalty programs, special gaming opportunities such as slot tournaments, advertising significant player wins, offering casino amenities, etc. in order to increase play, player acquisition, and player retention as the gaming industry is often very competitive.

Special or promotional casino games are typically designed where at least one player is selected from a group of players on the casino floor or other venues and offered the opportunity to participate in a promotional game such as a rotating mechanical wheel, selecting and envelope for a plurality of envelopes, choosing an object from a plurality of objects, etc. Generally, once selected, the player is asked to leave their gaming position such as a seat at an electronic gaming machine or table game position and go to a central location such as a stage or similar to play the promotional games in view of a very limited number of casino patrons. Once a player or players arrive at the central location; the promotional games are played, and the appropriate awards or prizes are given. Again, in view of a limited number of casino patrons with only an audio description of the game results broadcast over the public address system. Some casino promotions provide for predetermined awards, such as "hot seat" drawings where a player(s) is selected and receives a predetermine prize. Generally, award levels are static with only one level of outcome where the player play level or player tier level is disregarded, over rewarding low value players and under rewarding high value players which is detrimental to the intent of the promotion and player loyalty system. This limited casino patron view or limited audience participation greatly limits the effectiveness of the casino promotion as the intent is to raise awareness of the promotion and raise the excitement level across the casino floor.

Casino promotions may also be targeted to certain areas of the casino floor such as slots, video poker, general table games or pit, specific table games, etc. Similar to more general promotions, existing targeted promotions generally lack any interactivity beyond casino personnel and the winner as there is only limited group participation.

In addition, the systems and methods may be utilized for specialty casino games whereas when a player achieves the winning criterion of a base or special game, the player plays a secondary game which will determine their ultimate award or prize. Award and prize are used interchangeably herein.

SUMMARY

The present invention provides systems and methods for providing promotional games including a plurality of customizable interactive games and prizes or awards adaptable to promotions on the casino floor or associated locations.

A promotional game occurs once a triggering event has occurred. Triggering events include selecting a player via drawings, player points, game outcomes or the like. Generally, no award or prize will be given to a player based on the triggering event. Instead, the award or prize will be determined solely by the outcome of the second promotional game. Following a triggering event, the casino staff presents the selected player with the player tablet at their seat or gaming position with digital displays and/or video projectors, across the property or specific gaming area engaging players so a larger audience can participate in the fun and excitement of the promotion. There are many benefits of allowing players to remain seated as opposed to requiring the player to come to the central game area or stage such as not interrupting a player's play and associated resultant anticipated losses by the player for that promotional game period, the need for a player to cash-out from their slot machine, allowing handicapped players to remain seated, table games players to remain seated, etc. Those ordinarily skilled in the art will recognize that any mobile computing device such as a laptop computer, smart phone, etc. may substituted for a player tablet in any of the embodiments described herein.

Awards or prizes for any promotional game may be anything the operator desires including but not limited to any of the following; cash, free slot play, promotional chips, dining credits, show credits, spa credits, beverages, hats, cars, vacations, houses, motorcycles, boats, etc. All awards and prizes for any of the embodiments may be changed or customized at the server level either locally or remotely, which will appear on the player tablet and property displays.

The selected player may be presented with a specific game loaded onto the player tablet or in the alternative, may select which game they choose to play, i.e., wheel game, rotating drum game, match game, pick and win game, scratch and win game, punch card game, etc.

In one embodiment, an electronic representation of a physical wheel is disclosed where the selected player is given the opportunity to "spin the wheel" (activate the wheel) for their prize. Prizes or awards may be any prize that the casino may desire. The promotional game starts with the wheel already rotating and the player is allowed to press the "Press to stop" button on the tablet which will start the wheel slowdown and stopping process eventually stopping on one of a plurality of pie like slices or sections indicating the award or prize for the player. Alternatively, a wired or wireless game initiation button or similar may be provided to communicate with the player tablet and the like.

Preferably, a promotional game is in the idle position where the game shown on the player tablet and the displays of the gaming establishment show either identical or similar images and when the actual play begins, the game shown on the player tablet and the displays of the gaming establishment also show either identical or similar images. These video display actions are controlled by the system server and may include other images or videos such as property advertising shown either prior to a game being played or during the actual game play and may be dissimilar on the player tablet and property display.

In another embodiment, an electronic representation of a match game is disclosed where the selected player is given the opportunity to choose one of a plurality of icons until a match occurs whereas the match determines their prize.

In yet another embodiment, an electronic representation of a pick and win game is disclosed where the selected player is given the opportunity to choose one or more icons to determine their prize.

In yet another embodiment, an electronic representation of multiple scratch-off cards is disclosed where the selected player is given the opportunity to electronically scratch off various icons to reveal their prize or prizes. Those ordinarily skilled in the art will recognize that a great many game types may be incorporated into the promotional system.

For any game embodiment, the prize array for any game may be identical for all players, whether the player is identified or not or, in the alternative, may be adjusted relative to player value or player loyalty tier level. Use of varying prize scenarios may be accomplished either automatically or by manual adjustment by the operator prior to the game starting once the player is identified.

Some installations of the promotional system may be relatively small both in operation size and with a limited number of ongoing promotions and thus require only one or two player tablets. However, larger installation may include a significant number of different venues over a large geographic area, the promotional system is capable of running both a single tablet and multiple tablets simultaneously as all tablets are individually programmed and identified and may include differing games and prizes.

The promotional system may also be employed with table games, specialty games, side bets, proprietary games, proprietary side bets and the like. Examples of table games include, craps, roulette, blackjack, pai gow poker, poker, baccarat, and similar table games. In all embodiments where the promotional game follows a player achieving a triggering event following play of a game of chance requiring a wager, there may be no prize or award for the first game of chance outcome, instead the ultimate prize or award will be determined by the outcome of the promotional game of chance.

In addition, the promotional system can be used in other venues such as a sports book to incentivize current players or to attract current non-players. For example, current players may be rewarded for certain bets or wins or high tier non-sports book players may be introduced to the sports book by playing promotional games of chance where the winners play promotional games and win certain free bets, i.e., prop bets, parleys, etc. In the alternative, a winning bet may be paid via the promotional system to provide more excitement even though the average pay may be approximately equal to the normal bet payout.

Also disclosed is a system for presenting an award to a selected player based on a promotional event game outcome that is part of a promotional event after the selected player first being selected based on a first game of chance outcome comprising a server having a transceiver, a processor and a memory, the memory configured with non-transitory machine executable instructions executable by the processor, to generate the promotional event game outcome. Also provided is a mobile computing device, for use by the selected player, having a transceiver, a screen, a processor and a memory. The memory is configured with non-transitory machine executable instructions executable by the processor, to display a promotional event to the selected player on the screen, the promotional event including a second game of chance having a promotional event game outcome such that the award is determined by the promotional event game outcome, receive the promotional event game outcome from the server, present the award to the selected player responsive to the promotional event game outcome and, a remote display configured to show the promotional event or a portion of the promotional event concurrent with the promotional event being shown to the selected player on the screen of the mobile computing device.

In one embodiment, the mobile computing device is tablet computer. The promotional event may include (comprise) one or more of the following: an electronic wheel-based game of chance, an electronic matching game of chance, an electronic scratch-off game of chance, and an electronic pick and win game of chance. In one configuration, the selection of the selected player is based on a drawing from a plurality of players. It is contemplated and disclosed herein that the selection of the selected player does not require a wager by the selected player, or the selection of the selected player may require a wager by the selected player.

In one embodiment, a system is proposed for offering a promotional event for a player such that the player selected based on a first game of chance outcome comprising a remote display configured to receive a signal representing the promotional event and display at least a portion of the promotional event on the remote display. Also part of this embodiment is a promotional event computing device having a processor, a memory, a screen, and a wireless transceiver. The memory is configured with non-transitory machine executable instructions executable by the processor responsive to a trigger event, initiate the promotional event and generate a random outcome, the random outcome representing a promotional event outcome. Then display the promotional event and the promotional event outcome to the player on the screen of the promotional event computing device and award the player a prize, the prize determined by the promotional event outcome. During the promotional event, transmit at least a portion of the promotional event to the remote display, the remote display viewable by additional people.

A system for offering a promotional event for a selected player, the selected player being selected based on a first game of chance outcome. In one embodiment, the system includes a promotional event computing device comprising a processor, memory, a screen, and a wireless transceiver. Also part of this embodiment is one or more displays, separate from the promotional event computing device, viewable by people other than or in addition to the selected player, the one or more displays and configured to display at least a portion of the promotional event; A stationary computing device having a processor, a memory, a screen, and a transceiver, is also provided. The memory is configured with non-transitory machine executable instructions, executable by the processor, to responsive to a trigger event, communicate with the promotional event computing device to initiate a promotional event for display on the screen of the promotional event computing device, generate a promotional event outcome with a random number generator, transmit the promotional event outcome to the promotional event computing device, associate and store the promotional event outcome with the promotional event. The memory of the promotional event computing device is configured with non-transitory machine executable code, executable by the processor of the mobile computing device, configured to receive a communication from the stationary computing device to display a promotional event start screen, receive input from the player to initiate the promotional event, and responsive to input from the player, display the promotional event and the promotional event outcome on the screen of the promotional event computing device and display an award on the screen of the promotional event computing device, the promotional event outcome determined by the stationary computing device.

Also disclosed is a system for presenting an award to a player based on a game outcome that is part of a promotional event. The player is selected based on a first game of chance outcome that provides no award. In one embodiment this system comprises a server having a transceiver, a processor and a memory, such that the memory is configured with non-transitory machine executable instructions executable by the processor, to generate a game outcome. Also part of this embodiment is a mobile computing device, for use by the player, having a transceiver, a screen, a processor and a memory. The memory is configured with non-transitory machine executable instructions executable by the processor, to display a promotional event to the player on the screen, the promotional event including a second game of chance such that the award is determined by the game outcome, receive the game outcome from the server, present the award to the player responsive to the game outcome, and a remote display configured to show the promotional event or a portion of the promotional event concurrent with the promotional event being shown to the player on the screen of the mobile computing device.

Also disclosed is a system for presenting an award to a player based on a game outcome that is part of a promotional event. In one embodiment, the system comprises a promotional event computing device, for use by the player, having a transceiver, a screen, a processor and a memory, such that the memory is configured with non-transitory machine executable instructions executable by the processor, to display the promotional event to the player on the screen, the promotional event including a game of chance that has an award which is determined by a RNG, present the award to the player responsive to the game outcome, and display the promotional event to a plurality of additional people.

In another embodiment, a system is disclosed for providing a promotional event to a player of a first game of chance after participating in the first game of chance that provides a first award based on a first game of chance outcome and participation in a second game of chance that provides no award except participation in the promotional event is disclosed. The system may comprise a promotional event computing device, for use by the player, having a transceiver, a screen, a processor and a memory, such that the memory is configured with non-transitory machine executable instructions executable by the processor, to: display the promotional event to the player on the screen, the promotional event including a third game of chance that has a promotional event award which is determined by a RNG, present the promotional event award to the player responsive to an outcome of the third game of chance outcome, and display the promotional event on one or more screens in addition to the screen of the promotional event computing device for viewing by one or more people in addition to the player.

Also disclosed is a method for providing a promotional event to a selected player of a game of chance after a trigger event. In one embodiment, this method comprises, responsive to the trigger event, presenting a promotional event computing device to the selected player and initiating the promotional event, the promotional event including a game of chance, and then presenting the promotional event including the game of chance to the selected player on a screen of the promotional event computing device. This method also generates a game outcome with a random number generator and presents an award to the selected player, such that the award is determined by the game outcome. While presenting the promotional event to the selected player, concurrently displaying the promotional event on one or more additional screens separate from the promotional event computing device for viewing by one or more people in addition to the selected player.

Another disclosed method includes providing a promotional event to a selected player of a game of chance after first being selected based on a first game of chance outcome that provides no award. In one embodiment this method comprises, responsive to a trigger event, presenting a promotional computing device to a player and initiating a promotional event, the promotional event including a second game of chance and presenting the promotional event to the user on a screen of the promotional event computing device including the second game of chance. This method also includes generating a second game of chance outcome with a random number generator and presenting an award to the player, the award determined by the second game of chance outcome. While presenting the promotional event to the user, concurrently displaying the promotional event on one or more additional screens separate from the promotional event computing device for viewing by one or more people in addition to the player.

Also disclosed is a method for providing a promotional event to a selected player of a first game of chance after first being selected based on a first game of chance outcome that provides no award. In one embodiment, this method comprises, responsive to a trigger event, presenting a promotional computing device to a player and initiating a promotional event, the promotional event including a second game of chance, and then presenting the promotional event including the second game of chance to selected player on a screen of the promotional event computing device. This method also includes generating a game outcome for the second game of chance with a random number generator, presenting an award to the player, the award determined by the game outcome for the second game of chance, and displaying the promotional event on one or more screens in addition to the screen of the promotional event computing device for viewing by one or more people in addition to the selected player.

Also disclosed is a method for providing a promotional event to a player of a game of chance after participating in a first game of chance that provides an award based on the first game of chance outcome and participation in a second game of chance that provides no award for except participation in the promotional event. In one embodiment, this method comprises, responsive to a trigger event, presenting a promotional computing device to the player and initiating the promotional event, the promotional event including a third game of chance. Then presenting the promotional event including the third game of chance to the player on a screen of the promotional event computing device and generating a third game of chance outcome with a random number generator. This exemplary method also presents an award to the player, such that the award is determined by the third game of chance outcome, and displaying the promotional event on one or more additional screens for viewing by one or more people in addition to the player.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Further, any of the elements and features disclosed herein may be combined in any manner with any of the other elements and features disclosed herein.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 11B illustrates an alternative exemplary promotional event graphical interface.

FIGS. 16A, 16B, 16C, and 16D are directed to an administrative interface for configuring the promotional event system.

DETAILED DESCRIPTION

As those of ordinary skill in the art will understand, various features of the embodiments illustrated and described with reference to any one of the Figures may be combined with features illustrated in one or more other Figures to produce embodiments that may not be explicitly illustrated or described in detail. The combinations of features illustrated provide representative embodiments for typical gaming applications for bingo and related games. However, various combinations and modifications of the features consistent with the teachings of the present disclosure may be desired for particular applications or implementations. The representative embodiments used in the illustrations relate generally to a game of chance, such as bingo or a related game, with multiple prizes and/or winners. Those of ordinary skill in the art may recognize similar games such as, but not limited to, slots, keno, video poker, blackjack, craps, baccarat, roulette, pai gow poker, etc., or other applications or implementations not specifically described, but that are within the scope of the claims.

Figure 1:
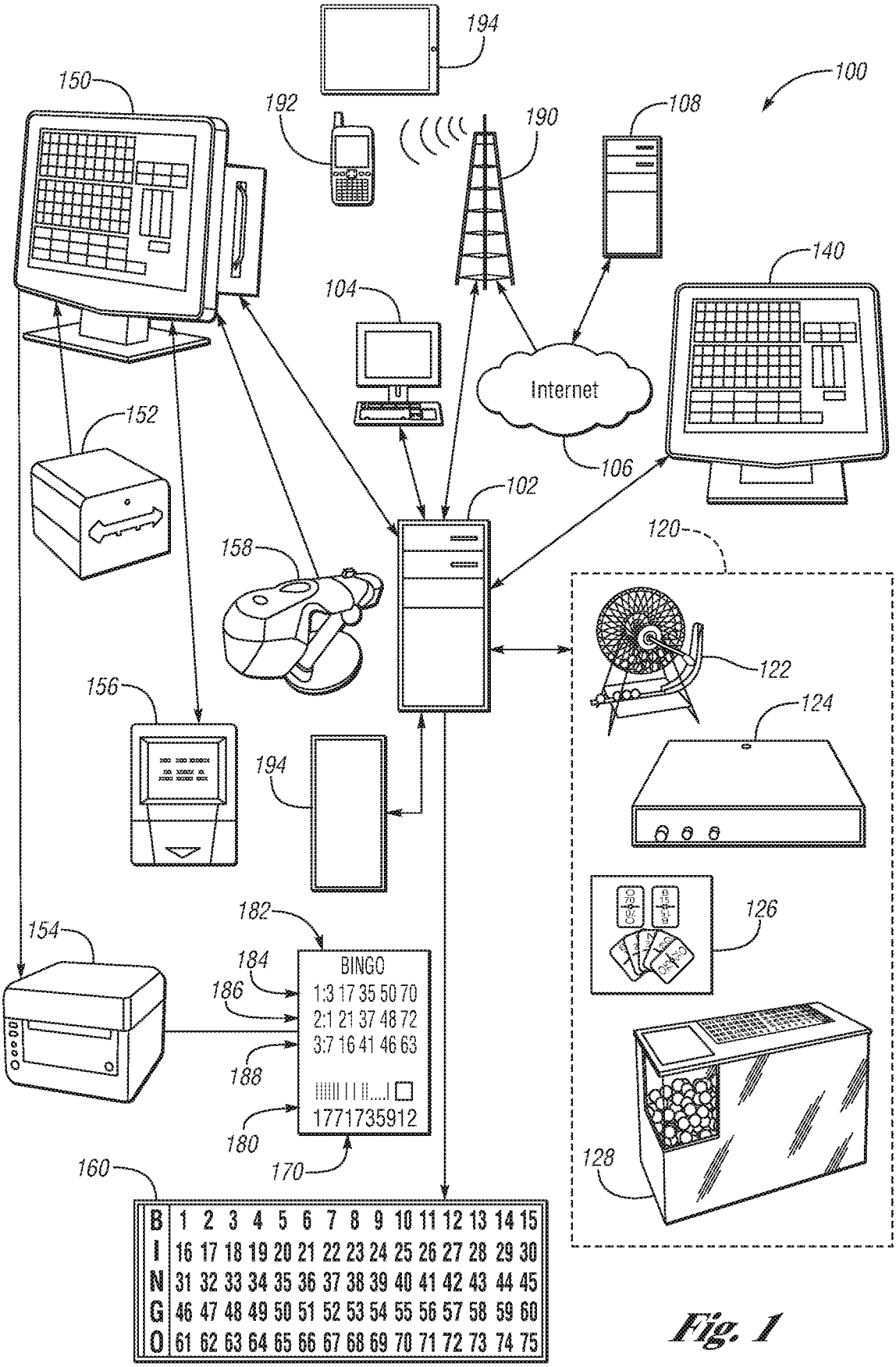
FIG. 1 illustrates a block diagram illustrating a bingo gaming system.

FIG. 1 illustrates an exemplary bingo game, which is one possible base game for the promotional event described herein. The descriptions of various styles of bingo and related gaming are purely illustrative. The systems and methods for gaming according to various embodiments of the present disclosure are generally independent of the size of the pool of indicia and are not limited to a particular number or type of indicia, elements, balls, or numbers used in traditional bingo as played in the United States or Europe as described with respect to various representative embodiments, or other wagering games. In addition, those of ordinary skill in the art will recognize that any reference to balls or ball calls apply equally to games where other indicia such as letters, words, names, symbols, constellations, figures, patterns, and the like may be used in place of, or in combination with numbers.

In general, the bingo strategies described with reference to various embodiments of the present disclosure are independent of the particular manner or strategy for selecting, determining, sequencing, calling, etc. of the house or game indicia. As such, the winning combination, matched selection, number of matches, etc., may generally be obtained by any predetermined or random selection of indicia using manual, electrical, mechanical, electronic, or computer controlled or assisted devices to match less than or equal to the total number of possible selections. Likewise, operator calls, house or game indicia may be determined, selected, or sequenced individually one at a time, and/or in groups or sets, and subsequently displayed or otherwise provided to game players. Whether selected individually or as a group or set, house or game indicia may be displayed or presented individually and/or as a group. For example, a group of game or house indicia may be pre-selected prior to the beginning of a game and displayed or presented as a group to the players. Subsequent selection and presentation may occur for individual calls in substantially real time during game play. As another example, all of the available pool of indicia may be pre-selected or sequenced prior to game play and then called or presented individually to the game players to determine prize awards as described herein.

Those of ordinary skill in the art will recognize that the bingo strategies illustrated in various embodiments of the present disclosure may be applied to virtually any existing or future variation of bingo, keno and related games. The strategies may be used with any winning pattern, combination, number selections, and the like. Similarly, various embodiments of the present disclosure may be played with tickets or cards on paper, card stock, or electronically via a video screen on a kiosk or handheld device, for example. Bingo strategies according to embodiments of the present disclosure may be applied to games based on fixed award payouts, fixed odds payouts, pari-mutuel, progressive jackpots, or any combination thereof. Similarly, although various embodiments may refer to a ball call, an operator call or more generally selection or determination of house or game indicia, the bingo strategies illustrated may be used in games that incorporate various methods for selecting or determining house or game indicia, which may include a number, letter, word, graphic, picture, etc., including but not limited to pre-called games, random number generators, ball blowers, card draws, roulette style draws, and the like.

As shown in FIG. 1, a system or method for playing a game of chance such as bingo is disclosed. The system 100 includes a computer server 102 in communication with various local and/or remote client devices using standard communication protocols, which may include secure, encrypted communications. The computer server 102 performs various functions associated with operation, management, and reporting for bingo and related games of chance as described in greater detail herein according to various embodiments of the present disclosure. Computer server 102 may be connected via a local and/or wide area network using any of number of standard wired and/or wireless connection technologies and communication standards. A management or administrator terminal console or computer 104 may be used to manage various game related operations performed by computer server 102. The computer 104 may be directly connected to the server 102 or may be connected via a public or private network, such as the internet, generally represented by 106. The computer server 102 may also be connected to one or more computers 108, which may include one or more website servers and/or gaming servers at one or more gaming establishments or properties, for example, via a private wired or wireless network and/or the internet 106. The computer server 102 may control and/or coordinate games for multiple gaming establishments or properties to facilitate multi-property progressive prizes, for example. One or more website servers 108 may be used to remotely play bingo or a related game of chance where regulations permit. Similarly, a website server 108 may provide status information for player tickets/cards to allow players to obtain information relative to multi-game tickets as described in greater detail herein.

Gaming devices used in a system or method for bingo and related games of chance according to the present disclosure may include at least one device as generally represented by reference numeral 120 for selecting house indicia or called objects from a pool of available objects for a particular game. For example, the device 120 may be implemented by one or more ball cage 122, an electronic or computer controlled random number generator (RNG) 124 or pseudo random number generator (PRNG), a deck of cards 126, or a ball blower/console 128, although typically only one device is used in any particular game. RNGs and PRNGs are used interchangeable herein. The RNG 124 may be implemented by a dedicated hardware device with associated embedded software. Alternatively, the RNG 124 may be implemented entirely in software executing on the computer server 102 or another computer or server. In one embodiment, the RNG 124 is implemented by a dedicated hardware device or network appliance that communicates via a standard network protocol, such as Ethernet, and supports multiple games at multiple locations with house/game draws of between two and one-hundred-twenty numbers. The RNG 124 may be programmed via hardware, software, or firmware, to provide a particular range of numbers and numbers of draws for a particular application. For example, in one embodiment of bingo according to the present disclosure, the RNG 124 provides 24 randomly generated numbers having values between 1 and 75 for each game similar to a traditional bingo draw. Additional draws or numbers may be provided to play the game to conclusion depending on the particular implementation as described in greater detail herein.

Although various house indicia selection devices or methods may have advantages over others, those of ordinary skill in the art will recognize that the present disclosure is independent of the particular type of device 120 or method used to select, sequence, or otherwise determine house indicia represented by called numbers or objects as previously described. Depending on the particular device used to select or otherwise determine house indicia, the selected indicia may be manually entered by an operator and/or automatically determined and communicated to the computer server 102 in near real time and/or as a group upon conclusion of a game or at other selected intervals. For example, a ball blower console 128 may be used to manually draw each number. Each ball drawn is electronically or otherwise detected by the console 128 or an associated device and communicated to the computer server 102. In applications having an RNG 124, selected house indicia are automatically communicated to server 102 in response to a particular request, which may be manually or automatically initiated. For example, an operator may initiate an electronic ball draw via an associated touch screen display 140 or similar device as illustrated and described herein. Alternatively, the touch screen 140 may be used to enter ball calls determined using a manual device, such as a ball cage 122, a card 126, a ball blower 128, or the like, which are then communicated to the server 102. In one embodiment, a desk terminal implemented using a touch screen 140 with embedded software facilitates various game functions, such as game close, clear boards, and re-display, for example. In other embodiments, the server 102 may automatically generate a request for multiple draws when a game is initiated. Of course, various other manual and/or automatic strategies for selecting or otherwise determining house indicia may be used.

As shown in FIG. 1, the system 100 may include one or more writer terminals 150 to facilitate various game-related functions. In one embodiment, the writer terminal 150 is a client device implemented by a touch-screen display with embedded software to provide a user interface to control gaming functions and communicate with computer server 102. The terminals 150 may be located at multiple gaming establishments and communicate with a single centralized server 102. The writer terminal 150 may also include an integrated secondary customer display. Various accessories may also be connected to writer terminal 150. For example, a magnetic card reader 412 may be provided to read player affinity cards, credit cards, and similar cards to track player habits, place wagers, etc. It is also contemplated that other types of cards may be read with the card reader 412, such as RFID enabled cards, cards which include an electronic chip (for example, EMV cards), or any other type player tracking, identification, or credit/bank card. In addition, a fingerprint reader, retina scanning device, facial recognition system, or similar may be provided to enhance login security for operators of the writer terminal 150. As previously described, the writer terminal 150 may communicate with the server 102 and one or more peripheral devices directly and/or using any standard communication protocol such as Ethernet, for example. The writer terminal 150 may also include cash register features such as subtotal, total, and tender. A single writer terminal 150 may be used to provide gaming functions for any of a number of games being coordinated by server 102.

The writer terminal 150 may be directly connected or otherwise in communication with various peripheral or accessory devices such as a mark sense reader 152 and ticket/card printer 154, for example but not limitation. The reader 152 may be used to automatically read player tickets/card requests, which may include one or more player requested indicia. In one embodiment, players may request numbers printed on a paper ticket request by marking the paper with a pen or pencil. The ticket request is then fed into the reader 152 which reads the marks and communicates associated information to the writer terminal 150. As described in greater detail below, writer terminal 150 communicates this information to the server 102. The ticket/card request form may include all available numbers depicted as a bingo flashboard, for example, as generally represented by a flashboard 160. Of course, various other arrangements may be provided. For example, a ticket request may only include numbers written by hand by the player. Ticket requests may be presented to an operator with requested player indicia automatically and/or manually entered via the writer terminal 150 as described in greater detail herein. However, use of a machine-readable ticket request in combination with a corresponding device such as the reader 152 reduces or eliminates errors associated with manually selecting player indicia requested by a particular player. Upon collecting an associated wager and verifying ticket information, a paper ticket or card 170 may be printed by a printer 154. Alternatively, or in combination, a virtual ticket/card may be provided in electronic form to an associated display on a player terminal and/or handheld device, such as cell phone 192. As also illustrated in FIG. 1, the printer 154 may be directly connected to writer terminal 150 and or the server 102 via a wired or wireless connection. Alternatively, or in combination, one or more printers 154 may be networked to one or more writer terminals 150 and/or the server 102 and distributed at convenient locations throughout a gaming establishment depending upon the particular application and implementation.

The system 100 includes a plurality of player cards or tickets 170. The actual type, arrangement, and content of player cards 170 may vary by the game being played. Cards may have various common features, such as a game identifier 182 and indicia or objects 184, 186, 188 (numbers in this example) that may include multiple wagers and/or multiple games with one or more player selected indicia. For example, wagers 184, 186, 188 may represent multiple wagers for a single game. Alternatively, each group 184, 186, 188 of player indicia may represent wagers for three different games. Alternatively, the three wagers may apply to multiple future games at various intervals, such as one a day, one a week, ten per day, etc. In one embodiment, player requested, or selected indicia include randomly generated numbers produced in response to a player request for a quick pick card or ticket. The cards 170 may also include computer readable indicia, such as a machine-readable identification and/or security code 180. For example, computer readable indicia may include a linear or two-dimensional bar code, machine readable numbers, magnetic stripe, etc. Similarly, the card 170 may include human readable numbers and/or letters associated with a machine-readable symbol or barcode to identify a particular ticket or card. Various other information may also be printed on the cards 170, such as the amount of a wager, session ID, number of games, date, etc., depending on the particular implementation. Of course, arrangements of numbers or indicia other than those shown or described are possible and contemplated within the scope of this disclosure. The cards 170 generally include a first plurality of indicia, 5 numbers in this example, selected from a pool of a second plurality of indicia, such as 75 numbers, for example. Some or all of the player indicia may be selected or requested by the player, with any remaining player indicia randomly generated by the house using a software and/or hardware random number generator (RNG) or similar device. The indicia may be prearranged in a particular order or pattern, such as from low to high, or associated with a particular bingo letter, for example. The player cards 170 may be physically implemented on paper, cardstock, or similar material, or may be electronically or virtually represented on a fixed, portable, or handheld electronic device having a display, such as a player terminal or a cell phone 192, for example. In one embodiment, the cards 170 are implemented as cards having player indicia preselected and concealed by pull tabs. In this embodiment, house indicia may be preselected prior to the beginning of the game. Players open the pull tabs to reveal the player numbers or other designations on the player card 170. The prize award may be determined based on the number of pull tabs sold or opened by the player to match the previously designated number of numbers or other designations.

Various accessories or peripherals may also be provided as generally represented by the card/ticket checker 156, the barcode scanner 158, and the display or flashboard 160. Ticket checker 156 may include a barcode reader in addition to a magnetic stripe reader. The magnetic stripe reader may be used to read a customer affinity program card and display associated information, for example. The ticket checker 156 is a player activated device that may be used to scan a ticket and determine the ticket ID and display the status of that ticket. For example, the ticket checker 156 may scan the barcode on a ticket to determine the ticket ID. The ticket ID information is communicated to server 102 to determine the status of the ticket. Ticket status is returned to ticket checker 156 and displayed on an embedded display. Ticket status may include a variety of information related to the game or games associated with the particular ticket, such as the date and time the ticket was issued, the wager, the time of completion of associated games, any winnings, and the like. A barcode scanner 158 may also be used to scan or read machine-readable information encoded on a ticket/card. Information is communicated to the server 102 to identify the ticket. Associated information stored in a database in the server 102 may then be communicated to any associated terminal or display.

A flashboard 160 may be used to present or display house indicia to players within a gaming establishment. While illustrated as a dedicated display, the flashboard 160 may be alternatively implemented by a general-purpose display. Similarly, house indicia may be communicated in various other formats depending upon the particular application and implementation. In addition to a local display, the house indicia may be presented to players via wireless devices such as a cell phone 192 or tablet (194). Wireless devices may communicate with the server 102 via an associated antenna or tower 190. The antenna or tower 190 generally represents any wireless transmitting device such as a wireless router, cell phone tower, and the like. Alternatively, or in combination, house indicia and other related gaming information may be presented to one or more computers or servers 108 via the Internet 106 and/or any local private or public networks. Likewise, any devices illustrated in FIG. 1 may communicate with server 102 using a wireless connection.

In operation, a game of chance, such as bingo or a related game, is played for prizes, including monetary prizes, with the cards/tickets 170 bearing numbers or other designations. Players or cardholders may cover the selected numbers or other designations when objects similarly numbered or designated as represented by the balls 122, 128, or the cards 126, for example, are drawn or electronically determined, such as by a random number generator 124. Depending upon the particular implementation, the game may be won by the first person covering a previously designated number of numbers, designated pattern, or other designations on card 170, which may include at least some of the player numbers or other designations selected by a player. Numbers or other designations may be selected using a printed or electronic representation of a bingo flashboard as generally represented by flashboard 160, for example. In one embodiment, at least some of the numbers or other designations are selected by a player using a handheld mobile device, such as a cell phone 192 or tablet 194, for example. Numbers may be requested or selected by a player using a standard text messaging protocol, such as SMS or a similar protocol, for example. Similarly, players may request one or more player indicia for a particular card/ticket by marking or requesting a quick pick, for example. In this case, the player requested indicia are randomly generated by the server 102 and/or an associated random number generator 124. In one embodiment, the game is played to conclusion by continuing to draw or electronically determine objects until at least one cardholder covers the previously designated number of numbers, patterns, or other designations. Alternatively, the game ends after a fixed number of draws by awarding every cardholder a prize associated with the number of numbers or other designations covered after the predetermined number of objects are drawn. In one embodiment of bingo, 24 numbers or other designations are drawn or electronically determined from a pool of 75 numbers or other designations with a prize awarded for every card corresponding to the number of numbers or other designations covered after the 24 numbers or other designations have been drawn.

Prizes are awarded based on an associated pay table stored within the server 102 as explained in greater detail herein. Prize awards may be fixed or be determined on a pari-mutuel basis based on wagers made less a designated house portion. Alternatively, prize awards may include a seeded prize beginning at a minimum value and increasing based on a cumulative amount of wagers or other meter until a winner is determined. As previously described, a ticket/card may be valid for a predetermined number of future games based on a corresponding wager amount for each game.

Figure 2:
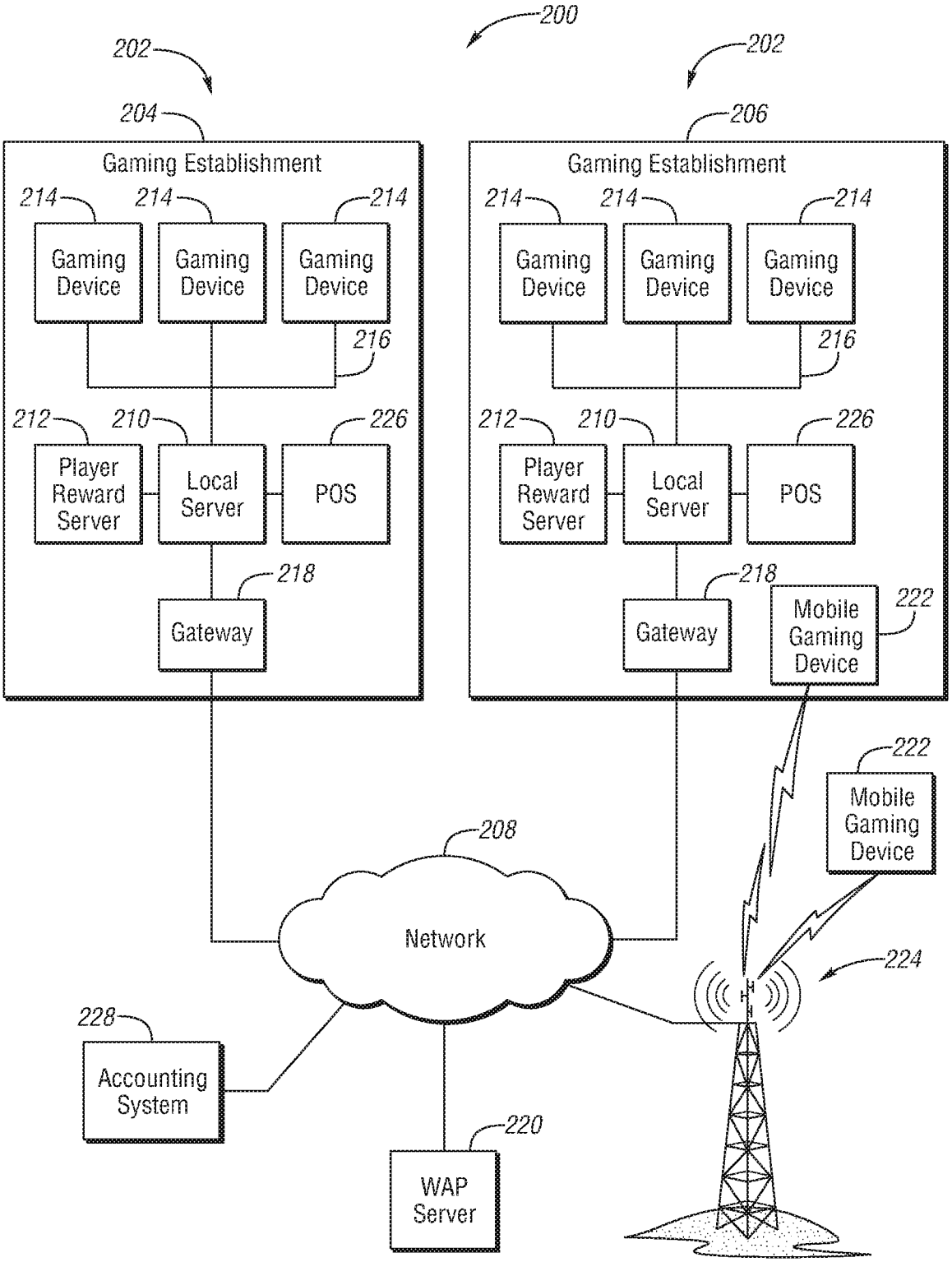
FIG. 2 illustrates a block diagram of a multiple property system that may be used to play a game of chance.

FIG. 2 illustrates a block diagram of a multiple property system that may be used to play a game of chance. This figure provides a view of exemplary gaming systems in one or more casinos. In one embodiment, a plurality of gaming devices 214 are connected to one or more servers 210 over a network 208, such as a wide area network (WAN) and/or a local area network (LAN). In one embodiment, the gaming devices 214 are electronic gaming machines (EGMs), otherwise known as "slot machines." These may be classified as Class II, Class III, video lottery terminals (VLT), or the like. EGMs may present either one or a plurality of games to the player such as video reels, video poker, video keno, video bingo, electronic table games, and the like. In another embodiment, the gaming devices are gaming kiosks or terminals. Alternatively, the gaming devices may include remote gaming devices, for example, cellular phones, laptop or desktop computers, and/or any other suitable devices. The servers may include one or more local servers within a gaming establishment and/or one or more wide area progressive (WAP) servers connected to the local servers and/or to the gaming devices through the network.

Those familiar with the gaming arts will recognize that certain types of EGMs, generally utilized in regulated casino environments, are commonly referred to as "slot machines". Although the etymology of the term "slot machine" was originally derived from a coin slot in the gaming machines at the time, coin slots have long since generally been replaced by bill validators which only accept paper currency or ticket-in-ticket-out validators which accept vouchers and/or electronic fund transfer means, such as card readers or account interfaces. Thus the term "slot machine" is not necessarily technically accurate but is still used in the gaming industry to refer to EGMs. Those familiar with the gaming arts will recognize that modern EGMs used in regulated casino environments are still often referred to as "slot machines" which differentiates this type EGM from other EGMs such as cell phones, tablets, laptop computers, etc. As a result, the term EGM is defined to mean something different than a laptop or desktop computer, cell phone, or tablet computer.

In one embodiment, each gaming device presents either one or a plurality of games of chance to a player to enable the player to select and play the games of chance. In addition, each gaming device may include a randomization device, such as a random number generator (RNG) and/or a permutation generator, that is used to play a selected game on the gaming device. The randomization device may be used to randomly determine a game outcome for the game of chance. For example, if the player selects a game of bingo to be played on a gaming device, the gaming device uses the randomization device to select a plurality of house indicia from a pool of indicia to be used during the game. In another embodiment, at least some aspects of the game are provided by one or more servers, such as a local server 210, a wide area server, a local area progressive server (LAP), or a wide area progressive server (WAP) 220. The server or servers may include a randomization device for randomly selecting the house indicia in the bingo game or any other wagering event.

In the example of a video poker game, either one or a plurality of games are presented to the player. After game selection and wagering, a number of playing cards, generally selected from a 52-card deck, are distributed to the player. In the case of draw poker or its many variants, the player selectively chooses to retain one or more of the original cards dealt and to discard those cards not chosen to be retained. The discarded cards are then replaced by new cards. If the player obtains a predefined winning combination of cards, the player wins an amount associated with the particular combination of cards.

In the example of mechanical, electromechanical, or video reel machines, the games may include a number of mechanical or simulated rotating reels that are arranged in a horizontal configuration forming columns or vertical configurations forming rows. One or a number of rows are presented to the player to allow for one or many different winning pay lines. Pay lines may be straight across or designed in any convenient fashion. A typical game many include five reels or columns and three or four rows or the like or a vertical configuration of five rows and three or four columns and the like.

In the example of the bingo game, the house indicia are compared to a plurality of player indicia that are included within a pattern selected for one or more player cards. If at least some of the player indicia within the pattern are matched by the house indicia, the player may win a prize based on the number of house indicia that have been matched and an associated pay table.

In the example of a keno game or a keno-related game of chance, the gaming device uses the randomization device to randomly select a plurality of house indicia in a similar manner as described with respect to the game of bingo. However, twenty house indicia are typically randomly selected or called from a pool of 80 house indicia, although other sizes of house indicia pools may be used. The called house indicia are compared to a plurality of player indicia to determine how many player indicia are matched by the house indicia and may be irrespective of a pattern of the player indicia. The embodiments described herein may include allowing the player to select the number of and specific player indicia to be utilized for a keno game or may include an automated or quick pick selection. For example, a player may select one player indicia or spot to play a 1 spot game, 2 player indicia or spots for a 2 spot game, 3 player indicia or spots for a 3 spot game, etc. Embodiments may also require a minimum number of player indicia or spots to match to win a game. For example, 10-player indicia or 10 spot game may require a minimum of 5-player indicia or spots to match the randomly selected player indicia. Embodiments may also include a maximum number of player indicia or spots that are playable. For example, in an 80 number game, the maximum number of house indicia or spots selectable by the player may be confined to 20 numbers or less or a 20 number game or less. Accordingly, in an 80 number game, the minimum number of player indicia or spots may be 2 and the maximum player indicia or spots may be 20. The player may win one or more prizes based on the number of player indicia matched by the called house indicia.

In the example of sports wagering, a player may be seated in a player area that may include a betting terminal which includes a monitor and input means. A player may make or place periodic wagers on a variety of sporting events.

As the player plays the games, the gaming device and/or a server or another computing device tracks data representative of the gameplay of the player (referred to herein as "gameplay data"), such as a theoretical win or loss, a past history, wager amounts, a number of plays per hour, wager amounts relative to an amount of time spent playing games on the gaming device, a number of wins or losses of the player, a cumulative amount wagered by the player, an amount of money won or lost by the player, and/or any other suitable data. The gameplay data is used to determine whether the player is eligible to receive a comp. The comp may include, for example, one or more free beverages, free meals, free tickets, reduced price meals or tickets, and/or the like.

In one embodiment, a comp indicator is included within, attached to, or displayed on the gaming device. The comp indicator may be energized or activated in any conventional way to indicate status including displaying on the game monitor, player tracking module or the like. The comp indicator is used to display to the player and/or to gaming establishment employees whether the player is eligible to receive the comp. If the gameplay data indicates that the player has reached a predetermined threshold of play and/or wagering activity, for example, the player is determined to be eligible to receive the comp. The comp indicator may then be activated to notify the player and/or gaming establishment employees that the player is eligible to receive the comp. The comp indicator activation may include any suitable means for displaying comp status, comp eligibility, change in comp status, incremental progress toward comps, continual progress toward comps, reduction in comp status after awarding of comps, etc., and may include any visual or sensory indicator or indication. Gaming establishment employees may then take action in response to the notification, such as by awarding the comp to the player. While the comp indicator is sometimes described as being a visual indicator, it should be recognized that the comp indicator may notify the player and/or gaming establishment employees using any suitable sensory perception.

A technical effect of the systems and methods described herein includes one or more of: (a) presenting a game of chance to a player on a gaming device; (b) enabling the player to input money or credits or physical items representing money or credits for use in the game of chance using a payment input device of the gaming device; (c) enabling the player to withdraw money or credits from the gaming device using a payment output device of the gaming device; (d) providing a comp indicator attached to or integrated within the gaming device, wherein the comp indicator is configured to provide an indication if the player is determined to be eligible for a comp; (e) generating gameplay data associated with the game of chance for the player using the gaming device; (f) receiving input from the player at the gaming device to enable the player to play the game of chance; (g) randomly determining a game outcome for the game of chance using a randomization device; (h) transmitting the gameplay data from the gaming device to a computing device; (i) determining, by the computing device, whether the player is eligible for the comp based on the gameplay data; and (j) transmitting data representative of whether the player is determined to be eligible for the comp from the computing device to the gaming device.

Comp monitoring or accounting may also be monitored locally or remotely by management to insure proper compliance. Systems and methods described herein may be self-contained within a gaming device or may reside in a server-based system such as a slot accounting system (SAS).

As used herein, a "game of chance" or "game" refers to a manual or an electronic game that is played by a player in which an outcome of the game of chance is at least partially based on chance or a random selection of game components. A game may be categorized by a game variety and/or a game size, for example. It should be recognized by those of ordinary skill in the art that the term "random" is not limited to true randomness, such as truly random numbers. Rather, pseudorandom numbers and pseudorandom algorithms are included within the meaning of "random." In addition, those of ordinary skill in the art will recognize that permutation generators may additionally or alternatively be used to generate player card indicia or other game components.

Gaming devices described herein may use real money for play or may utilize a credit-based system in which the credits used for the games may or may not have a cash value. Similarly, prizes for the games may be in the form of credits, cash, and/or physical prizes such as televisions, automobiles, or the like.

The play of a game, or the gameplay, includes the drawing or selection of a plurality of house indicia after one or more player cards have been selected. The house indicia are drawn or selected until the game ending criteria is met. The game ending criteria may include, for example, the matching of a pattern on the player card, or the drawing or selection of a predetermined maximum number of house indicia. It should be recognized that other suitable game ending criteria may be used to end the play of the game.

As used herein, the term "player indicia" refers to indicia, such as objects, graphics, symbols, numbers, letters, or the like, that are printed on, displayed on, or otherwise associated with a player card used by the player to play a game of chance. In at least some embodiments, the player may select one or more player indicia for each player card or a permutation generator may select one or more player indicia for each player card.

The term "house indicia" or "game indicia" refers to indicia generated, called, or otherwise selected by a gaming establishment or an operator of the game. In one embodiment, house indicia are compared to player indicia on each player card to determine if each player card satisfies one or more winning conditions.

The term "ball call" refers to a random selection of house indicia in connection with a game of chance. The terms "select," "draw," "call," "determine," and "generate" are used interchangeably with respect to the selection of house indicia, numbers, or balls in a game. A ball call may include drawing or receiving a random ball with a number indicated on the ball or may more generally refer to a random selection of a number or another suitable house indicia using a randomization device. A "ball," as used herein, may be a round plastic, wood, or glass spherical object with a number or other indicia displayed thereon, or may be an electronic representation of a spherical object with a number or other indicia displayed thereon. It should be recognized that the term "ball" may also include non-spherical objects or electronic representations, such as cubes, cards, electronic images, and/or the numbers or indicia by themselves As used herein, the term "pattern" refers to a predetermined combination of spaces of a player card. In at least some embodiments, a winning combination is satisfied if player indicia included within the spaces associated with a pattern are matched to house indicia called during the game.

As used herein, the term "the house" refers to a game operator or a gaming establishment operator. For example, if a game is operated within or by a casino, the casino may be referred to as the house. Alternatively, the house may refer to a software application contained within a mobile device, such as a cell phone or a tablet computing device, that operates the game on the mobile device.

As used herein, the term "fixed prize" or "fixed payout" refers to a prize or payout that is a predetermined multiple of an amount wagered on the game, or that is a fixed amount regardless of the amount wagered. The fixed prizes or payouts are typically listed on a pay table associated with the game.

In contrast, progressive prizes or payouts are prizes or payouts in which at least a portion of the payout or prize increases or changes based on the amounts wagered by the players who are playing the game to win the progressive prize.

Any suitable game of chance may be played that operates according to the described embodiments. Example games of chance playable according to the disclosure herein include video poker, video reel slots, a traditional or electronic keno game, a traditional or electronic bingo game, a Vegas Numbers® game, a Nevada Numbers® game, a Super Flashboard® game, a Pattern Bingo™ game, and sports betting. However, it should be emphasized that these games are merely exemplary, and any other suitable game may be played as described herein.

In a Vegas Numbers® game, the player may select between 1 and 10 player indicia from a pool of 80 indicia for one or more player cards. In addition, 20 house indicia are drawn from the pool of 80 indicia. The house indicia are compared to the player selected indicia. Prizes are awarded based on a number of player indicia that match the selected house indicia, regardless of whether a pattern of player indicia is matched. In one embodiment, a progressive prize may be awarded as one or more of the prizes. The prizes and/or the game may be linked or shared among other gaming devices or locations so that any one of the gaming devices may win one or more of the prizes, such as the progressive prize.

In a Nevada Numbers game, the player may select 5 player indicia out of a pool of 80 indicia for one or more player cards. In addition, 5 house indicia are drawn from the pool of 80 indicia. The house indicia are compared to the 5 player selected indicia. Prizes are awarded based on a number of player indicia that match the selected house indicia, regardless of whether a pattern of player indicia is matched. A progressive prize may be awarded as one or more of the prizes. The prizes and/or the game may be linked or shared among other gaming devices or locations so that any one of the gaming devices may win one or more of the prizes, such as the progressive prize.

In a Super Flashboard bingo game, the player may select between 5 and 10 player indicia out of a pool of 75 indicia for one or more player cards. In addition, 24 house indicia are drawn from the pool of 75 indicia. The house indicia are compared to the player selected indicia. Prizes are awarded based on a number of player indicia that match the selected house indicia, regardless of whether a pattern of player indicia is matched. A progressive prize may be awarded as one or more of the prizes. The prizes and/or the game may be linked or shared among other gaming devices or locations so that any one of the gaming devices may win one or more of the prizes, such as the progressive prize.

In the Pattern Bingo game, the player may select a number of player indicia from a pool of 75 indicia for one or more player cards. The player may also select one or more patterns of player indicia to be matched and may also select the player indicia within each pattern. A predetermined number of house indicia, such as 48 house indicia, are drawn from the pool of 75 indicia. The house indicia are compared to the player selected indicia. Prizes are awarded based on whether the pattern or patterns of player indicia are matched by the selected house indicia. A progressive prize may be awarded as one or more of the prizes. The prizes and/or the game may be linked or shared among other gaming devices or locations so that any one of the gaming devices may win one or more of the prizes, such as the progressive prize.

A "local game" is a game that is played by players within a predetermined location, such as within a single gaming establishment, or players playing the game across a local area network. A "local prize" or a "local payout" (including a local progressive prize or a local progressive payout) is a prize that may be won during a local game.

In some embodiments, different groups of players may qualify to compete to win different prizes. For example, a first group of players positioned in a gaming establishment may be able to compete to win one or more local prizes (e.g., progressive prizes and/or pari-mutuel prizes) while a second group of players may not be able to compete to win those prizes, for example, if the second group of players is positioned outside of the gaming establishment. However, the first group of players and the second group of players may be able to compete to win one or more other shared or common prize, such as one or more progressive and/or pari-mutuel prizes administered over a wide area network.

An "individual prize" is a prize that is only awarded to a player of an individual gaming device. For example, if a group of players are playing a game over a network, the game may provide one or more individual prizes that are tied to a single gaming device such that the individual prizes are only able to be won by the player of the gaming device. Individual prizes are sometimes referred to as gaming device specific player prizes because the individual prizes are specific to a player's gaming device. Accordingly, while a plurality of players may play to win one or more shared or common progressive prizes and/or pari-mutuel prizes, each player is prevented from winning individual prizes associated with, or "tied to," any other player's gaming device.

As used herein, the terms "connect" and "couple" are not limited to only including direct connections. Rather, unless otherwise specified, indirect connections are included within the definitions of "connect" and "couple." For example, two devices may be considered to be connected together even if there are other devices or components connected between the two devices. Any suitable means to connect or couple devices or components together may be used.

A player reward card refers to a physical or electronic card, token, or other device or data that enables a system to identify a player in connection with, among other things, a reward program or campaign. Accordingly, the player reward card may serve to identify the player and may enable gameplay, credits, funds, or other data to be associated with the player. In addition, player card tier levels may be established to denote the level of player play or relative worth to the casino operator.

A player card refers to a card that may be used by the player to play bingo or another game of chance. The player card typically includes a plurality of spaces that may display or include player indicia. The player card may be an electronic card that is transmitted to a device or generated by a device that the player is using to play the game of chance. Alternatively, the player card may be manufactured from paper, cardboard, cardstock, plastic, and/or any other suitable material.

The methods described herein may be embodied within a plurality of instructions stored within a memory device of a computing device. Moreover, a processor of the computing device, or of a computing device coupled to the memory device, executes the instructions to perform the functions described herein and/or to cause the functions described herein to be performed. The instructions may be grouped together to form one or more computer-readable program modules.

Computing devices typically include at least one processor and at least one memory device. As an example, the processor may be, without limitation, an x86-based logic circuit, an ARM-based logic circuit, and/or a system-on-a-chip circuit. It should be recognized that these examples are non-limiting, and a variety of other programmable circuits may be included within the definition of "processor." The memory device may include random access memory (RAM), flash memory, read-only memory (ROM), hard disk drives, magnetic-based memory, and/or any other form of computer-readable memory.

A desktop computer is one example of a computing device. Other examples of computing devices include, without limitation, electronic gaming machines (also known as slot machines), kiosks, cell phones, tablets, PDAs, laptop computers, and smart watches. It should be recognized that computers or computing devices may be implemented as one or more virtual machines, virtual servers, and/or any other virtual device. A server is another type of computing device that may receive network connections from a computer or a plurality of computers or other computing devices.

As used herein, the term "module" or "program module" refers to a computer program, dataset, and/or instruction set that, when executed by a processor, performs the functions described herein. In one embodiment, the module may be included within a computer program, or may be connected to a computer program in any suitable manner. Any computer readable instructions may be programmed or hard-coded in a device, such as a gaming device, in any suitable manner.

FIG. 2 is a block diagram of a system 200 that may be used to play one or more games of chance, such as video poker, video slots, sports betting, bingo, keno or any the wagering game. The games of chance may be played by a player against other players or may be played by the player against the house.

System 200 is operated using components and devices within one or more gaming establishments 202, such as a first gaming establishment 204, a second gaming establishment 206, and a third gaming establishment 209. It should be recognized that any suitable number of gaming establishments 202 may be provided within system 200. Accordingly, system 200 is not limited to including two gaming establishments 202 as illustrated. In one embodiment, gaming establishments 202 are locations in which devices (e.g., gaming devices) that play or operate at least a portion of the game of chance are located. For example, gaming establishments 202 may be casinos, racetracks, bingo halls, keno parlors, or any other establishments. In another example, gaming establishments 102 may be residences or businesses in which one or more devices are located for playing or operating the game of chance. Gaming establishments 102 may additionally or alternatively include any combination of the examples described herein.

In one embodiment, gaming establishments 202 are physically remote from each other and are communicatively connected to at least one network 208, such as a wide area network (WAN), a metropolitan area network (MAN), and/or the Internet, for example. Alternatively, the gaming establishments 202 may be separate rooms or sections of a casino or another facility that are communicatively connected by network 208. It should be recognized that network 208 may be a wired Ethernet network, a wireless Ethernet network, a combination of wired and wireless Ethernet networks, or any other suitable wired and/or wireless network.

In one embodiment, each gaming establishment 202 includes a local game server 210 (referred to herein as a "local server") and a player reward server 212. Local server 210 and player reward server 212 may alternatively be implemented as or within a single server. The local server 210 is coupled to a plurality of the gaming devices 214 through an internal network 216, such as a private local area network (LAN) within the gaming establishment 102, for example. The gaming devices 214 may be located in separate gaming establishments 202, or within the same gaming establishment 202. In one embodiment, a gateway 218 is provided to enable the local server 210 of each gaming establishment 202 to securely connect to the network 208.

In one embodiment, the local server 210 is a server computer (or "server") that monitors and controls the games played on gaming devices 214, including local games. In one embodiment, the local games include games that are played against the house and/or that are played against other players within gaming establishment 202.

In addition, the local server 210 may administer other background tasks that enable games to be played on the gaming devices 214. For example, the local server 210 may facilitate authenticating gaming devices 214 and the players using the gaming devices 214 and may facilitate allocating payments or credits between players and the house. The local server 210 may include payment processing capabilities to enable players to receive electronic funds from a bank or another financial institution or to deposit electronic funds to the bank or financial institution. Alternatively, the payment processing capabilities may be included in a separate server or another device that is communicatively connected to the local server 210. In addition, the local server 210 may interface with the player reward server 212 to facilitate tracking and administering player rewards. Each gaming device 214, group of gaming devices 214, local servers 210, player reward servers 212, or the like may collect and/or generate data desired for accounting purposes, such as for use in slot accounting systems.

In one embodiment, the local server 210 may enable the gaming devices 214 within the gaming establishment 202 to participate in one or more games that share one or more progressive or pari-mutuel prizes with other gaming establishments 202 and/or gaming devices 214. While progressive prizes are described in embodiments herein, it should be recognized that pari-mutual prizes may be substituted as desired, and vice versa. In such an embodiment, each local server 210 may be coupled to a wide area progressive (WAP) server 220 that administers the prizes. For example, the WAP server 220 receives data from each local server 210 and/or from gaming devices 214 regarding an amount wagered by each player playing the game. WAP server 220 may allocate a portion of each wager to the prizes and may communicate the current prize amounts to local servers 210 and/or to the gaming devices 214.

The gaming devices 214 may include one or more kiosks or electronic gaming machines (EGMs) (also known as "slot machines"). The gaming devices 214 may additionally or alternatively include one or more desktop computers or one or more mobile gaming devices 222, such as, without limitation, cellular phones, tablet computing devices, and/or laptops. Mobile gaming devices 222 may connect to local server 210, WAP server 220, and network 208 via a wireless data network represented by cell tower 224. For example, mobile gaming devices 222 may connect to any suitable network 108 (and thereby to local servers 210 and/or WAP server 120) via a "3G", "4G" or a "5G" wireless data network. It should be recognized that mobile gaming devices 222 may additionally or alternatively connect to network 208 using another suitable wireless network, such as a wireless Ethernet network. For convenience, gaming devices 214 described herein may also include mobile gaming devices 222.

One or more point-of-sale (POS) terminals 226 or redemption kiosks may also be included within each gaming establishment 202 to enable players to "cash out" winnings from one or more gaming devices 214 and/or to perform other account management activities related to player accounts. The POS terminals 226 may be connected to the local server 210, for example, and/or to the WAP server 220 as desired.

In addition, the system 200 may include an auditing system 128 coupled to WAP server 220, the local server 210, and/or a gaming device 214, for example, through network 208. Accounting (auditing) system 228 may be used to audit and/or track components of system 200 to ensure compliance with applicable regulations.

In one embodiment, a plurality of gaming devices 214 having different operating systems and/or system architectures may connect to the local server 210 or to another suitable server to play one or more games of chance. In such an embodiment, the gaming devices 214 may be used to play a session bingo game, for example, or any other game of chance.

During operation, the player utilizes or selects a gaming device 214 and initiates a gaming session for playing one or more games of chance ("games"). Optionally, the player inserts a player reward card or enters a player reward number or other identification information into gaming device 214. If the identification information is entered, the gaming device 214 may transmit the identification information to local server 210 for authentication, or authentication may be accomplished locally within the gaming device 214. The local server 210 communicates with player reward server 212 to establish the player's identity and to associate the gameplay with the player account. The local server 210 authenticates the player and gaming device 214 and authorizes the player to play the game or games on gaming device 214 if desired or required.

When game play is initiated, during selection of the game, or during play of the game, the player may be required to purchase or generate credits. The player may purchase or generate credits by inserting cash or a ticket-in-ticket-out voucher into gaming device 214 or another device. Cash, ticket-in-ticket-out vouchers, credit cards or debit cards are examples of physical items associated with the gaming device. Alternatively, or additionally, the player may transfer credits or cash to the gaming device 214 from banking accounts, credit accounts, gaming establishment accounts, and/or gaming company accounts. In one embodiment, computer-generated credits may be used with gaming device 214, for example, as part of a free-to-play game.

The player selects a game to play and enters a wager on the gaming device 214. The gaming device 214 transmits data representative of the selected game and the wager to the local server 210. If the player selects a game that is at least partially operated by the WAP server 220 or that includes one or more progressive prizes administered by WAP server 220, local server 210 transmits the wager and game information and/or selection to WAP server 220. The WAP server 220 may increment the progressive prizes based on the wager received from the player and may communicate the updated prize amounts via the network 208 to all other players (via associated gaming devices 214) playing to win the progressive prizes.

The player plays the game on the gaming device 214. The following gameplay is described as being administered by the WAP server 120. However, it should be recognized that the gameplay (i.e., the play of the game of chance) may be alternatively or additionally administered by the local server 210 and/or the gaming device 214. For example, if the gaming device 214 is a cellular phone or a tablet computing device, the gameplay may be administered through an application installed on the gaming device 214.

In one embodiment, the player may play a game of bingo by selecting a game or game type, one or more player cards, selecting one or more winning patterns for the player cards, and/or selecting one or more numbers or other player indicia for the player cards using the gaming device 214. The selected player cards, winning patterns, and player indicia are transmitted to WAP server 220. The player cards are included within one or more game tickets issued by WAP server 220, and the game tickets are communicated to the gaming device 214 via the network 208 and the local server 210. The WAP server 220 selects or receives randomly generated house indicia and compares the house indicia to the player indicia and the pattern or patterns selected for the player cards. Alternatively, the functions described herein (e.g., comparing the house indicia to the player indicia and the pattern or patterns selected for the player card) may be performed in the gaming device 214. It should be recognized that the house indicia may be randomly generated using a randomization device, such as hardware, firmware, and/or software-based random number generator (RNG), a ball blower or console, a ball cage, and/or any other suitable device or machine that enables numbers or other house indicia to be randomly generated. In an alternative embodiment, the WAP server 220 (or another device) may designate a server, computer, or another device to provide randomly selected house indicia during the game and may receive the house indicia from the designated device.

WAP server 120 determines whether the player wins a prize based on the comparison of the house indicia to the player indicia. For example, WAP server 120 determines whether the player indicia within the pattern or patterns selected for each card match the house indicia that were randomly determined (sometimes also referred to as the house indicia that were "called"). If the player indicia within a pattern match the called house indicia, the player may win a prize based on a pay table associated with the game. The prize may be one of the progressive prizes or the prize may be a fixed prize identified in the pay table. WAP server 120 determines the appropriate payout to be paid to the player based on the pay table and transmits data representative of the payout to local server 110.

Local server 110 receives the payout data and credits the player account accordingly. In addition, local server 110 may transmit the gameplay data and/or payout data to player reward server 112 to enable player reward server 112 to update the player history and other gameplay data for the player. When the player is done playing, the player may "cash out" some or all of the credits in the player account or may deposit the credits into the player account using POS terminal or kiosk 126, for example. The player account may be stored on gaming device 114, local server 110, or player reward server 112, for example.

In one embodiment, the player may enter the wager and/or may initiate play of the game on a first gaming device 214 and may complete the gameplay on a second gaming device 214. Alternatively, the player plays the game on the first gaming device 214 and receives the results of the gameplay (e.g., whether the player won and how much the winnings are) on the second gaming device 214. For example, the player may begin playing the game on a kiosk or electronic gaming machine, and may complete the game or view the results of the game on a cell phone. In such an embodiment, the WAP server 220 and/or local server 210 may transmit the player's gameplay data from the first gaming device 214 to the second gaming device 214.

Figure 3:
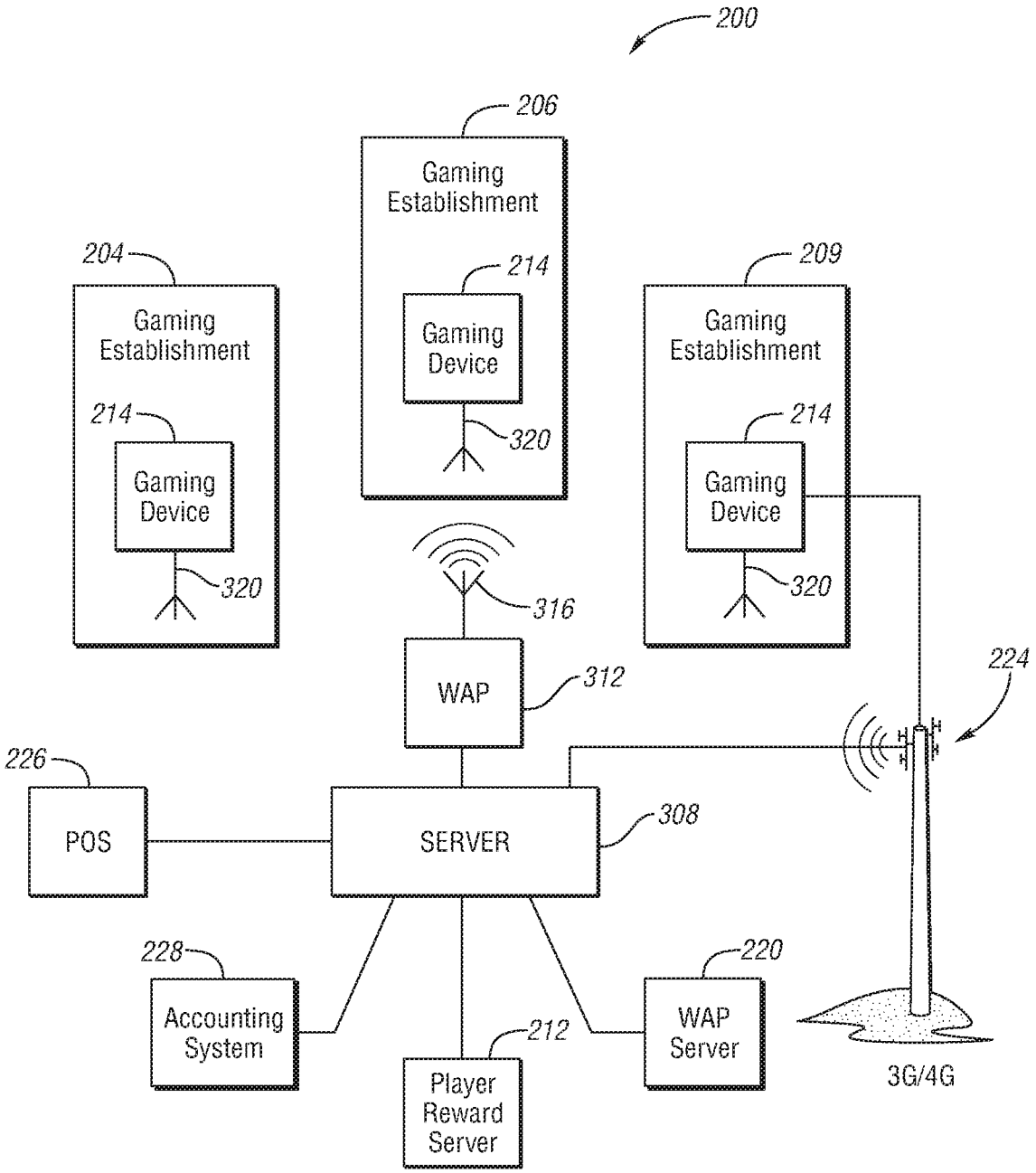
FIG. 3 illustrates a block diagram of a gaming system with a wireless communication arrangement.

FIG. 3 is a block diagram of another system 200 that may be used to play one or more games of chance, such as bingo or keno, or any game of chance. Unless otherwise specified, the system 200 is similar to system 200 (shown in FIG. 2) and similar components are labeled in FIG. 3 with the same reference numerals used in FIG. 2. It should be understood that more or less components may be included within the various embodiments described herein.

In the embodiment shown in FIG. 3, the system 200 includes a plurality of gaming devices 214 that are positioned in a plurality of gaming establishments 202. Gaming devices 214 may connect to a server 308 through a wireless access point 312. The wireless access points 308 includes an antenna 316 configured to wirelessly transmit to and receive signals from antennas 320 associated with the gaming devices 214. Wireless communications systems and methods are understood by one of ordinary skill in the art and as such are not described in detail here. For example, the gaming devices 214 may be playing one or more stand alone or Internet-based games that connect to the WAP server 220 through a server 308. In some embodiments, one or more gaming devices 214 may connect to the WAP server 220 and/or to the player reward server 212 through a wireless data network as described above. Accordingly, the gaming devices 214 interact with WAP server 220 to play the game, and WAP server 220 performs the game administration and other tasks handled by local server 210 as described above in FIG. 2. In a similar manner, a POS terminal 226 may connect to a gaming device 214 and/or WAP server 220 via network 208. In other respects, system 200 performs in a similar manner as described above.

During operation, the player utilizes or selects a gaming device 214 and initiates a gaming session to play one or more games on the gaming device 214. The player inserts a player reward card or enters a player reward number or other identification information into the gaming device 214. The gaming device 214 transmits the identification information to player reward server 212 to establish the player's identity and to associate the gameplay with the player account. The player reward server 212 authenticates the player and the gaming device 214 and may authorize the player to play the game on the gaming device 214. In one embodiment, the gaming device 214 also transmits the identification information to the WAP server 220 to enable the WAP server 220 to associate the player with the game to be played. As previously described, player identification or authentication may be optional.

In another embodiment, the WAP server 220 authenticates the player using the player identification information in addition to, or instead of, the authentication performed by the player reward server 212. In some embodiments, the player reward server 212 is omitted and the functions of player reward server 212 are incorporated within WAP server 220.

The player selects a game to play and enters a wager using gaming device 214. If the player selects a game that is operated by the WAP server 220 or that includes one or more progressive prizes administered by the WAP server 220, the gaming device 214 transmits the wager and game selection to the WAP server 220. The WAP server 220 may increment the progressive prizes based on the wager received from the player and may communicate the updated prize amounts over the wireless channel via the server 308 to all other players (via associated gaming devices 214) playing to win the progressive prizes.

Although shown as a wireless network, it is contemplated that the same functionality may be implemented in a wired system, or a combination of both.

The player plays the game on gaming device 214. The following gameplay is described as being administered by the WAP server 220. However, it should be recognized that the gameplay may be alternatively or additionally administered by the gaming device 214. For example, if the gaming device 214 is a cellular phone or a tablet computing device, the gameplay may be administered through an application installed on gaming device 214.

In one embodiment, the player may play a game of bingo by selecting one or more player cards, selecting one or more winning patterns for the player cards, and/or selecting one or more numbers or other player indicia for the player cards using the gaming device 214. In another embodiment, the player may play a game of keno by selecting one or more player cards and selecting one or more numbers or other player indicia for the player cards using gaming device 214. The selected player cards, winning patterns (for example, in the bingo embodiment), and player indicia are transmitted to the WAP server 220. The player cards are included within one or more game tickets issued by the WAP server 220, and the game tickets are communicated to the gaming device 214 via a wireless connection. The WAP server 220 selects or receives randomly generated house indicia and compares the house indicia to the player indicia and the pattern or patterns selected for the player cards. It should be recognized that the house indicia may be randomly generated using a randomization device, such as hardware, firmware, and/or software-based random number generator (RNG), a ball blower or console, a ball cage, and/or any other suitable device or machine that enables numbers or other house indicia to be randomly generated.

The WAP server 220 determines whether the player wins a prize based on the comparison of the house indicia to the player indicia. For example, in an embodiment in which the player plays a game of bingo, the WAP server 120 determines whether the player indicia within the pattern or patterns selected for each card match the house indicia that were randomly determined. If the player indicia within a pattern match the called house indicia, the player wins a prize based on a pay table associated with the game. In an embodiment in which the player plays a game of keno, the WAP server 220 determines whether the player indicia selected for each card match the house indicia that were randomly determined. If a predetermined number of the player indicia match the called house indicia, the player wins a prize based on a pay table associated with the game. The prize may be one of the progressive prizes or the prize may be a fixed prize identified in the pay table. WAP server 120 determines the appropriate payout to be paid to the player based on the pay table and transmits data representative of the payout to the gaming device 214 for display to the player.

The WAP server 220 also credits the player account to reflect the prize that was won by the player. In addition, the WAP server 220 may transmit the gameplay or payout data to player reward server 212 to enable the player reward server 212 to update the player history and other gameplay data for the player. When the player is done playing, the player may "cash out" some or all of the credits in the player account and/or the gaming device 214 or may deposit the credits in the player's account using POS terminal 2126, for example.

In one embodiment, the player may purchase any number of future games (i.e., games to be played in the future) by entering a wager, a number of cards to play for each game, and a number of games to play. After inserting sufficient cash or credits to pay for the games, the WAP server 220 or another device or machine that is administering the game (such as the gaming device 214) may automatically display the called house indicia for each game and a result of each game to the player. The player may watch the results of the game in real time, or may view the results at a later time, for example, by viewing a summary of the game results. The player may view the results (in real time or later) on the same gaming device 214 used to initiate the games and enter the wagers, on another gaming device 214, or on any other suitable device.

In another embodiment, such as an embodiment in which the game is administered through an application installed on a cell phone, a tablet computing device, or another gaming device 214, the WAP server 220 only administers the progressive prizes, or some or all prizes associated with the game being played. In such an embodiment, the gaming device 214 randomly selects the house indicia using a randomization device included within, or connected to, the gaming device 214. In addition, the gaming device 214 may determine whether the player indicia within the player selected pattern match the house indicia, thus determining whether the player wins a prize. The gaming device 214 may transmit the results of the game to the WAP server 220. The results of the game may include, for example, an indication whether the player won, the house indicia randomly selected, the player indicia selected, the player pattern selected, the number of ball calls that were required to match the house indicia to the player indicia, and/or any other aspect of the game.

In one embodiment, the WAP server 220 confirms the result of the game before awarding the prize to the player. For example, the WAP server 220 may determine whether the house indicia match the player indicia within the player selected pattern independently of the game result reported by gaming device 214.

Figure 4:
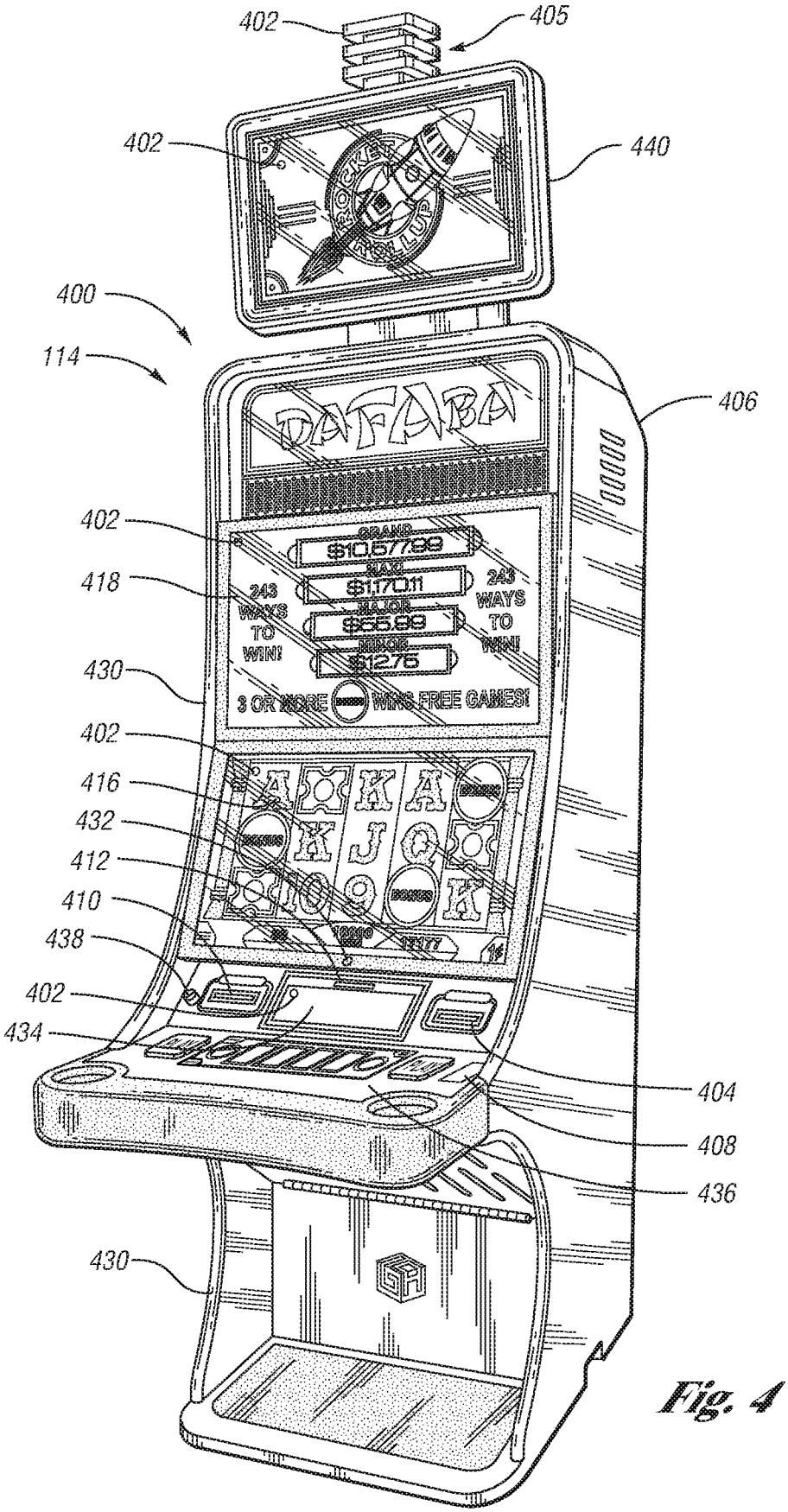
FIG. 4 illustrates an exemplary gaming machine.

FIG. 4 is an illustration of an exemplary electronic gaming machine (EGM) 400 that may be used with the systems described herein. In one embodiment, EGM 400 is a gaming device 114. EGM 400 may include one or more comp indicators 402, which may be incorporated into, or implemented by, a candle device 405, lighting element 430, displayed on monitor 416 or 418 displayed on the player tracking module 434, displayed as an LED indicator on button panel 436, or another device. One or more cameras 432 are provided with or as part of the EGM 400 to capture images of the player or other aspects of game play.

The comp indicator 402 visually notifies or alerts the player or casino staff when the player is determined to be eligible to receive one or more comps from a gaming establishment, for example. The comp indicator 402 may also display or otherwise notify the player of the progress towards attaining the comp or comps. Such comps may include, for example, one or more free beverages, free meals, free rooms, free credits for one or more games of chance, free prizes, free tickets to a performance, free services (e.g., spa services), and/or a discount or reduced price for one or more of the foregoing goods or services (e.g., with respect to a market price of the goods or services). In one embodiment, comp indicator 402 may include an audio notification or other sensory notification in addition to, or in place of, the visual notification. While comp indicator 402 is described as being used with EGM 400, it should be recognized that comp indicator may be used with any gaming device 114 and/or computing device.

The EGM 400 also includes a cabinet 406 configured to support and secure the elements of the EGM. The EGM 400 includes one or more screens such as an upper screen 418 and a lower screen 416. The screens 416, 418 may be configured to display game content to the player or any other information regarding the game, the casino, rules, pay tables, promotions, advertisements, or any multimedia content. Any type screen may be used, such as a flat screen display. Additional lights 430 may be incorporated into the gaming machine to providing lighting for the player or ornamentation for the EGM 400.

A scanner 408 is provided to scan tickets which have bar or box codes, or for scanning money, cards, or any other media. In addition, scanner 408 may include other connectivity means such as blue tooth communications, near field communications or similar. Similar, a card reader 406 is provided to read one or more aspects of cards, such as player tracker or rewards cards, personal identification cards, and/or credit cards. The EGC 400 may also include a printer 410. The printer may print on any type media. Any type content may be printed including but not limited to cash out tickets, coupons, gift certificates, comps, prizes, gaming codes, redemption codes, bar or box codes, receipt, or any other type of information. Also, part of this embodiment is a cash acceptor 404 configured to accept paper money, ticket-in-ticket-out vouchers, or any type physical item associated with the gaming machine 400. A USB port 438 or other type charging or I/O port is provided for phone charging or interfacing the user's phone to the gaming machine. Numerous other buttons and player interface elements are presented with the gaming machine to accept player input. The screens 416, 418 may be configured as touch screens.

In one or more embodiment the EGM 400 may be configured to present games of chance to a player and one or more of the outcomes of the games of chance may be a trigger that allows the player to participate in the promotional event as described herein. In addition, the EGM 400 may be played by a player and based on time played, games played, coin in, or just being logged into the machine may make the player eligible for participation in the promotional event.

Figure 5:
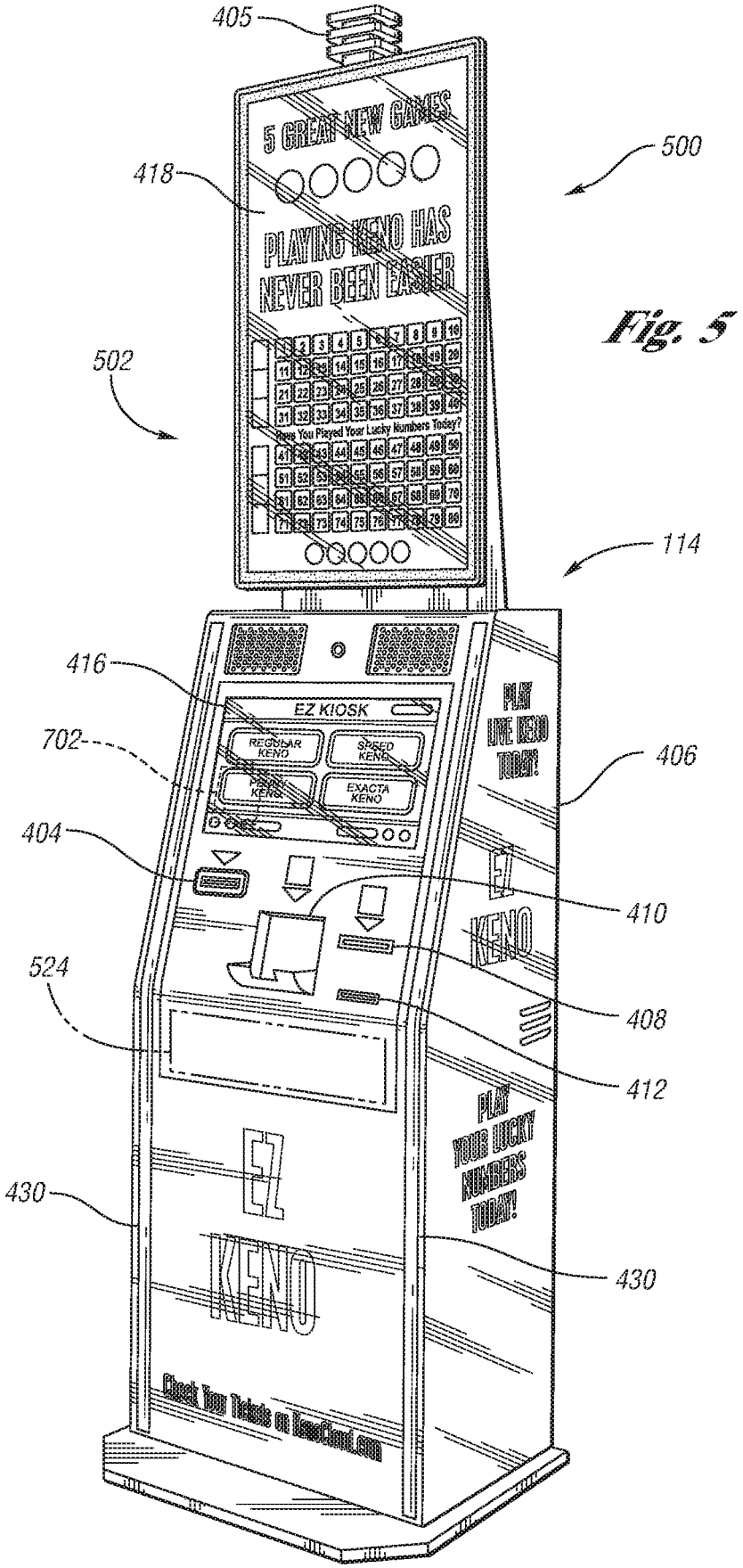
FIG. 5 illustrates an exemplary kiosk.

FIG. 5 is an illustration of an exemplary kiosk 500 that may be used with the systems described herein. In one embodiment, kiosk 500 is an electronic device provided for user to obtain information, conduct business, enter information, or any other use for which is computing device with communication capability is useful. The kiosk 500 may also be used for gaming. Unless otherwise specified, kiosk 500 shares some components and functionality with an EGM 400 (shown in FIG. 4) and similar components are labeled in FIG. 5 with the same reference numerals as used in FIG. 4.

Kiosk 500 may include one or more informational displays 502, which may be incorporated into, or implemented by, a display 418, such as first display 416 and/or second display 418. Also shown in association with the kiosk 500 is a keyboard 524 which may be fixed or fold down from the front of the kiosk to provide a user input device. The screen may be configured as a touch screen thereby allowing user input.

In use, a user may use the kiosk 500 for any use now known or developed in the future. Such uses include but are not limited to, check in or check out for a hotel, spa, restaurant, gaming area, pool, or any other location or service. The kiosk 500 may also be used to sign up for an event or program, such as but not limited to a player reward program, tournament, or event. The kiosk 500 may also be used to purchase tickets, goods or services. One of ordinary skill in the art will arrive at other uses for a kiosk 500. As part of the use of the kiosk, a trigger event may occur or using the kiosk is the trigger event that allows a user to participate in a promotional event.

Figure 6:
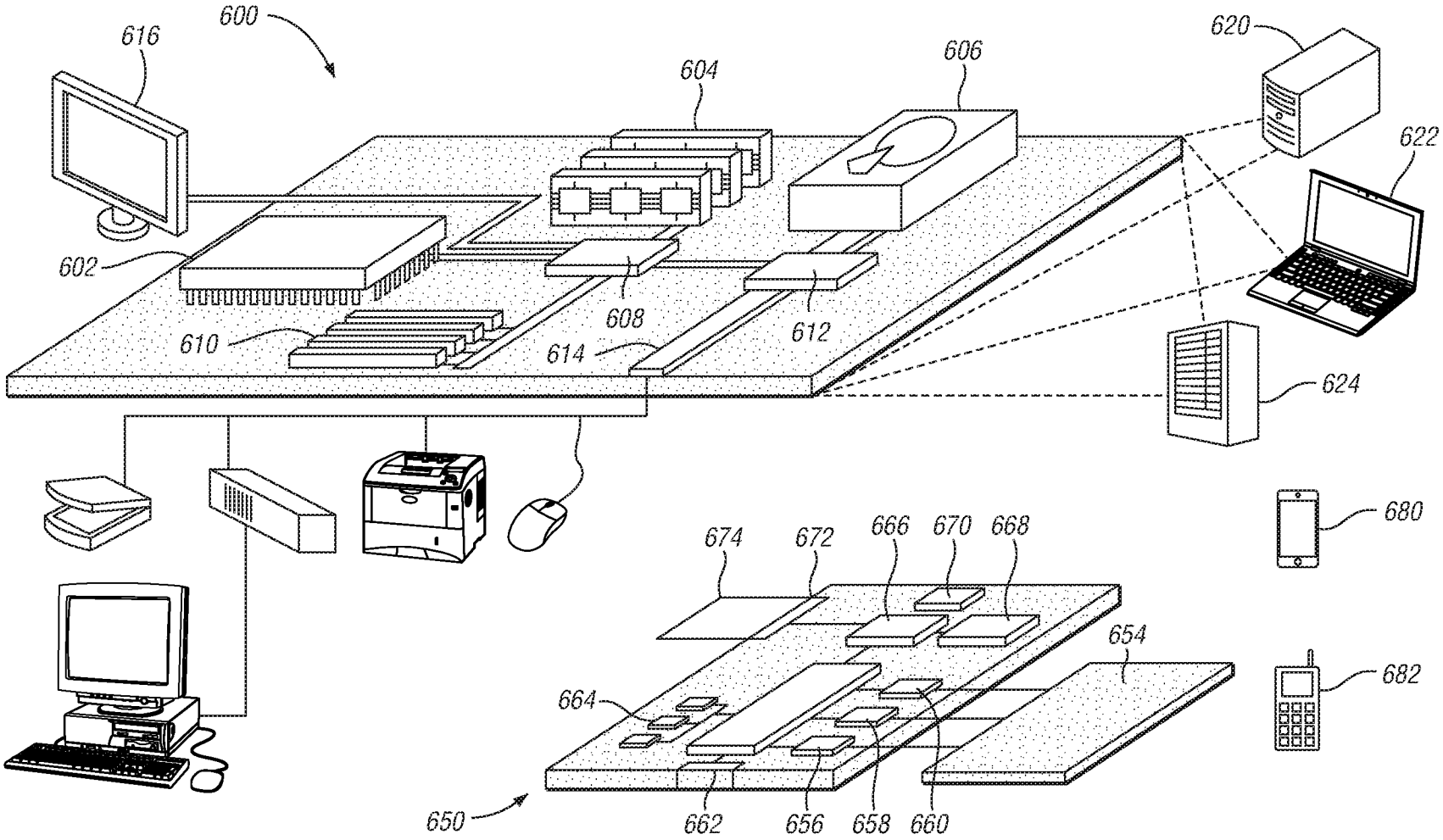
FIG. 6 illustrates an exemplary diagram of the components of a computing device, either mobile or stationary.

FIG. 6 is a schematic of a computing or mobile device, or server, such as one of the devices described above, according to one exemplary embodiment. Computing device 800 is intended to represent various forms of digital computers, such as smartphones, tablets, kiosks, laptops, desktops, workstations, personal digital assistants, servers, blade servers, mainframes, and other appropriate computers. Computing device 650 is intended to represent various forms of mobile devices, such as personal digital assistants, cellular telephones, smart phones, and other similar computing devices. The components shown here, their connections and relationships, and their functions, are meant to be exemplary only, and are not meant to limit the implementations described and/or claimed in this document.

Computing device 600 includes a processor 602, memory 604, a storage device 606, a high-speed interface or controller 608 connecting to memory 604 and high-speed expansion ports 610, and a low-speed interface or controller 612 connecting to low-speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high-speed controller 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a hard disk device, an optical disk device, or a tape device, a flash memory or other similar solid-state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high-speed controller 608 manages bandwidth-intensive operations for the computing device 600, while the low-speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed bus 614. The low-speed bus 614, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a micro-drive or other device, to provide additional storage. Each of the components 650, 652, 664, 654, 666, and 668, are interconnected using various buses, and several of the components may be mounted on a common motherboard or in other manners as appropriate.

The processor 652 can execute instructions within the computing device 650, including instructions stored in the memory 664. The processor may be implemented as a chipset of chips that include separate and multiple analog and digital processors. The processor may provide, for example, for coordination of the other components of the device 650, such as control of user interfaces, applications run by device 650, and wireless communication by device 650.

Processor 652 may communicate with a user through control interface 658 and display interface 656 coupled to a display 654. The display 654 may be, for example, a TFT LCD (Thin-Film-Transistor Liquid Crystal Display) or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provide in communication with processor 652, to enable near area communication of device 650 with other devices. External interface 662 may provide, for example, for wired communication in some implementations, or for wireless communication in other implementations, and multiple interfaces may also be used.

The memory 664 stores information within the computing device 650. The memory 664 can be implemented as one or more of a computer-readable medium or media, a volatile memory unit or units, or a non-volatile memory unit or units. Expansion memory 674 may also be provided and connected to device 650 through expansion interface 672, which may include, for example, a SIMM (Single In Line Memory Module) card interface. Such expansion memory 674 may provide extra storage space for device 650, or may also store applications or other information for device 650. Specifically, expansion memory 674 may include instructions to carry out or supplement the processes described above and may include secure information also. Thus, for example, expansion memory 674 may be provide as a security module for device 650 and may be programmed with instructions that permit secure use of device 650. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652, that may be received, for example, over transceiver 668 or external interface 662.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, Wifi, or other such transceiver (not shown). In addition, GPS (Global Positioning system) receiver module 670 may provide additional navigation- and location-related wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 660. It may also be implemented as part of a smart phone 682, personal digital assistant, a computer tablet, or other similar mobile device.

Thus, various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse, joy stick, trackball, or similar device) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system (e.g., computing device 600 and/or 650) that includes a back end component (e.g., as a data server, slot accounting system, player tracking system, or similar), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

Figure 7:
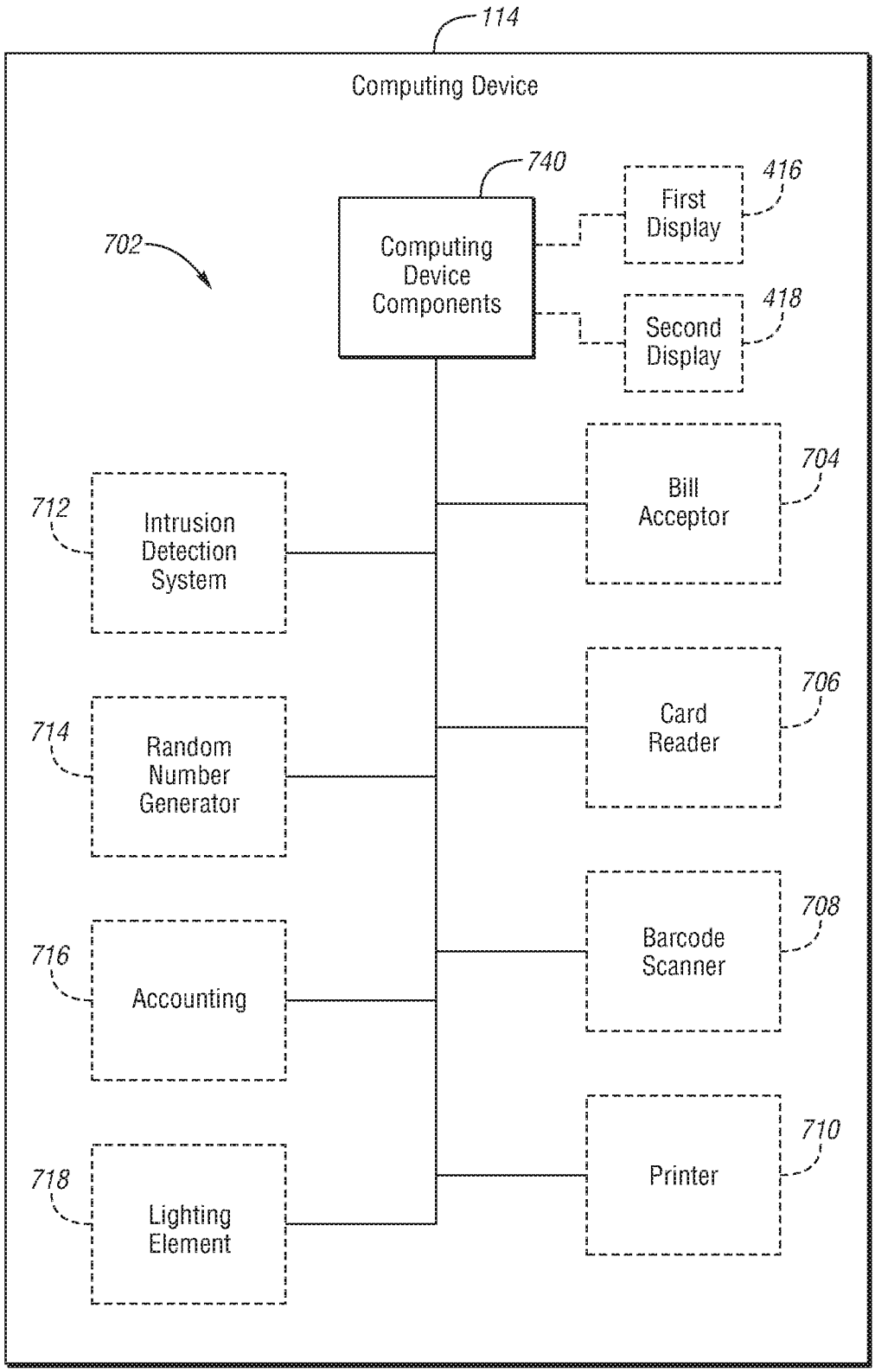
FIG. 7 illustrates a block diagram of exemplary gaming device hardware.

FIG. 7 is a block diagram of a gaming device 114 that may be used with system 100 (shown in FIG. 1) or system 200 (shown in FIG. 2). As described above, the gaming device 114 is a computing device 300 (such as an EGM) that includes a plurality of computing device components 702 positioned within a cabinet or other housing. In one embodiment, computing device component manager or processor 740 include first display 416 and second display 418. In addition, gaming device 114 may include a plurality of gaming device components 702 including a bill acceptor 704, a card reader 706, a barcode scanner 708, a printer 710, an intrusion detection system 712, a randomization device 414 (such as an RNG), and an accounting interface 716 that are positioned within, or coupled to, the cabinet or housing of the gaming device. In one embodiment, gaming device 114 may also include at least one lighting element 418 coupled to the cabinet or housing.

It should be recognized that in some embodiments, a gaming device 114 may not include each gaming device component 702 illustrated in FIG. 7. For example, if the gaming device 114 is a cellular phone or a tablet, the gaming device may not include bill acceptor 704, card reader 706, barcode scanner 708, and/or printer 710. Rather, in some embodiments, the functions of each omitted gaming device component may be replaced by equivalent software, hardware, and/or firmware if desired. Optional components may be designated using dashed lines in the figures.

The bill acceptor 704 is a payment input device that enables gaming device 114 to receive and identify paper currency, ticket-in-ticket-out vouchers, or other physical items representing a monetary value. For example, bill acceptor 704 may receive and identify dollar bills or other currency that are inserted into bill acceptor 704. In one embodiment, bill acceptor 704 includes a scanner that scans paper currency inserted therein. The bill acceptor 704 may also include optical character recognition (OCR) capabilities that enable bill acceptor 704 to identify the amount of currency inserted into bill acceptor 704 from a scanned image of the currency. The bill acceptor 704 may transmit data representative of the amount of currency inserted into gaming device 114 to controller or processor 740, for example. The controller or processor 740 may cause the amount of currency to be converted into credits usable with the game and may add the credits to the player's account.

The card reader 706 is a device that "reads," or obtains data encoded in, player reward cards or other cards or media that are inserted into reader. In one embodiment, the card reader 706 is a magnetic or optical card reader that reads barcodes or magnetic strips included within a player reward card. In another embodiment, the card reader 706 wirelessly reads data encoded within the player reward card by accessing a chip, such as a radio frequency identification (RFID) chip, embedded within the card or other similar authentication means. The card reader 706 reads the data obtained from the cards and transmits the data to the processor 740. In one embodiment, the card reader 706 is used to read player identification information encoded within player reward cards. The controller or processor 740 may transmit the player identification information to player reward server or other external component to identify the player, track past or present player activity, to allow for the transfer of funds or credits, to facilitate authenticating the player, and/or to authorize the player to play a game on gaming device 114. In one embodiment, the player may "log in" to the gaming device 114 by swiping the player reward card or otherwise passing the player reward card through or inserting the player reward card into the card reader 706. In another embodiment, the player may enter a number or other identifier associated with the player reward card into the gaming device 114, through the user interface devices for example, instead of using the card reader 706. In another embodiment, the insertion of the player reward card and player entering the identifier into user interface device may be combined. In yet another embodiment, the player may use a near field communication (NFC) device to read the player reward card or data representative of the player card. Alternatively, the player reward card may be associated with an application on a cell phone or tablet which wirelessly communicates with the card reader or similar system.

In one embodiment, the barcode scanner 708 is an optical or a magnetic scanner that is optimized to read barcodes on media positioned proximate to the scanner and may also include RFID sensors, blue tooth connectivity, near field communications devices, etc. For example, the barcode scanner 708 may be optimized to read barcodes printed on paper receipts (sometimes referred to as "tickets" or vouchers, not to be confused with game or player tickets that may include player selected patterns, player indicia, and the like) and/or barcodes displayed electronically on a cell phone or tablet computing device. It should be recognized that the barcodes read by the barcode scanner 708 may be linear or one-dimensional barcodes, two-dimensional barcodes, or may even include data represented in a form other than a barcode. For example, the barcode scanner 708 may read images and/or text indicative of data, such as currency or credits, usable with gaming device 114. The barcode scanner 708 extracts the data from the barcode and transmits the data to controller/processor 740. For example, the barcode scanner 708 may scan a paper receipt or voucher that includes an amount of currency or credits usable by the player with a gaming device 114 and may transmit the amount of credits to the controller/processor 740. In such an example, the barcode scanner 708 may act as a payment input device. The controller/processor 740 may cause the amount of currency or credits to be displayed to the player on first display 716 (or on any display) to inform the player how many credits or currency is available to be used in playing a game.

The printer 710 may be used to print paper receipts (also known as tickets as described above), ticket-in-ticket-out vouchers, or other physical items representing a monetary value that indicate an amount of currency or credits available to the player. In many locations, the tickets or receipts may alternatively be referred to as vouchers. The printer 710 may act as a payment output device that enables a player to cash out or withdraw money or credits from the gaming device 114 by printing a voucher representative of the money or credits. In one embodiment, the printer 710 is a thermal printer that is fed by a roll of paper or any suitable paper stock. In a further embodiment, the roll of paper includes one or more watermarks that are visible when the printer 710 has printed the receipt on the paper. Alternatively, the printer 710 may print the watermark on the receipt, or may include another security mechanism to facilitate preventing counterfeit receipts from being made. For example, the printer 710 may include an image or a code on the receipt that identifies the gaming device 114, the printer 710, or another component of the gaming device along with a time that the receipt was printed, serial number, date, location, or other desired information. Other suitable security mechanisms may be used as well. It should be recognized that the barcode scanner 708 and the printer 710 may cooperate such that a security mechanism printed on the receipt may be received and validated by the barcode scanner, in conjunction with controller/processor 740, for example. The barcode scanner 708 may be located remotely from the gaming device 114, such as within a redemption kiosk, a casino cage, or the like.

The intrusion detection system 712 notifies the controller/processor 740 if a case, cabinet, or other housing enclosing components of the gaming device 114 is opened or modified without authorization. In one embodiment, the intrusion detection system 712 includes a pair of contacts that may be physical, magnetic, optical, or similar that transmit an electronic signal to the controller/processor 740 if the housing of the gaming device 114 is opened (e.g., if the opening of the housing separates the contacts). In another embodiment, the intrusion detection system 712 may include a light sensor that detects a change in the light within the housing of the gaming device 114. The intrusion detection system 712 may also include a key or another mechanism for disabling the operation of the game or transmission of the signal to the controller/processor 740 in the event that maintenance or other authorized or unauthorized access to the gaming device 114 components is desired or occurs.

In one embodiment, the intrusion detection system 712 includes a software program (a "monitoring program") that monitors one or more applications installed on the gaming device 114. For example, if the gaming device 114 is a cell phone that includes an application for playing the game thereon, the monitoring program may monitor the application to determine whether the application is modified without authorization. In one embodiment, the monitoring program stores a hash value or a digital fingerprint of the application when the application is installed and/or when the application undergoes authorized modification (e.g., if the application is updated or patched). However, if the monitoring program determines that the application has been modified without authorization, the monitoring program may cause a signal or another notification to be transmitted to the controller/processor 740. For example, the monitoring program may periodically calculate a new hash value of the application and/or create a new digital fingerprint of the application. The monitoring program then compares the new hash value and/or digital fingerprint to the stored hash value and/or digital fingerprint. If the hash values or fingerprints are different, the monitoring program may determine that the application has been modified without authorization. It should be understood that the hash value, the monitoring program, and/or the digital fingerprint may be generated by any suitable means and may be encrypted for additional security.

In response to the signal or notification from the intrusion detection system 712 and/or the modification program, the controller/processor 740 may perform one or more actions. For example, the controller/processor 740 may alert an administrator within gaming establishment by transmitting a message via communication device, may cause audio output device to emit an alarm or another audible alert, may cause a display 416, 418 to display an error or a warning, message, and/or may disable the application and/or the gaming device 114 such that the game is unable to be played on the gaming device.

In one embodiment, the randomization device is an electronic random number generator (RNG) or pseudo random number generator (PRNG) 714 or a permutation generator that may be implemented by a dedicated hardware device with associated embedded software. Electronic random number generators or pseudo random number generators are used interchangeably herein. Alternatively, the RNG 714 or the permutation generator may be implemented entirely in software executing on gaming device 114. The RNG 714 may be used to randomly determine a game outcome for the game of chance. In one embodiment, the RNG 714 or the permutation generator provides house or game draws of between 1 and n numbers, where n may be a suitable number based on the game type selected to be played by the player. The RNG 714 or the permutation generator may be programmed via hardware, software, or firmware to provide a particular range of numbers (or other indicia) and numbers of draws for a particular application. For example, in one embodiment of bingo according to the present disclosure, the RNG 714 or the permutation generator initially provides 24 randomly generated numbers having values between 1 and 75 for each game. In other embodiment other methods or numeric values may be used. Additional draws or numbers may be provided to play the game to conclusion depending on the particular implementation as described in greater detail herein. In addition, the RNG 714 or the permutation generator may be used to randomly select a plurality of player indicia to be used with one or more player cards. In embodiments in which a processor, such as controller/processor 740, is described as randomly selecting indicia, it should be recognized that controller/processor may interface with randomization device 714 or the permutation generator to select the indicia. In other embodiments, controller/processor 740 may include randomization device 714 or the permutation generator, or may execute instructions to perform the functions of randomization device 714 or the permutation generator.

The accounting interface 716 is used to interface with an accounting system, such as a slot accounting system, at or operated by a gaming establishment. Accounting interface 716 may include or be connected to a network interface, such as the communication device 308 for use in communicating gameplay data, player identification information, and/or other data to the accounting system for accounting and/or auditing purposes.

The lighting element 718 may include, for example, one or more LEDs, slot machine candles, fluorescent tubes, and/or any other element that emits light as controlled or directed by the controller/processor 740. In one embodiment, the lighting element 718 is activated to display light, or one or more lighting patterns, when the controller/processor 740 determines that a winning ticket was scanned via the card reader 706 or when the controller/processor otherwise determines that a ticket is a winning ticket. The lighting elements 718 may also be activated upon receipt of a signal from the intrusion detection system 712 (e.g., upon the determination that the gaming device 114 has been opened and/or modified without authorization) and/or upon any other suitable determination.

In one embodiment in which the gaming device 114 or kiosk may interface with another gaming device operated by or otherwise associated with the player, such as a cell phone, tablet, or another mobile device. For example, the gaming machine or kiosk may be configured to transmit a result of one or more games of chance to the player's mobile device to notify the player whether one or more player cards or game tickets are winning cards or tickets.

The gaming machine 114 or a kiosk may also notify the player that a software application is available to be installed on the player's mobile device. If the player installs the application on the mobile device, for example, the results of the games of chance and/or the determinations of whether the player's card and/or tickets are winners may be automatically transmitted to the application to be displayed to the player. Alternatively, the gaming machine 114, a kiosk or another device (such as local server 110 or WAP server 120) may automatically transmit the results of the games and/or the determinations of the winning cards and/or tickets to the player's mobile device or other device via email, SMS message, MMS message, and/or by any other suitable means. In one embodiment, the kiosk or another device (such as local server 110 or WAP server 120) may wait to transmit the results of the games until all of the games for the player's purchased cards or tickets have been completed. Accordingly, if the player purchases player cards or game tickets for a current game and/or one or more future games, the results of the current game and the future games may not be transmitted until all of the future games associated with the player's cards or tickets have been completed.

The player may also view the player cards and/or the game tickets that the player has selected on the player's mobile device or other device, for example, using the application. After the player receives the results of the games and/or the determinations of whether the player's cards and/or tickets are winners, the player may use the mobile device (i.e., the application installed on the mobile device) to receive any winnings from the games and/or to cancel any un-played games, player cards, and/or game tickets. The winnings may be credited to the player's account, for example, using the mobile device.

In one embodiment, one or more advertisements, marketing information, and/or promotions may be presented to the player via the mobile device or other device (e.g., through the application). For example, after the player has been notified of any winning tickets or player cards, a promotion may be presented to the player on the mobile device that offers a bonus or discount for one or more products or services if the player uses (or redeems) at least a portion of the winnings to purchase the product or service. Alternatively, the promotion may be transmitted along with, or before, the player has been notified of any winning tickets or player cards. The bonus or discount may be restricted to being usable within a predetermined amount of time after the promotion was transmitted to the mobile device, or the bonus or discount may be increased if the player purchases the product or service within the predetermined amount of time. For example, a promotion may be offered to the player in which the player receives a bonus (free) or discounted dinner if the player cashes in or redeems a winning ticket at a casino within 24 hours of the promotion being sent to the player's device. As another example, the player may receive bonus credits if the player purchases one or more game tickets for a new game of chance using at least a portion of the winnings.

Figure 8:
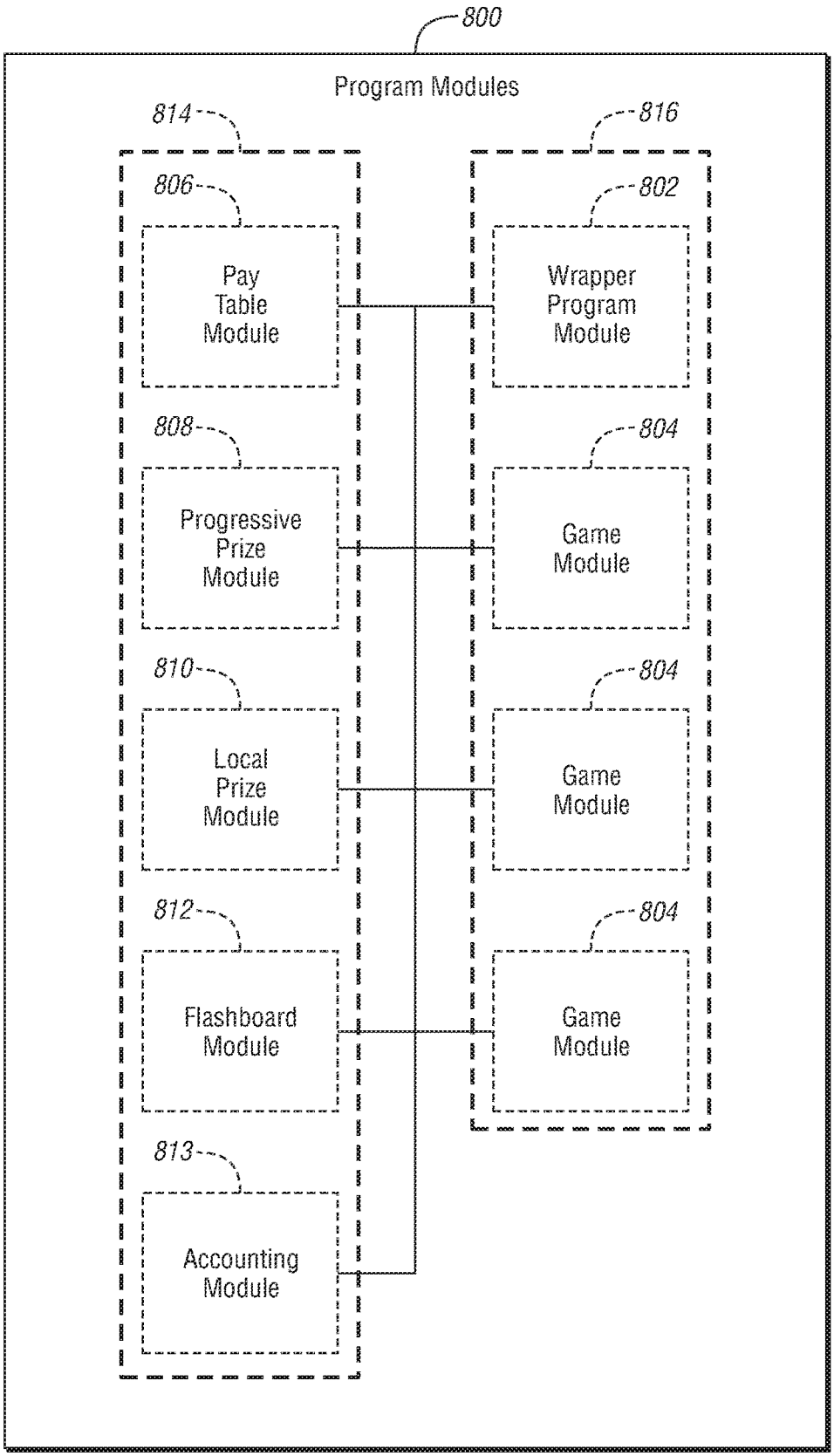
FIG. 8 illustrates a block diagram of exemplary gaming machine program modules.

FIG. 8 is a block diagram of a plurality of program modules 800 that may be used with the systems shown and described hereinto administer one or more games of chance. In one embodiment, one or more program modules 800 are installed and/or stored within local server, WAP server, and/or gaming devices. For example, program modules 800 may be stored in memory device of local server, WAP server, and/or gaming devices.

The program modules 800 are hardware, firmware, or software programs or applications that, when executed by a processor, cause the processor to perform the functions described herein. In one embodiment, the program modules 800 include a wrapper program module 802, a plurality of game modules 804, a pay table module 806, a progressive prize module 808, a local prize module 810, a flashboard module 812, and/or an accounting module 813. A first plurality 814 of the program modules 800 may be installed within each local server and/or WAP server and a second plurality 816 of the program modules 800 may be installed within each gaming device. It should be recognized that in embodiments in which the game of chance is administered by gaming device (e.g., when a cell phone or a tablet computing device is used as gaming device), some or all of the first plurality 814 of program modules 800 may be incorporated within gaming device and executed by a processor of a gaming device. Alternatively, some or all of the second plurality 816 of the program modules 800 may be incorporated within a local server and/or WAP server. Together, the wrapper program module 802, the game modules 804, and the other program modules 800 that present and/or administer one or more games may be referred to herein as a game application, or an application.

In one embodiment, the wrapper program module 802 is used at least in part to provide a graphical user interface (GUI) on a first display of the gaming device. The wrapper program module 802 operates to provide an entry point or a game entry interface for a player to access the gaming device, and to enable the player to select a game of chance to be played on the gaming device. For example, the games of chance may be categorized into a plurality of game sizes and a plurality of game variations. The wrapper program module 802 may present the game sizes and the game variations to the player, using a display, and may enable the player to select a game to play by selecting a game size and game variation through user interface device.

In one embodiment, the wrapper program module 802 may present a list of bingo player card sizes (i.e., game sizes or matrices), such as 3×3, 4×4, and 5×5, to the player for selection on a display. In addition, the wrapper program module 802 may present a list of games or game variations to the player for selection on a display. Alternatively, the game size and game variation may be combined into one selectable icon, such as an icon representing a first variation of 3×3 bingo card or a second variation of 5×5 bingo card. If the player selects a size and variation, wrapper program module 802 calls or branches to a game module 804 that provides the selected game size and variation.

In one embodiment, the game modules 804 each provide a game associated with the selected game size and/or game variation to the player using gaming device, local server, and/or WAP server. Accordingly, in one embodiment, each game is provided by a separate game module 804. Alternatively, each game module 804 may provide more than one game to the player.

The pay table module 806 provides a pay table associated with each game such that one or more pay tables may be associated with each game module 804. In one embodiment, the pay table module 806 provides a pay table associated with a game when the game module 804 requests the pay table and/or when a predetermined event occurs during the game. The pay tables associated with a game may be changed as desired by a game operator by any suitable means. The predetermined event may include, for example, the player selecting a "See Pays" or another icon displayed on the display that represents a request to view the pay table for the game. The predetermined event may also include reaching a point in the game in which the house indicia are matched to the player indicia within a selected pattern to determine whether the player wins a prize.

The progressive prize module 808 may be used to administer aspects of one or more progressive prizes, such as one or more progressive prizes offered to players playing across network. For example, the progressive prize module 808 may receive information regarding an amount wagered by each player playing a game that has a chance to win the progressive prize. The progressive prize module 808 may allocate a first portion of each wager to a first progressive prize to increase the size of the progressive prize. The progressive prize module 808 may allocate a second portion of each wager to a second progressive prize, and may continue in a similar manner for any additional progressive prizes, if desired or applicable. Accordingly, a plurality of progressive prizes may be provided for each game and may be at least partially funded by each or selected wagers.

The local prize module 810 may be used to administer aspects of one or more local prizes, such as one or more prizes that may be won by players playing against each other within a gaming establishment. In addition, the local prize module 810 may administer aspects of one or more fixed prizes, such as prizes that may be won only by individual players playing on respective gaming device. Accordingly, fixed or individual prizes may be awarded to a player based on the gameplay of the player relative to a randomization device of gaming device, rather than based on winning against other players.

In one embodiment, the flashboard module 812 may be used to display called bingo numbers or other house indicia within one or more gaming establishments. In another embodiment, the flashboard module 812 may be used to display called bingo numbers, keno numbers, or other house indicia on the gaming devices themselves, for example, on a display during play of the game. The flashboard module 812 may cause the house indicia to be displayed as a rectangular matrix of spaces (sometimes referred to as a "flashboard"). For bingo games played utilizing 75 numbers or indicia, the letters B, I, N, G, and O may be pre-printed above five vertical columns of the matrix with one letter appearing above each column to assist players in more quickly locating a called number on their card(s). For 75 number bingo games, the numbers printed on the card are commonly arranged as follows: 1 to 15 in the B column, 16 to 30 in the I column, 31 to 45 in the N column, 46 to 60 in the G column, and 61 to 75 in the 0 column. However, other arrangements of the flashboard may be used instead of the arrangement described herein.

The accounting module 813 may be used to interface with an accounting system, such as a slot accounting system or auditing system, at or operated by a gaming establishment. In one embodiment, the accounting module 813 is incorporated within, or executed by, accounting interface. Any suitable data, such as gameplay data, player identification information, an amount of prizes won by a player, and/or any other suitable data may be collected and transmitted by the accounting module 813.

For keno games played utilizing 80 number or indicia, the numbers may be arranged sequentially in a matrix such that numbers 1-10 appear sequentially in a first row, the numbers 11-20 appear sequentially in a second row below the first row, the numbers 21-30 appear sequentially in a third row below the second row, and so on. It should be recognized that embodiments of keno games having a different number of player indicia (or spots) may be used, such as 49 or 25 spots.

It should be recognized that two or more program modules 800 may be combined together such that the functionality of each program module 800 is incorporated into the combined module. Likewise, each program module 800 may be split into two or more sub-modules that each perform a portion of the functionality of the program module 800 being split. Accordingly, while the above-described program modules 800 are described individually, each may be combined or split into other sub-modules as desired.

Figure 9:
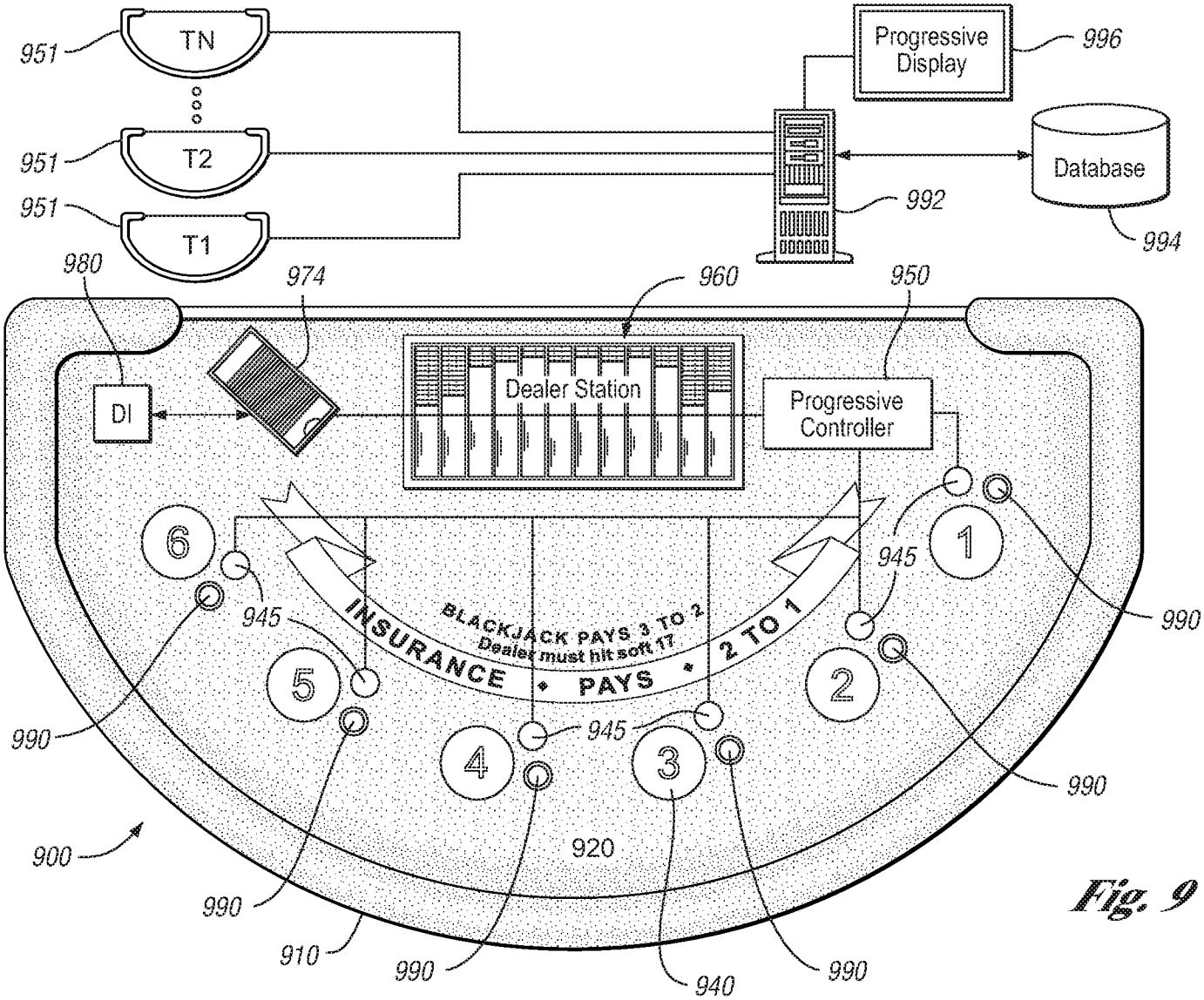
FIG. 9 illustrates a block diagram an exemplary embodiment of a gaming table.

FIG. 9 illustrates a block diagram of an example embodiment of a gaming table 500 that may generate or otherwise serve as the base game that generate a trigger to initiate or allow a player to participate in the promotional event. This is but one possible table arrangement and layout and it is contemplated that one of ordinary skill in the art may arrive at other table arrangements to promote game play for different players or accommodate a greater or fewer number of players. For example, it is contemplated that the method and apparatus described herein may be utilized with any game layout such as blackjack, craps, roulette, pai gow, baccarat, Caribbean stud, three card poker and the like including electronic versions thereof. Likewise, the table can be configured in a stand-up or sit-down arrangement.

In this example embodiment, gaming table 900 includes an outer edge 910 surrounding a generally flat top surface 920. The table 900 may also be configured to accommodate other types of traditional table games including, but not limited to, any type of blackjack, poker wherein the house only receives a percentage or rake from the pot of money wagered by the players, baccarat, pai-gow, proprietary table games, or non-proprietary card table games which may use any combination of dice, wheels, cards, or other play devices. Traditional table games include games of chance that use cards or dice, and tokens (also denoted as gaming chips), currency, currency equivalents or credit vouchers which may be of differing values. Of course, any table game may be played in a tournament format. In this discussion, the table is configured for use as a blackjack table. Traditional table games also include proprietary games. Proprietary table games are table games for which a casino will lease or purchase from a manufacturer because the proprietary traditional table game is protected by the intellectual property of the manufacturer. The following description illustrates an exemplary embodiment of the system with reference to playing a blackjack card game. Of course, without limiting the scope of the disclosure, the forms, types, and variations of the game are immaterial to the teachings of the present invention.

As is well known by a person ordinarily skilled in the art, in a round of playing a blackjack card game, initially a hand comprising two cards may be dealt by a dealer to one or more players and to the dealer. The dealer may distribute cards to the players face-up from one or more decks of cards according to pre-established rules of the game. In other variations of the game, the dealer may deal cards face-down to the players. The dealer is dealt one card face-up and one card face-down (termed the hole card). During play of the game, each player may receive further cards (termed being hit) from the dealer to improve the player's hand. The dealer may discard (or according to the terminology of the art "burn") one or more cards when dealing the cards to insure security of the game. Additionally, the dealer may discard a hand when a player folds the hand. When all players stand (in other words, cease requesting cards), playing card distribution to the one or more players ceases and the dealer may reveal the dealer's hand. The dealer may further deal cards to the dealer's hand. When no further cards are distributed to the dealer (known in the art as the dealer stands) the players' hands may be compared to the dealer's hand and a settlement may occur between the dealer and each player. The dealer may then dispose of all cards and begin yet another round of play of the game.

In one embodiment, the promotional event may be triggered, meaning a player is given a chance to participate in the promotional event, based on a particular game outcome for a player, such as a blackjack with a particular card set, a certain number of cards, multiple game outcomes in a row, or any other predetermined game outcome for a player.

In this example embodiment of a gaming table 900, there is an outer edge 910 of the table. One or more player stations 930 (also denoted herein as player locations) are provided and configured for use by a player to participate in a wagering game or a game of chance offered at the table 900 such as blackjack. In this embodiment the player stations 930 comprise a player position 940 wherein a player is dealt playing cards and a player may accumulate tokens during the course of play. For example, the player may place original gaming chips (or tokens) and tokens that are won within the area of player position 940 during the course of play.

In other embodiments, one or more progressive wager detectors 945 may be located in one or more other locations on the table surface 920 or be a separate device independent from the table 900. The progressive side wager detectors 945 may comprise a coin-in (or token) slot which accepts a coin or token, an RFID, optical detector, proximity sensor, weight detector or similar which detects the side wager or progressive wager. By way of example, a wager detector 945 may be associated with each player position 940 or may be shared by more than one player. In operation, when a player makes a wager, a player takes tokens from the player's token zone and places them in or on the wager detector 945.

In another embodiment a fixed or portable bet manager may be provided whereby a player may purchase credits which are registered or stored on the bet manager. The bet manager may communicate wirelessly, or via a wired connection, with other components to indicate a player's progressive wager. It is contemplated that the wager detector may be part of the bet manager.

Additionally, the table 900 may comprise supplement bet spots, token buy-in spots and the like. Optionally, in another embodiment of the table 900, the table's player positions 940 may be configured as card spots and associated card detection zones (not shown). Playing cards may be configured with elements detectable by the card detection zones. Such detection may be by various means including, but not limited to optical and UV scanning and radio wave scanning (better known as radio frequency identification or RFID).

The table may also comprise an optional electronic card reading shoe 974 configured to read the suit and rank of dealt cards. The shoe 974 may communicate with other elements of the table and progressive system. The shoe 974 may also manually or automatically perform card shuffling and present the cards for dealing. A dealer interface 980 is provided and may be connected to the shoe 974 to provide dealer control and to interface with the shoe, such as by providing information regarding cards dealt to the dealer. Optionally, a wired or wireless game initiation device such as a button 990 or similar may be provided to communicate with the server 992 to initiate play for the promotional game.

The wager detectors 945, and optionally the shoe 974 electrically communicate with a progressive controller 950 that is associated with the table 900. The progressive controller 950 may be disposed, for example, under the table 900, or at a remote location. The shoe 974 or bet detection areas 945 may communicate to the progressive controller 950 to indicate to the progressive controller 950 when a player qualifies for, based on dealt cards, a progressive jackpot or award, and optionally the payout amount based on the cards dealt to the player, or participating in the promotional event. This information may be used by the dealer to assist in game play and track progressive participation. The progressive controller 950 records which player positions have placed a progressive wager to allow that player to participate in the progressive. The progressive controller 950 may also time stamp the time of the wager paid by a player or the dealing of cards to a player from the electronic shoe to establish a timing event for the player in relation the wager and secondary game. The controller 950 may also calculate the amount wagered for progressive participation for each table and communicate that to the server 992. Additional tables 955 may also be similarly configured and linked to either the controller 950 or server 992 as shown.

The progressive controller 950 is in communication (wired or wirelessly) with one or more servers 992 which may be located locally or remotely. The servers 992 may be configured as is known in the art with a processor configured to execute non-transitory machine readable code (software) which is stored in one or more memories. There may be one or more other tables 951, numbered T2 thought TN, where N is any whole number in addition to the table 900. A progressive display 996 also connects to the server 992. The server 992, executing machine readable code, is configured to sum the progressive wagers and display the total possible amount to be won on the progressive display 996. By displaying the large potential progressive payout on the display 996, players are encouraged to play the base game and the progressive. One or more databases 994 are optionally provided to store data, machine readable code, or a combination thereof.

A player may receive cards from a dealer and place them on a player's card position 940. Each player's cards may be detected and monitored by the dealer in an associated card detection zone and the table may be equipped with RFID, overhead, dealer or player active detectors, or other card or token readers. The player positions 940 may also detect or provide space for wagers, such as progressive bets, that are placed and detected with the bet detectors 945. Without limiting the disclosure, it will be appreciated that the table 900 may comprise any number of or combination of player positions 940, detection spots and associated detection zones (bet detectors 945), and the like as discussed above to achieve operation as described herein.

In one example embodiment, the table 900 may comprise a dealer station 960 for a dealer. As is generally understood, the dealer may present the game from the dealer station 960 by dealing cards to players. The dealer station 960 is a location on or in some way associated with the table 900 and/or the dealer on which tokens or playing cards may be placed. Those familiar with the art will recognize that any of the games described may be implemented manually or electronically either as individual games or multi-game formats such as the Gaming Arts Casino Wizard™ multi-game which includes blackjack, craps, roulette and baccarat and may be played by an individual player. Alternatively, electronic table games may allow for a group of players to play in separate gaming positions against a common computerized dealer or game device such as a roulette wheel or similar.

The dealer interface 980 (referred to as DI in FIG. 5) may also be placed near the dealer station 960. The dealer interface 980 comprises a user interface configured to allow the dealer to provide input to the shoe 974 and optionally receive output from the shoe, which can be presented to the dealer and the server 992. In various embodiments, the dealer interface 980 comprises one or more buttons, dials, display screens, LCD/touch screen, lights or other illumination devices, speakers or other audible indicators, or analog dials, potentiometers, or keypads. Through use of the dealer interface 980, the dealer provides input to the shoe 974 or receive data from the shoe 974.

In yet another embodiment, the dealer interface 980 may be configured to communicate with a detection system (discussed above), a player tracking system (as monitored and controlled such as by one or more servers 992) and an accounting system.

One or more components may all be integrated into a single device. For example, the dealer interface 980 may be part of the shoe/shuffler 974. In addition, the table may also include a player tracking device, such as a card reader and associated keypad. Such player tracking devices are well known and may permit the game operator to track play of players at the gaming table. The tracked play may be utilized to offer player bonuses or awards.

Servers 992 may additionally have other functions, such as tracking players to provide coupons (also termed "comps") based on various aspects of players' behaviors. Without limiting the scope of the disclosure, behaviors that may trigger an award of player comps and subsequent printing of player coupons include amounts wagered, won, or lost, number of hands played by the player, duration of play, or random events, such as a mystery award which may be awarded to one or more players. Input from a player tracking system may also be utilized. Furthermore, servers 992 may provide accounting and auditing functions during play of a game.

Disclosed is a secure and stable system to provide a more exciting gaming experience for a person gaming, those around them, the casino pit area, or the casino in general. In embodiments where the promotional game follows a player achieving a triggering event following play of a game of chance requiring a wager, there may be no prize or award for the first game of chance outcome. Instead the ultimate prize or award will be determined by the outcome of the second promotional game of chance. A player interactive system provides for player involvement with an event such that the event and the outcome may be shared with others. Systems and methods as discussed herein provide promotional and gaming awards include a plurality of fully customizable interactive games adaptable to virtually all promotions anywhere on the casino floor or associated locations or other appropriate venues. Using a hardware and software interface, four representative different game displays and interactive experiences for the user are available and are discussed below. In other embodiment, other graphical interfaces and interactive experiences may be provided to the player beyond those shown here.

In one generalized embodiment, the promotional event begins with the casino staff presenting the selected player with the player tablet at their seat or gaming position. As the promotional event is occurring due to the player interacting with the tablet and the graphical interface, displays and/or video projectors, placed proximate to the game, across the property, or cross multiple properties, share the promotional event and its outcome. This allows other players and casino visitors to view and share in the excitement of the promotional event thereby sharing the event with a larger audience. The tablet provided to the player to conduct the promotional event allows the player to remain seated at the game or table. There are many benefits of allowing players to remain seated (not leave their current gaming location) as opposed to requiring the player to come to the central game area or stage for the promotional event. Primarily, it does not interrupt their gaming or wagering, is easier for the player, and does not force them to lose their machine or seat to another player, etc.

Figure 10:
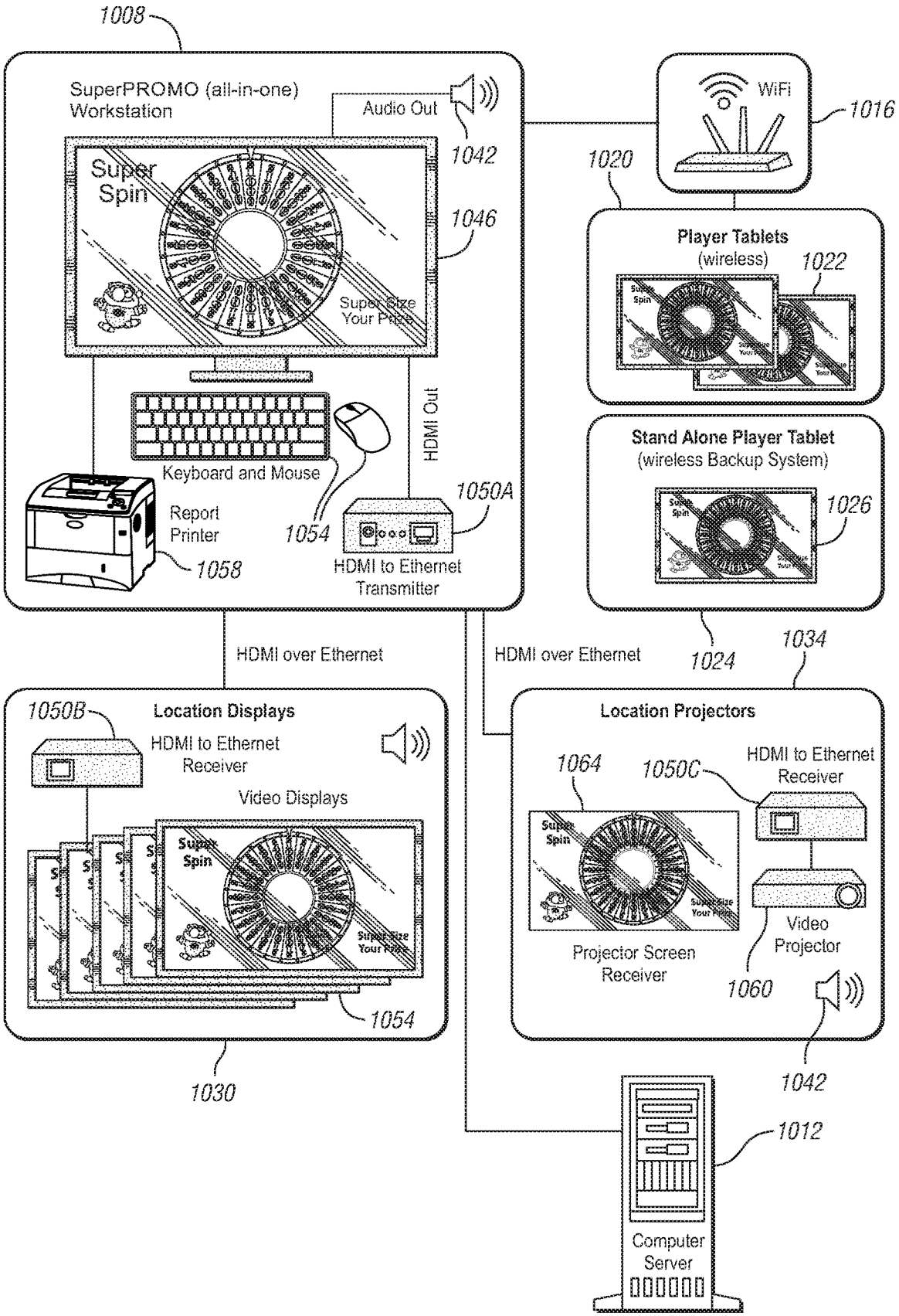
FIG. 10 illustrates an exemplary promotional event system.

Turning now to FIG. 10, an example arrangement of elements configured to offer the promotional event is shown. This is but one possible system configuration and it is contemplated that one of ordinary skill the art may arrive at other embodiments without departing from the scope of the claims. The promotional event system includes a workstation 1008 with associated computer or server 1012 (hereafter computer) and one or more mobile computing devices 1022 such as a tablet (1022). A wireless communication device 1016 may facilitate communicate between the tablet 1022 and the workstation 1008 or the computer 1012. Any type wired or wireless communication is contemplated. A printer 1058 is optionally part of the workstation 1008. Any type printer may be provided, such as for ticket in/ticket out vouchers, for reports or other certificates, or any other desired requirements.

In this example embodiment, the workstation 1008 includes a display 1046 configured with a user interface 1054, such as a keyboard and mouse. The user interface may be used to configure or initiate the promotional event by communicating with a computer/server 1012. The computer or server 1012 may be referred to herein as a stationary computing device. A transceiver 1050A may be provided as part of the workstation to broadcast audio and video of the promotional event to a large screen, such as screen 1046 other locations in the casino so that other players may view the promotional event and thus share in the excitement. In this embodiment, the transceiver 1050A is configured to receive an HDMI format signal and transmit it in an Ethernet format. It is contemplated that the broadcast of the promotional event may occur from the computer/server, or over a wired or wireless network, and any video/audio format or standard may be used for the broadcast. Any system or data format may be used, whether wireless or wired, to communicate audio/video/data between components.

The computer/server 1012 is configured as described herein and has memory storing machine readable code (machine executable instructions), which is commonly referred to as computer program code or software. A processor of the computer/server 1012 or work station 1046 executes the machine readable code to cause the promotional system to provide the promotional event to the player as well as the other displays/projectors in the casino or other establishment. The computer/server 1012 or work station 1046 may be configured to connect to and communicate with other casino computing and gaming systems.

Also, part of the promotional event system is a mobile computing device 1022, such as tablet, laptop, smartphone, tablet computers, e-readers, handheld gaming devices, or any other computing device. As described herein the mobile computing device 1022 includes processor, wired and wireless communication capability, and screen or other user interface. The promotional event is transmitted from the workstation 1008 or the computer/server 1012 for display on the screen of the mobile computing device 1022 for interaction and viewing by the player. The player may provide input to the mobile computing device 1022 to initiate the promotional event and view or otherwise interact with the mobile computing device as part of the promotional event. Exemplary promotional event interactions are described below in detail. Because, in one embodiment, the mobile computing device 1022 is mobile and battery operated, with wireless communication, it may be transported to the player allowing the player to be at any location in the casino. Thus, to participate in the promotional event, the player need not leave their gaming machine, dining seat, room, pool chaise, bar seat, concert event, or any other location. This increases convenience and service priority approach for the player. There are many other benefits of allowing players to remain seated while participating in the promotional event, as opposed to requiring the player to come to the central game area or stage, such as not interrupting a player's play and associated resulting anticipated losses by the player for that promotional game period, the need for a player to cash-out from their slot machine, allowing handicapped players to remain seated, etc. Those familiar with the art will recognize that the system may also be fixed at a central location where players travel to the central location to participate as is the case for casino wide promotions such as weekly promotional drawings and the like.

Location displays 1054 are located at one or more locations in the casino to provide further displays of the interactive promotional event that is being experienced by the player. The location display may be video projectors or be large displays which are wall mounted or part of another gaming system. Associated with the location displays 1054 are a transceivers 1050B configure to receive the audio/video signals from the workstation 1008 or the computer/servers 1012 and optionally broadcast the signal to other displays 1054. The displays 1054 may be equipped with audio output devices, such as speakers and/or microphones.

Similar to the location displays 1054 are screens projector systems 1034 with one or more video projectors 1060. The video projectors 1060 receive an audio/video signal from a transceiver 1050C and project the received audio/video signal to a screen 1064 for viewing by other players or patrons. As is understood in the art, projectors are capable of creating a viewable image that is larger than a framed display, such as an LED or OLED display or similar.

It is also contemplated that any screen may be used to display the promotional event, either to the player participating in the promotional event or other players may be any type screen. For example, the screen may be on a gaming machine, kiosk, player or other patron's smartphone or tablet, television screen, gaming table screen, sports book screen, movie theater screens, or any other screen, display or projection.

It is also understood that the promotional event system may be contained entirely on a stand-alone mobile computing device 1026. Because the stand-alone mobile computing device 1026 includes a processor, memory, display, and user interface, the entire promotional event may be presented and contained on a single device. Machine readable code on the stand-alone mobile computing device 1026 may function as a random number generator to generate the outcome if required. This reduces system costs and complexity or be suited to location which do not have location displays or projectors. The stand-alone mobile computing device 1026 may be configured broadcast the video and audio of the promotional event to other displays.

In one embodiment, promotional event information is sent to the individual displays from the stationary computing device through the property's AV system via a wired network such as coaxial cables, HDMI cables or similar cabling where specific displays will be selected to display the event. It is also possible to wirelessly connect the display devices via blue tooth or similar. In one embodiment, the promotional event information is sent to the individual displays directly from the mobile computing device.

As discussed in connection with FIG. 10, computing devices such as the all-in-one computer shown typically include at least one processor and at least one memory device. The processor may be, without limitation, an x86, Pentium, i-series based processor logic circuit or an AMD processor, an ARM-based logic circuit, and/or a system-on-a-chip circuit. It should be recognized that these examples are non-limiting, and a variety of other programmable circuits may be included within the definition of "processor." The memory device may include random access memory (RAM), flash memory, read-only memory (ROM), hard disk drives, magnetic-based memory, and/or any other form of computer-readable memory or combination thereof.

A desktop computer is one example of a computing device. Other examples of computing devices include, without limitation, tablets, video lottery terminals, cell phones, tablets, and laptop computers. It should be recognized that computers or computing devices may be implemented as one or more virtual machines, virtual servers, and/or any other virtual device. A server is another type of computer that may receive network connections from a computer or a plurality of computers or other computing devices. Any computing device may be housed locally or remotely. In addition, a remote computer may be utilized in conjunction with the local computer to provide updates, graphics, new games, etc.

As shown above, the computing device is connected to input and ancillary devises such as a keyboard, mouse, printer, and HDMI ethernet transmitter. It is further contemplated that some of these devices may be used in conjunction with accounting, player development and marketing departments to generate reports either manually, automatically or in conjunction with the CMS, SAS or similar. In addition, it is connected through ethernet cables or Wi-Fi to player tablets which may include backup tablets in case problems arise with the primary tablet(s) or if the tablet(s) are lost or stolen. It is understood that a tablet or similar may include any number of tablets playing the same or different games. As may be understood, an HDMI cable is provided to connect to a HDMI to Ethernet receiver which communicates to the property displays which may include video projectors and the like. Other Wi-Fi, Bluetooth, or similar devices may also be utilized.

Some installations of the promotional system may be relatively small both in operation size and with a limited number of ongoing promotions and thus require only one or two player tablets. However, for larger installation which may include a significant number of different venues over a large geographic area, the promotional system is capable of running both a single tablet and multiple tablets simultaneously as all tablets are individually programmed and identified. For example, through Wi-Fi networks, a central server may communicate with various locations and venues throughout the property, each with its own promotions type and tablets. In such instances, there may be one or more tablets in each of the slot area, table games areas, players club, cage, video poker bars, sport book, host office, hotel check-in, various restaurants, various bars, spa, clubs, etc. In many larger installations, while one system may be capable of operating multiple tablets and promotions simultaneously, it may be more practical and economical to divide the property into operational areas, each with its own separate server and system.

Security protocols are generally included insuring only authorized employees can operate the system via login identification, passwords, facial recognition, fingerprints, retinal scan, etc., with a similar or higher level of security for administrators of the system. Similar security protocols may be utilized for remote service and programming of the promotional system by third party developers or service entities.

Although shown and discussed in connection with providing a promotional event to a player, it is also contemplated that this promotional event may be provided to any person and a variety of different times for a variety of different reasons. These variations are discussed below in greater detail.

Figure 11A:
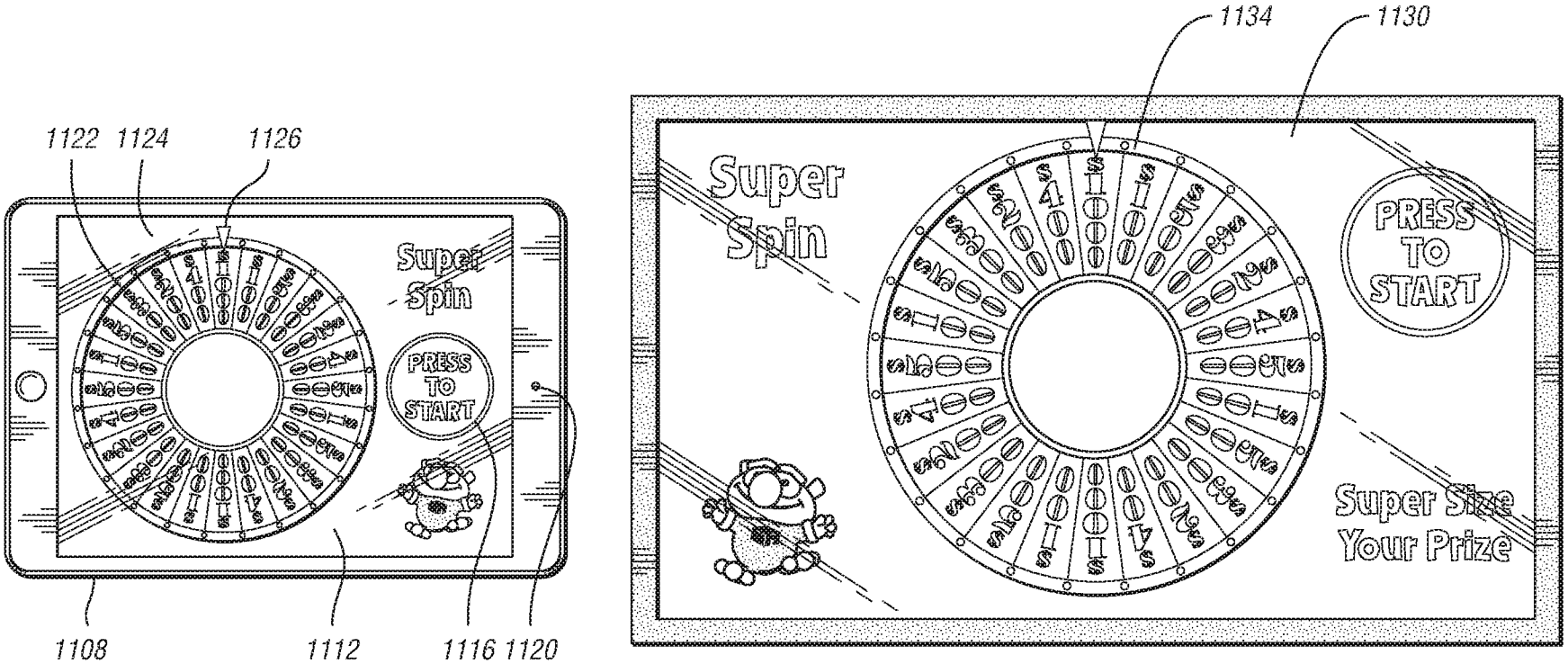
FIG. 11A illustrates an exemplary promotional event graphical interface.

FIG. 11A illustrates an exemplary promotional event graphical interface. Systems and methods for providing promotional and gaming awards include a plurality of fully customizable interactive games adaptable to virtually any or all promotions anywhere on the casino floor or associated locations or other appropriate venues. Four representative different game suites are shown in FIGS. 11A through 11D. Each starts with the casino staff presenting the selected player with the player tablet at their seat or gaming position with digital displays and/or video projectors, across the property engaging players so a larger audience can participate in the fun and excitement of the promotion. It should be recognized that the player tablet is only one of many computing devices which may be presented to the player. Other similar devices include smart phones, laptop computers, gaming machines, or any other screen equipped computing device.

Shown in FIG. 11A is a mobile computing device 1108 having a screen 1112 that also serves as a player interface. One exemplary mobile computing device is a tablet such as available from Apple, Samsung, and Microsoft. The mobile computing device 1108 may be equipped with a camera 1120 and microphone (not shown). A promotional event graphical interface is displayed on the screen 1112. In this embodiment, the promotional event graphical interface presents a rotating wheel 1122 having segments 1124 which are assigned different prizes. At a location near the outer edge of the rotating wheel 1122 is an indicator 1126 that represents which segment is selected or active during the event. The indictor 1126 indicates which segment is selected (awarded to the player). Also shown in the display screen is a representation of a button, switch, or other activation symbol 1116 for the player to start and optionally stop the promotional event. Additional functionality may be included such as login, logout, game change, change paytable, change player tier level, show previous winner(s), etc.

In operation, the player participating in the promotional event would be presented with the mobile computing device 1108 configured to display the screen shown in FIG. 11A. The player would press the activation symbol 1116 to spin or rotate the wheel 1122. As the wheel 1122 rotates, different segments, with prizes displayed thereon, pass the indictors 1126 add suspense to the event. Either through program control or from the player pressing the activation area 1116 or other screen area, the wheel rotation will slow, eventually settling a segment and revealing the prize awarded to the player. If configured such that the player controls when the wheel stops, the player presses the "press to stop" button (activation area 1116), the wheel gradually slows down and stops with the indicator pointing at a randomly selected or predefined section. It is understood that any game may be unbiased or biased in favor of smaller prizes as opposed to larger prizes or any type bias desired by the casino operator.

Concurrent with the display of the promotional event on the mobile computing device 1108, the promotional event is broadcast to one or more additional displays 1130 that show the same or modified screen image from the mobile computing device. The additional display, which is likely a large display or projection, shows the rotating wheel 1134. This allows others in the room, property, or across multiple properties, to share in the excitement of the promotional event with the player. In any of the embodiments, persons ordinarily skilled in the art will recognize that the term concurrent may include truly concurrent or effectively concurrent whereas a short delay between the actual promotional event and the broadcasting to one or more additional displays may occur.

In one example, embodiment as illustrated above having an electronic representation of a physical wheel, the selected player is given the opportunity to "spin the wheel" for their prize by activating the wheel using the mobile computing device 1108. In the example embodiment illustrated, segments 1124 display prize ranging from a Tesla automobile to $250 in free play. The term "free play" may include free slot play where an amount is credited to the player's player loyalty card account, awarded in the form of a ticket-in, ticket-out (TITO) voucher, free promotional chips to be used for table games such as blackjack, craps, roulette, Pai Gow poker, three card poker or similar games that are generally played in the casino pit area(s).

In one embodiment, the promotional game starts with the wheel already rotating and the player is allowed to press the "Press to Stop" button which will start the wheel slowdown and eventually stopping on one of a plurality of segments indicating the award or prize for the player. Alternate actions may include "Press to Start", "Press to Start and Stop", or any other desired player interaction. Actions of the wheel and the eventual winning stopping position is controlled by a random number generator (RNG) or pseudo-random number generator (PRNG) located in the system server or in the alternative, the player mobile computing device 1108 (tablet) or both. RNGs used in gaming establishments are generally laboratory certified for accuracy and may be separate or integral with the system software.

One or more rotatable wheels may also be used or included within the game to provide prizes, prize multipliers, consolation prizes, or the like. In one embodiment, a player who is selected to participate or conduct the promotional event may be presented with an option to spin (or stop) the wheel instead of receiving the standard fixed prize. Alternatively, the player may spin (or stop) the wheel in addition to receiving the prize. The wheel segments may include, for example, a bonus prize amount, a prize multiplier, a special symbol, and/or any other suitable indicia. It is also contemplated that the prizes associated with each segment may hidden until a segment is selected, and the prize revealed, or the prizes may be slowly revealed as the wheel rotates or after rotations to increase excitement.

As used herein with respect to a virtual or electronic implementation of the wheel, the term "randomly selected" refers to a randomly selected section or wheel indicia that a randomization device selects. The randomization may be biased in favor of certain sections such as changing the true probability of a segment from 24:1 for a 24 segment wheel to 1,000:1 for a given segment or 2:1 for another segment, for example. Such biasing is programmed into the promotional system. For example, if a player presses a button or otherwise causes the wheel to rotate (or to be displayed as if the wheel is rotating), the randomization device may randomly select a segment or wheel indicia of the wheel. A processor may then cause the graphical display to show wheel slowing down and coming to a stop with the indicator (pointer) pointing at the randomly selected segment or wheel indicia.

A game session refers to a period of time in which one or a group of related games of chance are conducted. The games are often conducted sequentially such that a first game is conducted during the game session and when the first game ends, a second game is conducted during the same game session. However, it should be recognized that at least a portion of the games within a game session may be offered concurrently with each other.

Preferably, the game is in the idle position where the game shown on the player tablet and the displays of the gaming establishment show either identical or similar images and when the actual play begins, the game shown on the mobile computing device 1108 (player tablet) and the displays of the gaming establishment also show either identical or similar images. This allows the promotional event to be shared with other patrons. These video display actions are controlled by the system server or through direct broadcast from the mobile computing device 1108 and may include other images or videos such as property advertising shown either prior to a game being played or during the actual game play and may be dissimilar on the mobile computing device 1108 and property display/projection.

One of ordinary skill in the art will recognize that many variations of the wheel-based game embodiment shown are possible such as drum-based games as used on the television game "Price Is Right" or "Wheel of Fortune", 3D wheels, 3D drums, rotating spheres, gears, and the like. In addition, although the embodiment shown allows for the player to stop the wheel rotation, any similar action can be utilized such as the player starting the wheel rotation with a computer-controlled stop, player starting and stopping the wheel, or similar. The final outcome may be entirely controlled by the RNG or PRNG, partially controlled by the RNG or PRNG, be skill based, be biased in any desired way, or any combination thereof. In the alternative, any of the embodiments may include predefined prizes without the use of a RNG or PRNG.

FIG. 11B illustrates an alternative exemplary promotional event graphical interface. As compared to FIG. 11A, identical or similar elements are not described again. In this embodiment, the graphical interface includes an icon area 1140 having plurality of icons 1144. The icons 1144 have an indicia 1146 on them and the indicia may change based on player input to the mobile computing device 1108.

In the embodiment illustrated above, an electronic representation of a match game is disclosed where the selected player is given the opportunity to choose and reveal one or more of a plurality of icons 1144 until a match occurs. When a match occurs, a prize is revealed. In the embodiment illustrated, prizes range from a $500 to $50 free play but may include any prizes the casino operator may choose even though not illustrated above, i.e., any amount of money, motorcycle, dining credits, free game play, etc. Persons of ordinary skill in the art will recognize that any of the promotional games described may be biased via computer programming to favor certain prizes relative to other prizes or vice versa. For example, regardless of which icon is selected, the preprograming automatically awards a given prize regardless of which icon or group of icons is selected. Additionally, certain prizes may not be possible to win in game variants even though revealed as a possible winning prize once the player prize in determined.

In this embodiment, the promotional game starts with all icons 1144 in the icon area 1140 unrevealed until the player touches a particular icon thereby causing the icon to visually reveal the underlying prize or award designated by the indicia 1146. The player continues to touch other icons 1144 until a matching prize (indicia) 1146 is revealed thereby determining the prize that is awarded. Actions of the icon area 1140 or game board and the eventual winning match is controlled by a RNG or PRNG located in the system server or in the alternative, the mobile computing device 1108 (player tablet) or both. RNGs used in gaming establishments are generally laboratory certified for accuracy and may be physical or software based.

Preferably, upon starting, the game is in the idle position where the game shown on the player tablet with no prizes revealed and the displays of the gaming establishment show either identical or similar images and when the actual play begins, the game shown on the player mobile computing device 1108 and the displays 1130 of the gaming establishment also show either identical or similar images. These video display actions are controlled by the system server or direct broadcast from the mobile computing device 1108 and may include other images or videos such as property advertising shown either prior to a game being played or during the actual game play, and may be the same as or different than the mobile computing device 1108 and the one or more property display 1130.

Persons ordinarily skilled in the art will recognize that many variations of the match game embodiment shown are possible. In addition, although the embodiment shown allows for the player to select various icons 1144 until an indicia match occurs, any similar action can be utilized such as the player selecting three or more matching icons, selecting constantly changing pre-revealed icons, etc. The final outcome may be entirely controlled by the RNG or PRNG, partially controlled by the RNG or PRNG, be skill based or any combination thereof. In the alternative, the game may include predefined prizes without the use of a RNG or PRNG.

Figure 11C:
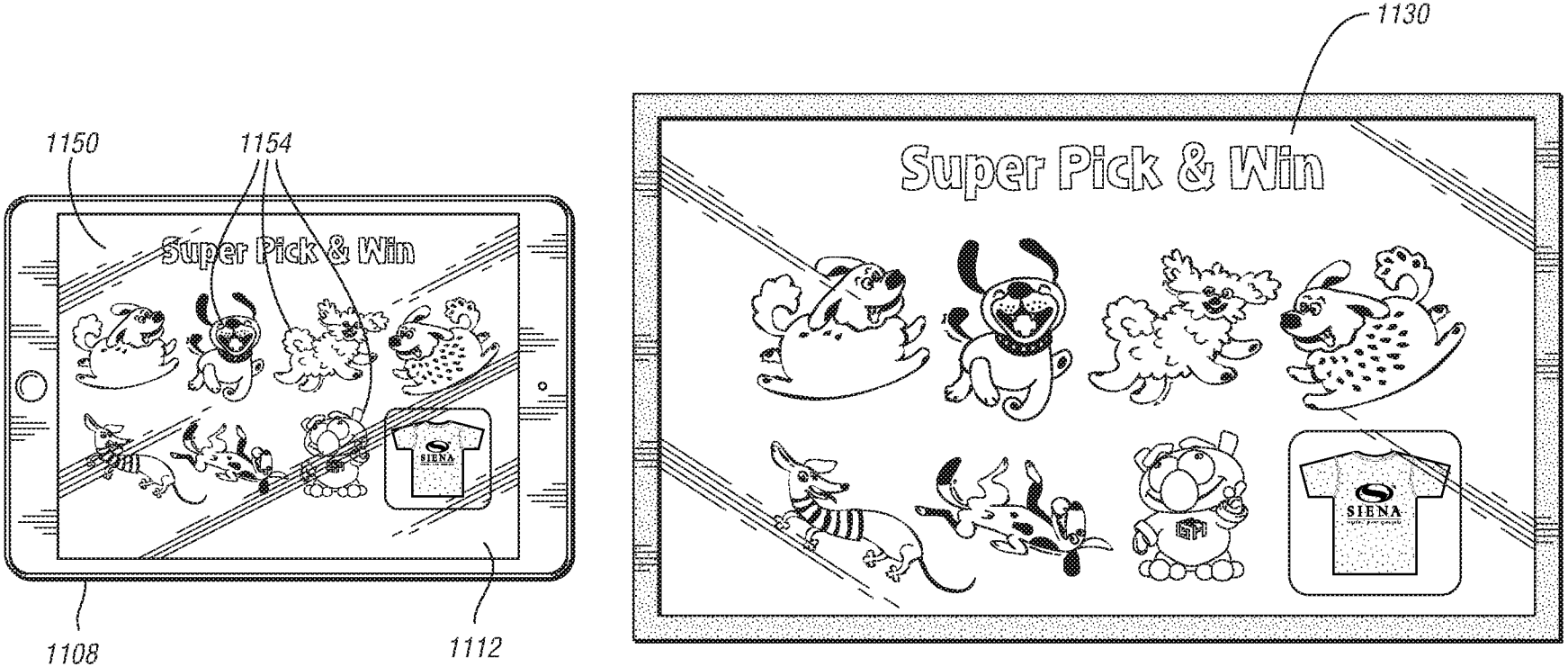
FIG. 11C illustrates an alternative exemplary promotional event graphical interface.

FIG. 11C illustrates an alternative exemplary promotional event graphical interface. In another embodiment as illustrated in FIG. 11C, an electronic representation of the promotional event, displayed on a screen 1112 of the mobile computing device 1108, is a pick and win game 1150. In this game, the player is given the opportunity to choose one or more animated character icons 1154 to determine their prize. In the embodiment illustrated, the prize won by the player is a logo T-shirt but available prizes may include any prizes the casino operator may choose even though not illustrated above, i.e., $100 (or any other amount) free play, show tickets, promotional chips, etc. Persons of ordinary skill in the art will recognize that any number of icons may be included. In addition, such promotional games may be biased via computer programming to favor certain prizes relative to other prizes or vice versa. For instance, regardless of which icon is selected, the preprograming automatically awards a given prize regardless of which icon or group of icons is selected. Additionally, certain prizes may not be possible to win in game variants even though revealed as a possible winning prize once the player prize in determined.

In this embodiment, the promotional game 1150 starts with all animated character icons displayed unrevealed on the screen 1112 until the player touches a particular animated character icon 1154. Upon being touched, the icon 1154 changes and reveals the underlying prize or award. Play may end at this point or the player may be allowed to touch additional animated icons 1154 to reveal additional prizes depending on the game rules. Actions of the game board 1150 and the animated character icons 1154 are controlled by a RNG or PRNG located in the system server or in the alternative, the mobile computing device 1108 (player table), or both. RNGs used in gaming establishments are generally laboratory certified for accuracy and may be physical or software based.

Preferably, the game 1150 is in the idle position where the game shown on the mobile computing device 1108 with no prizes revealed and the displays 1130 of the gaming establishment show either identical or similar images and when the actual play begins, the game shown on the mobile computing device 1108 and the displays 1130 of the gaming establishment also show either identical or similar images. These video display actions, subject to player input, are controlled by the system server or broadcast from the mobile computing device 1108 and may include other images or videos such as property advertising shown either prior to a game being played or during the actual game play and may be the same as or different than the player tablet and property display 1130.

Persons ordinarily skilled in the art will recognize that many variations of the pick and win game embodiment shown are possible such as different scenes, different number of icons, etc. In addition, although the embodiment shown allows for the player to select one animated character icon, any similar action can be utilized such as the player selecting multiple animated character icons, selecting constantly changing pre-revealed icons, etc. The final outcome may be entirely controlled by the RNG or PRNG, partially controlled by the RNG or PRNG, biased or unbiased, be skill based or any combination thereof. In the alternative, the game may include predefined prizes without the use of an RNG or PRNG. Persons of ordinary skill in the art will recognize that prizes may be identical or differ game to game based on any desired outcome such as prizes increasing in value for higher tier players who have a greater value to the casino operator or similar.

Figure 11D:
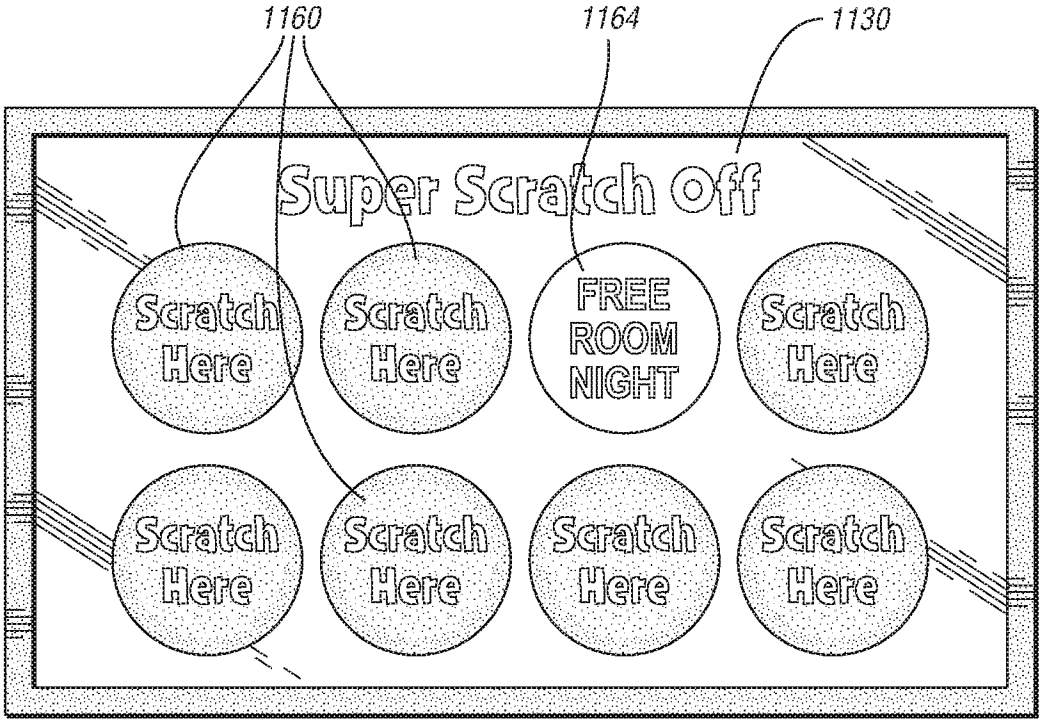
FIG. 11D illustrates an alternative exemplary promotional event graphical interface.
Figure 11D:
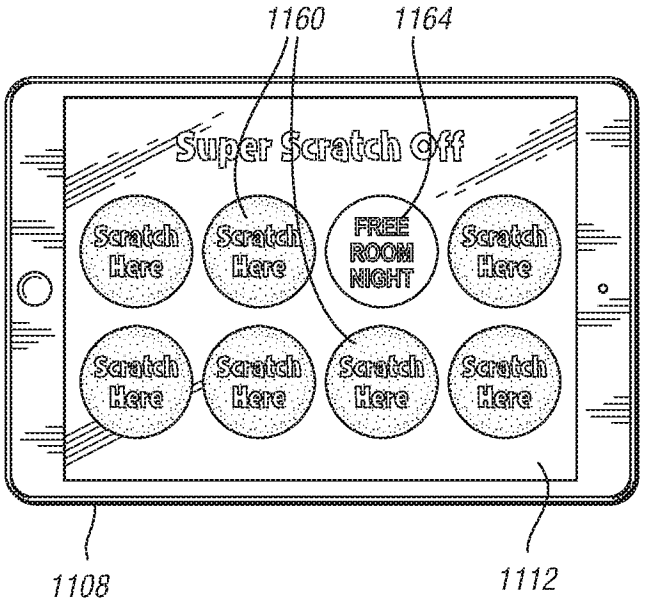

FIG. 11D illustrates an alternative exemplary promotional event graphical interface. In another embodiment as illustrated in FIG. 11D, a mobile computing device 1108 having a screen 1112 is provided. All or a portion of the screen display of the mobile computing device 1108 may be mirrored or generally duplicated in whole or in part to a larger display 1130, either in whole or in part, for viewing by a number of people. Those ordinarily skilled in the art will recognize that when the screen of the mobile computing device is mirrored or duplicated onto a larger display, certain graphical components may be adjusted or changed in order to present a more pleasing display due to the differing aspect ratios of the mobile computing device and the larger display. On the screen 1112 of the mobile computing device 1108 is an electronic representation of multiple scratch-off cards 1160 are displayed where the selected player participating in the promotional event is given the opportunity to electronically scratch off various icons to reveal their prize 1164 or prizes. In the embodiment illustrated, the wining prize is a free room night at the casino's hotel but may include any prizes the casino operator may choose even though not illustrated above, i.e., money, coffee mug, free play, dining credits, etc. Persons of ordinary skill in the art will recognize that any number of scratch-off icons may be included. In addition, such promotional games may be biased via computer programming to favor certain prizes relative to other prizes or vice versa. For instance, regardless of which scratch-off icon is selected, the preprograming automatically awards a given prize regardless of which icon or group of icons is selected. Additionally, certain prizes may not be possible to win in game variants even though revealed as a possible winning prize once the player prize in determined.

In this embodiment, the promotional game starts with all scratch off icons 1160 unrevealed until the player moves their finger across a particular icon causing the scratch off icon is removed, revealing the underlying prize 1164 or award. The play may end at that point of continue for additional prizes depending on the game rules. In the alternative, some scratch off icons 1160 may not contain an underlying prize 1164 or all scratch off icons may reveal some prize, even if small. Actions of the game board and the eventual winning scratch-off card may be controlled by an RNG or PRNG located in the system server or in the alternative, the player tablet or both. RNGs used in gaming establishments are generally laboratory certified for accuracy and may be physical or software based.

Preferably, at start up, the game is in the idle position where the game shown on the player tablet with no prizes revealed and the displays of the gaming establishment show either identical or similar images. When the actual play begins, the game shown on the player tablet and the displays of the gaming establishment also show either identical or similar images. These video display actions are controlled by the system server and may include other images or videos such as property advertising shown either prior to a game being played or during the actual game play and may be dissimilar on the player tablet and property display.

Persons ordinarily skilled in the art will recognize that many variations of the scratch-off game embodiment shown are possible. In addition, although the embodiment shown allows for the player to scratch-off various icons until a prize is revealed, any similar action can be utilized such as the player selecting two or more scratch-off icons. The final outcome may be entirely controlled by the RNG or PRG, partially controlled by the RNG or PRNG, be biased or unbiased, be skill based or any combination thereof. In the alternative, the game may include predefined prizes without the use of a RNG or PRNG.

Awards or prizes for any of the games shown may be anything the operator desires including but not limited to any of the following; cash, free slot play, promotional chips, dining credits, show credits, spa credits, beverages, hats, cars, vacations, houses, motorcycles, boats, etc. All awards and prizes shown for any of the embodiments may be changed or customized at the server level either locally or remotely, which will appear on the player tablet and property displays.

For all embodiments, the system and method can work independently or interface with conventional casino management systems (CMS), slot accounting systems (SAS). Player loyalty programs and similar. Such interfacing provides for direct links for player selection, automated tier level adjustments, prize or awards adjustments, accounting, W-2G reporting, or any other type system.

The systems and methods disclosed are representative of the many different games that may be used with the system. Any computerized game can be used with the system including those shown, pinball, pool, sports, arcade style, asteroids, Pac Man, Candy Crush, punchboard, pachinko, poker, blackjack, and the like. In addition, all games may be programmed as straight games where the probability of winning a given prize is fair, i.e., the probability of landing on a particular slice of a 24 slice wheel is 24:1 or may be biased in favor of the player or the house, i.e., the top value slice of a 24 slice wheel may be reduced to 10:1 in the player's favor or increased to 10,000:1 in the house's favor. Any ratio may be established to adjust the odds of any of the game embodiments described.

The player may be presented with a specific game loaded onto the player tablet or in the alternative, may select which game they choose to play, i.e., wheel game, rotating drum game, match game, pick and win game, scratch and win game, punch card game, etc.

Figure 12:
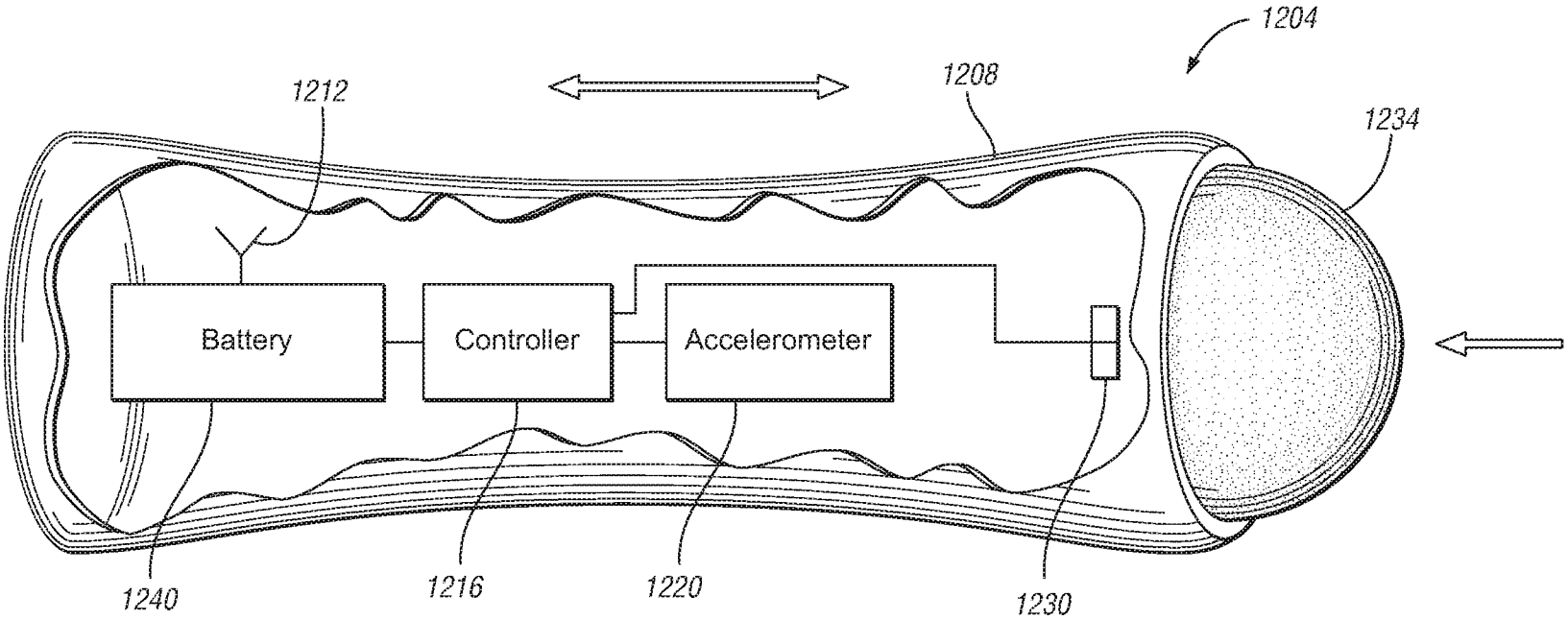
FIG. 12 illustrates an example embodiment of a promotional event activation device.

FIG. 12 illustrates an example embodiment of a promotional event initiation device. In one embodiment, the promotional event participant is provided a promotional event initiation device 1204 to initiate the promotional event, instead of a mobile computing device. The promotional event would be viewed by the player on one or more of the large displays or projections by the promotional event participant and the other patrons of the casino, or any other designated screen. This arraignment reduces complexity and cost while allowing all people to enjoy the excitement of the event on a large overhead display. Attention is still directed to the promotional event participant due to the promotional event participate being singled out, recognized, provided the promotional event initiation device and their interaction with the device. It is contemplated that any type device may be used to initiate the promotional event.

Shown in FIG. 12 is an example promotional event participate initiation device 1204 comprising a hand held shaker and/or button. An outer housing 1208 is configured to be held with the user's hand while internal to the event participate initiation device 1204 is an antenna 1212 connected to a controller 1216 which may include a transmitter. In communication with the controller 1216 is an accelerometer 1220 (or other type motion sensor) and/or a button contact 1230. A battery 1240 is also part of this embodiment to provide power to the one or more different components.

In operation, the event participant is provided the event participate initiation device 1204. To initiate the promotional event the user may either shake the device 1204 such that the motion is detected by the accelerometer 1220. In response, the accelerometer and controller 1216 wirelessly send a signal to a remote receiver that is in communication with the promotional event computer/server to initiate the promotional event. Alternatively, the user may push the button 1234 to initiate the event. The event participant would view the promotional event on the large displays or projections that are viewed by the other patrons of the casino or any other designated screen.

Figure 13:
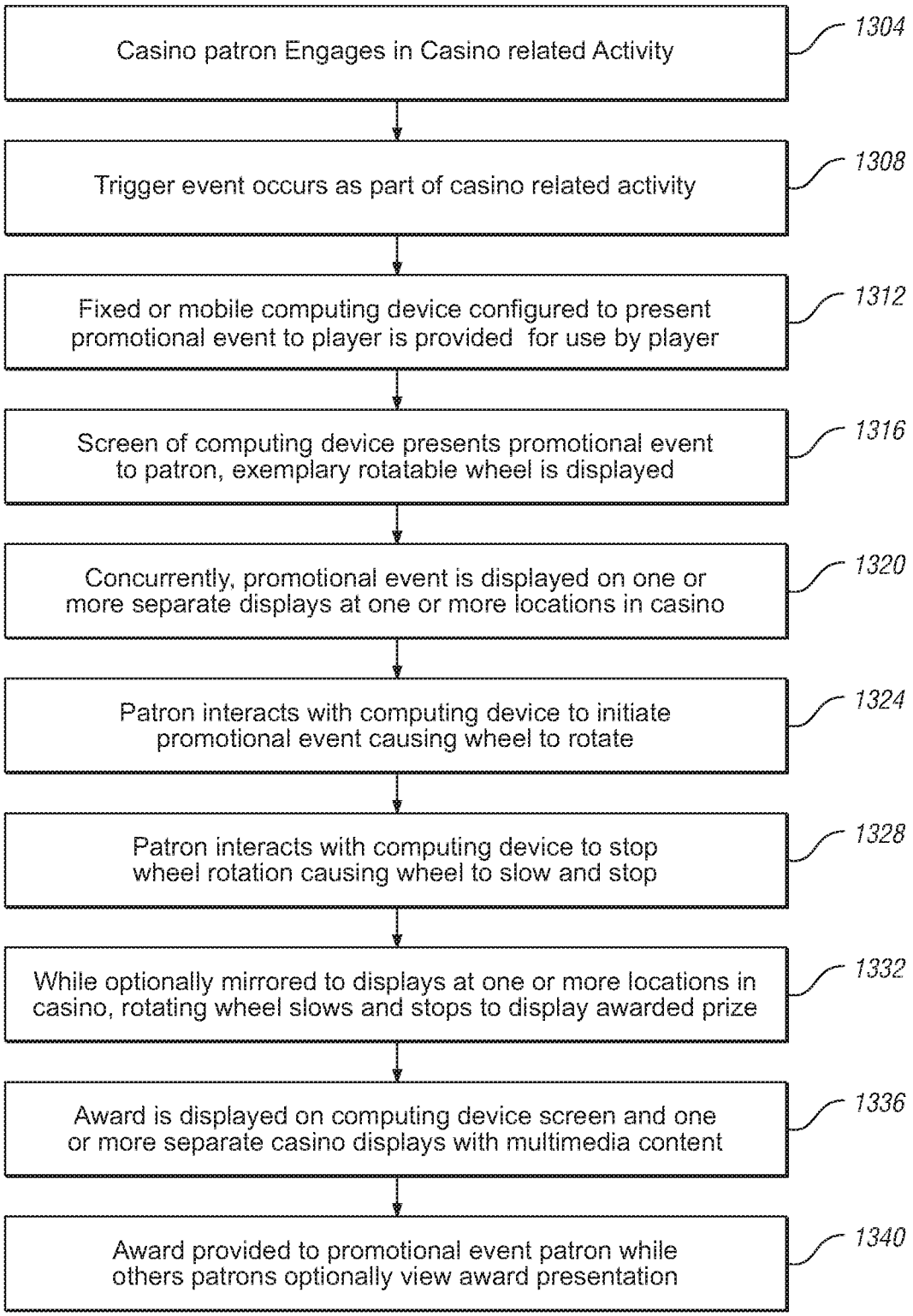
FIG. 13 illustrates an exemplary method of operation from a player perspective.

FIG. 13 illustrates one example method of operation from a player or casino patron perspective. This is but one possible method of operation and presentation of the promotional event and as such, one of ordinary skill in the art may develop variations to this method that do not depart from the scope of the claims that follow. At a step 1304, the casino patron engages in casino related activity. At a step 1308, a trigger event occurs as part of casino related activity. The various casino related activities and/or trigger events may include any number of different activities as are outline below in greater detail. For purposes of discussion and understanding, example casino related activities or trigger events include but are not limited to casino gaming, a particular winning outcome received during a casino game, weekly promotions, "hot seat" promotions, senior promotions, special events, casino check-in, signing up for a casino player club, etc.

As a result of the trigger event, a fixed or mobile computing device configured to present a promotional event to a casino patron or player is provided for use to the player or casino patron. This occurs at a step 1312. This step may include presenting the patron with a mobile computing device, such as tablet, using their existing gaming device, or directing them to a computer or kiosk. Once presented with the computing device offering the promotional event, the operation advances to step 1316 and the screen of the computing device presents the starting screen of the promotional event to the patron or player. This may be referred to as the promotional event start screen. In this exemplary discussion, an exemplary rotating wheel is displayed with means to initiate the promotional event.

At a step 1320, concurrent with the promotional event being displayed on the promotional event computing device, the promotional event is also optionally displayed on one or more separate displays at one or more locations in the casino. The locations may be near the player or at separate locations. The displays which concurrently display the promotional event may be any display, television, or projection in the casino property or other properties.

At a step 1324 the patron interacts with promotion event computing device to initiate the promotional event. In this embodiment, this intimating interaction comprises pressing a representation of a button on a touch screen of the computing device thereby causing a wheel to rotate. In other embodiment other actions may be taken such as pressing a physical button, touching a screen, saying a voice command, moving an object or other activating action. It is also contemplated that the event may start automatically. This causes the promotional event to display on the computing device and optionally larger displays or video projectors for everyone to view. This may include rotation of a wheel as described herein. Next, at a step 1328, the patron participating in the promotional event interacts with the computing device to cause the wheel rotation to slow. As it slows there is suspense for everyone watching the promotional event and the promotional event participate as to which segment of the wheel, and thus which award, the promotional event participate will win. At a step 1332, the rotating wheel eventually stops to display the awarded prize, all while being optionally mirrored or or generally duplicated in whole or in part in some manner also displaying the promotional event on the one or more additional displays at one or more locations in the casino.

Next, at a step 1336, the award won by the promotional event participate is displayed on the computing device screen and one or more separate casino displays with multimedia content promoting the award to alert as many people as possible of the award or prize won by the promotional event participate and to allow others to optionally share in the event. Then, at a step 1340 the award is provided to the promotional event participant, also referred to as the player, while other patrons view the award presentation.

Figure 14:
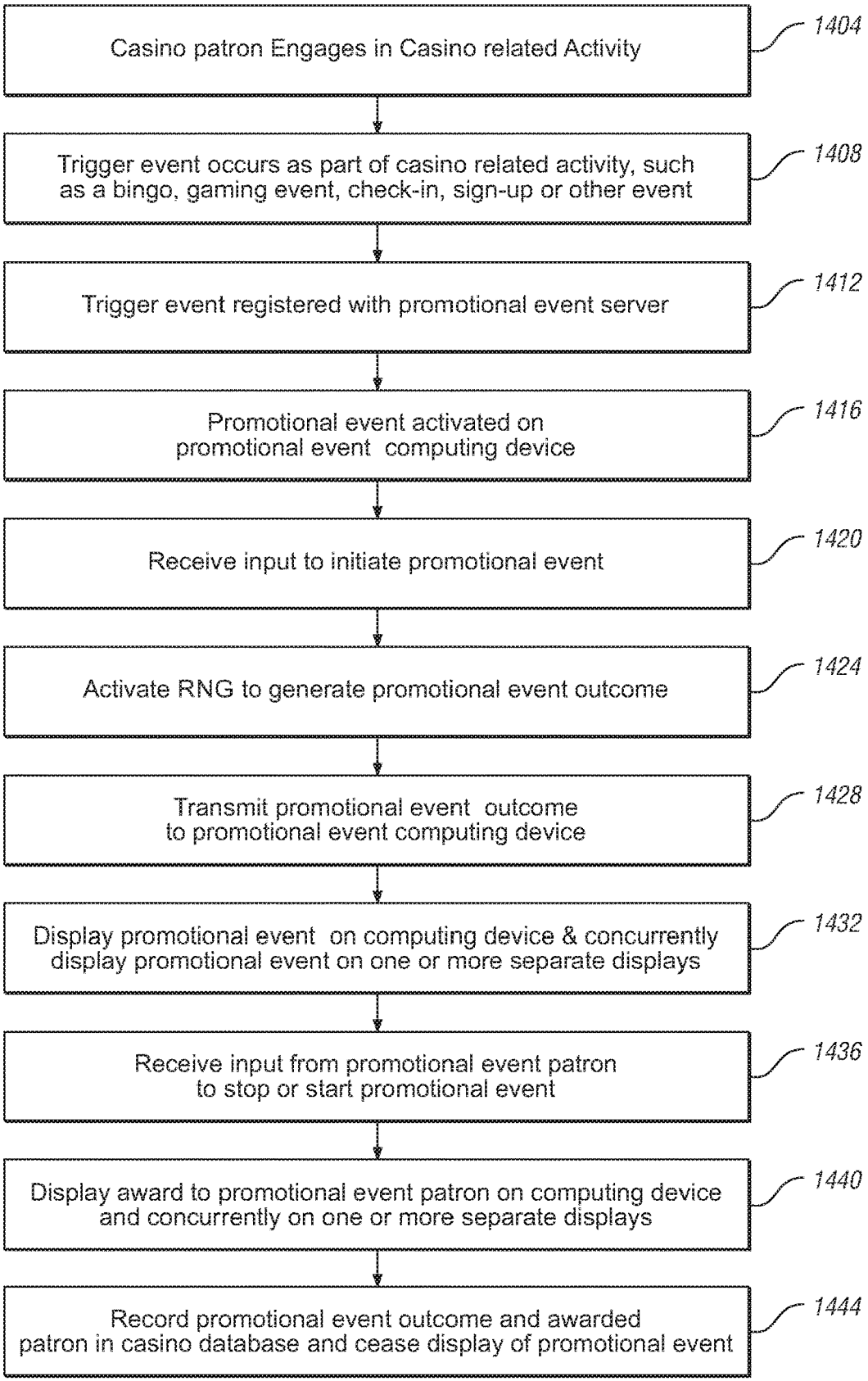
FIG. 14 illustrates one example method of operation from a player or casino patron perspective.

FIG. 14 illustrates one example method of operation from a player or casino patron perspective. This is but one possible method of operation and presentation of the promotional event and as such, one of ordinary skill in the art may develop variations to this method that do not depart from the scope of the claims that follow. At a step 1404 a casino patron engages in a casino related activity. As describe herein this may be any number of different events. At a step 1408, a trigger event occurs as part of casino related activity, such as a bingo win, predetermined gaming event outcome, patron hotel check-in, or sign-up for a player club, or any other event as described herein or that may occur in a casino. At a step 1412, the trigger event may be registered with the promotional event server, such as if the gaming outcome occurred on a gaming machine or electronic bingo platform. Or a casino worker may register the triggering action to initiate the promotional event. It is also contemplated that the promotional event participant may trigger to start the promotional event by entering data or a code into a kiosk or gaming machine or with a mobile computing device.

As a result of the triggering event, the promotional event is activated on a promotional event computing device. This occurs at as step 1416. This may occur due to a command from a gaming server or other computer, or the commands originate on a self-contained (stand-alone) promotional event computing device. Once activated, the promotional event is displayed on the screen to the promotional event participant. Then, at a step 1420 the promotional event computing device receives input from the user to initiate the promotional event. This may comprise touching the touch screen or pressing a physical button.

Upon initiation of the event, a RNG is utilized to generate a random outcome of the promotional event. This occurs at step 1424. In this example embodiment, the promotional event outcome is transmitted to the promotional event computing device at a step 1428 so that the outcome is available for the promotional event displayed on the one or more additional screens in the casino to the other patrons of the casino.

At a step 1432, the promotional event computing device displays the promotional event on a computing device screen and concurrently display the promotional event on one or more large displays or projectors for other patrons to view and to provide additional attention to the promotional event participate and the corresponding award win(s). Thereafter, at a step 1436 the promotional event computer device receives input from the promotional event participate to stop or conclude the promotional event. This may be a touch of a touch screen, press of a button, or the promotional event may end on its own after a predetermined time to not excessively extend the event. Conclusion of the promotional event may be the rotating wheel stopping rotation and the indicator designating a segment of the wheel to indicate an award or prize.

At a step 1440 the promotional event award is displayed on the screen of the computing device to the promotional event participant and concurrently on one or more large displays. This provides the award to the participant and shares the excitement of the award with other gamblers or casino patrons, such as those waiting in a line to check in or for dining, thus causing them to want to gamble and trigger an event that allows them to participate in the promotional event. At a step 1444, the promotional event outcome, the award, and the winning promotional event participant may be recorded in a casino database and thereafter, the promotional event may cease being displayed on the computing device and the other displays.

The promotional event may be used in a number of different locations and situations in a hotel, restaurant, spa, retail outlet, or casino. The forgoing list is exemplary and not limiting. Those of ordinary skill in the art, up reviewing this disclosure, will likely arrive at additional situations and locations which would benefit of the promotional event method and system as disclosed herein.

As discussed herein, the promotional event may be provided to a player, meaning the player may be allowed to participate in or conduct the promotional event, based on a number of wagering game related events. These events may be the referred to herein as a trigger event. For example, receiving a particular outcome of a wagering game may be the trigger event. In bingo, it may be a particular card pattern being made by the called numbers, such as a cross, line, or full card coverage or any desired bingo game outcome. For a poker game, it may be a royal flush, or full house, or any predetermined poker hand. The trigger event may be part of a keno game. Similarly, any wagering game may have a particular outcome or outcomes that serve as the trigger event that allows that player to participate in the promotional event for additional prizes. Optionally, no award or prize will be given to the player based on the outcome of the triggering event game. Instead the award or prize will be determined solely by the outcome of the subsequent promotional game of chance.

It is also contemplated that the trigger event may be based on duration of play. This encourages longer play and rewards players who play for an extended duration. For example, a player may be awarded a promotional event participation if they have played consistently for a predetermine duration or consistently for a predetermined duration over a course of a day, week, or month. The promotional event may also be awarded based on coin in to a gaming machine, amount wagered, number of games played (table games, bingo, keno, gaming machines, or any other wagering game). In addition, the promotional event may be used when a particular game is played in a way to direct players to particular games or part of a casino. As an example, a sports book player may trigger a promotional event where the outcome may be free or promotional gaming chips utilized in the pit area, a slot player may trigger a promotional event where the outcome may be free or promotional sport bets, etc. Additionally, the promotional event may be triggered by a person spending a threshold amount of money at a retail outlet, spa, restaurant, etc., whereas the winner of the promotion may win free gaming chips, sport bets, free play for the slot floor, etc. In another configuration, the trigger event is the player obtain chips at a cage or otherwise taking steps to gamble or make wagers. The games and wagering disclosed herein may be in person in a casino or alternatively online.

It is also contemplated that the trigger event may be based on an event in the sports book of a casino, either online or in a physical sports book. Thus, the trigger event may be placing a particular wager type, redeeming a wager, showing a winning or losing bet ticket, winning or losing a particular wager, placing a single or cumulative wager amount, placing a certain number of wagers, betting on a particular wager, such as fantasy football or other sports related promotion, or even simply visiting the sports book or attending a class or seminar on how to make sports book bets.

In another embodiment, the trigger event is when a patron checks into the hotel, spa, pool or other hotel/casino location. This provides an incentive to check into the hotel or other location or make a reservation at the hotel which in turn drives traffic and customer to a hotel and or casino. In addition, the trigger event may be eating at a restaurant or spending a certain amount in a restaurant, spa, store, or any other location. It is also contemplated that spending an amount of money at the casino or hotel may entitle a person to participate in a promotional event.

In one embodiment, the promotional event may be configured as a mystery event such that players eligible to participate in the mystery award may be awarded the promotional event participation at a random time without any trigger event other than the mystery event hitting, chosen by casino staff or being triggered by an RNG. The award given to the player who wins the mystery award is participation in the promotional event. It is also contemplated that the promotional event may be set up as or as part of a progressive award or the prizes awarded as part of the promotional event may grow in a manner similar to a progressive.

In one embodiment the trigger event is part of or the result of winning a gaming tournament. The gaming tournament may be any type of wagering event including slots, electronic or table-based poker, sports betting, table games, or any other tournament type event, manual or electronic. As part of participating in, earning a certain finishing rank, or the winning of the tournament, the play may be awarded a chance to participate in a promotional event and win a resulting prize. This establishes additional incentive to participate in a casino-based wagering tournament and bring tournament players together by having a promotional event shared among all the tournament participants. In addition, any group of participation is possible such as players located in a discrete group of slot machines, tables games, etc.

In one arrangement, the promotional event may be a stand-alone game such that a player may pay an amount of money, credits, or tokens, which may be considered a charge or wager to play the promotional event. After making the wager or paying the fee, the player has the opportunity to conduct the promotional event. In this embodiment, the play may be dedicated to a single screen or shown on multiple screen. The player may 'play' the promotional event once or as many times as they want, making a wager each time. The payout amounts may change based on the amount wagered.

In other variations, the trigger event may be a person's birthday or other special date, or as part of an incentive for paycheck cashing or signing up for a player tracking card, or as part of a show ticket purchase. In one variation, a patron is selected to conduct the promotional event for the benefit of everyone, such as a drink discount, free prize, or increased odds. This builds comradery among patrons or players and increases customers who return based on the comradery and chance to win a free item.

It is also contemplated that the video recording capability and/or audio recording capability of the microphone that are part of mobile computing devices, kiosks, or gaming machines are configured to capture audio, video, or both (multimedia content) of the player participating in the promotional event. This multimedia content is used to generate still images or video (audio option) of the player as they participate in and win at the promotional event. Face detection algorithms and other automated video processing may occur to locate and track the player's face and capture the resulting emotion. The resulting multimedia may be uploaded to an Internet site or social media for the player, casino, or both to further promote the outcome of the promotional event and the gaming experience. This provides the exciting event to other parties as well as being a reminder to the player of the win they had at the casino. The multimedia content may also be used in further marketing by the casino in web-based advertisements, in casino promotions, or television ads.

In one embodiment, the player be may be given the option or required to enter contact information into the computing device offering the promotional event. This provides a mechanism for the casino to obtain contact information for future marketing and follow-up contact. This also allows the casino to send a video of the player participating in the promotional event to the players email, text number, or social media accounts.

It is also contemplated that the promotional event may not occur immediately after the trigger event, but could be delayed, such as the next day or later at a time that is most convenient for the player or the casino. It is also contemplated that the promotional event may be provided to the user on the user's own mobile computing device, such as though link to a web site in an email or text message. For example, during check in or during gaming, the player may not want to conduct the promotional event. As such, the player may receive the link or other means to access the promotional event at a later time using their mobile phone, tablet, or home computer, or kiosk. It may also be presented to the player through social media, thereby sharing the event with others on social media.

Figure 15:
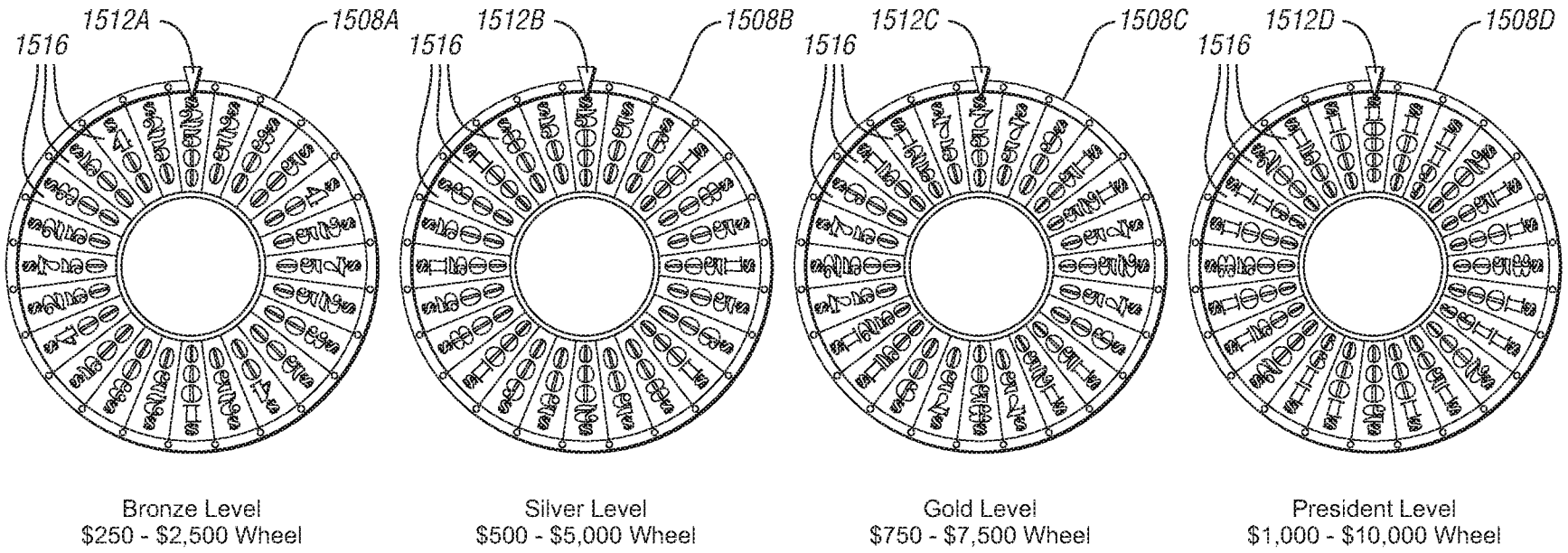
FIG. 15 illustrates an exemplary tiered prize structure.

FIG. 15 illustrates an exemplary tiered prize structure. The tiered prize structure is shown in FIG. 15 in association with wheels 1508A-1508D. On each wheel 1508A-1508D is a prize amount shown on the plurality of segments 1516. The segments indicate a prize, such as an item or prize amount. An indicator 1512A, 1512B, 1512C, 1512D determines which segment 1516 is selected. For any game embodiment, the prize array for any game may be identical for all players, whether the player is identified or not or, in the alternative, the prize amount may be adjusted relative to player behavior, past spending habits, or player loyalty tier level. As the example below illustrates, there are four different prize wheels used in the wheel game which correspond to the player's relative value, spending habits or play history at the casino or player loyalty tier level with increasing prize levels as the player tier level increases. Although shown with four tiers, there may be a fewer or greater number of tiers.

Generally, player tier levels are awarded based on the one or more player attributes such as player's amount gambled, known as coin-in for electronic gaming machines or theoretical loss over a given period of time, or some other factor. In this example configuration, a bronze tier player with a corresponding bronze player card designating the bronze tier has a theoretical monthly loss of $0 to $500, a silver tier player has a has a theoretical monthly loss of $501 to $2,000, a gold tier player has a theoretical monthly loss of $2,001 to $10,000 and a president tier level has a theoretical monthly loss of over $10,001. These values are exemplary and provided for purposes of discussion. Use of varying prize ranges allows for proper recognition of the player's relative worth to the casino operator and encourages lower tier players to increase their play to achieve the next tier level. The different tiers may also be assigned based on amount bet, time wagered, or other aspects associated with the player.

Use of varying prize scenarios may be accomplished either by manual adjustment by the operator prior to the game starting once the player is identified. For example, if the selected player has a bronze tier level, the operator will select the bronze game, or bronze wheel in this case, prior to handing the player tablet to the selected player or in the alternative, will select a gold game for a gold tier player. This may also be accomplished automatically be interfacing with the casino's CMS, SAS, or similar where the CMS, SAS or similar automatically adjusts the game prize scenario based on the know player tier level.

Typically, casino promotions may vary in promotion budgets and associated prize levels depending on the nature of the promotion and its value to a casino operator as described below. Exemplary prize types that may be used with the promotional event are set forth below.

Weekly Drawings $10,000 cash $5,000 cash
$1,000 cash
$500 free play
$250 free play
$100 free play
(theoretical cost per game equals $175)

Hot Seat Drawings
$1,000 cash
$500 free play
$400 free play
$200 free play
$100 free play
$50 free play
(theoretical cost per game equals $175)

Table Games
$500 cash
$100 promo chips
$20 promo chips
$10 promo chips
$5 match play
$5 double down (theoretical cost per game equals $9)

Player Sign-Up
$5,000 cash
Free room night
$10 Dining credit
$10 Promo chips
Signature T-shirt
$5 free play
(theoretical cost per game equals $8)

Casino promotions vary in type, operating days or hours, prize levels, etc. A number of representative promotions are listed below along with a brief description.

Weekly drawings—High value generally offered on weekends.
Hot seat drawings—Medium value which may be offered at any time.
Senior drawings—Medium value which may be offered at any time.
Slot tournaments—Medium value which may be offered at any time.
Table games—Medium value which may be offered at any time.
Pit Promos—Medium value which may be offered at any time.
Player sign-up—Low value offered at all times.
Check cashing—Low value offered at all times.
Hand Pay—High value offered at all times.
Host Initiated—High value offered at all times.
Video poker—Medium value offered at all times.
Bingo—Medium value offered during bingo operating hours.
Keno—Low value offered at all times.
Sports book—Low value offered at all times.
Bounce back—Low value offered at all times usually to promote the casino.
Hotel check-in—Low value offered at all times usually to promote the casino.
Food & Beverage—Low value offered at all times usually to promote the casino.
Retail—Low value offered at all times usually to promote the casino.
Special events—Low value offered at all times usually to promote the casino.
Club—Low value offered at all times usually to promote the casino.

The promotional system may also be employed with specialty games or side bets, whether they be promotional, utilized as a replacement for traditional static bet win, or standalone side bets. For example, a specific bet on a table game may have a higher house hold percentage than others such as a pass line bet on a crap table which has a normal hold percentage of 1.41% while a 7 out hold percentage has a hold of 16.67%. Accordingly, a casino may utilize the promotional system to supplement the win to encourage play for higher hold bets or in the alternative allow the player to play the promotional game of chance as a means to determine how much a player wins. For example, in the case of a 7 out bet, the player may win an addition average $5 using the promotional game of chance when making a $25 bet or instead of paying the player 4 to 1 on the amount wagered, the promotional game of chance can have a payout of between 2 to 1 and 20 to 1 thereby adding excitement to the game and encouraging other to make similar bets even though the average game payout remains at 4 to 1. In embodiments where the promotional game follows a player achieving a triggering event following play of a first game of chance requiring a wager, there may be no prize or award for the first game of chance outcome. Instead the ultimate prize or award will be determined by the outcome of the second promotional game of chance.

The promotional system may be property wide or regional as is the case of table games. Table game promotions may exist within the property wide promotional system or exist only for the pit. In any such applications, a server and tablet may be employed for each table game or one server may serve a plurality of table games located within the pit, elsewhere on the property or remote.

The promotional system may include progressive game management as in the case of table games but may be employed elsewhere in other promotions. For example, the promotional event may provide an opportunity to win a progressive award or a progressive award may be grown and available as part of the prizes winnable during a promotional event. Many table games lend themselves especially well to progressives such as the game of Pai Gow but may be employed on any standard table game, side bets, table games listed below, or other. The progressive game management may be self-contained within the promotional system or may interface with the CMS, SAS or other. Progressive incrementation is accomplished either manually by casino personnel entering data or may be automated by utilizing various sensors, RFID, etc. which interface with the promotional system.

In the case of side bets for table games which often have a much higher hold percentage than the base games, the promotional event system may replace traditional static wins to encourage play. In embodiments where the promotional game follows a player achieving a triggering event following play of a first game of chance requiring a wager, there may be no prize or award for the first game of chance outcome. Instead the ultimate prize or award will be determined by the outcome of the second promotional game of chance. A number of new and novel representative table game side bets are discussed below, without limitation as the number and type of side bet or secondary game possibilities is extremely diverse.

Blackjack—Back to Back Blackjack™ Game

When a player receives two blackjacks in a row or on split aces, they win a chance to play the promotional games of chance either for a secondary prize or for the primary payout. When lesser but similar hands are dealt, lower value secondary promotional prizes are awarded or in the case of a primary payout, reduced win amounts. With odds of approximately 400:1, there will be approximately one win every 70 minutes, depending on play levels. It should be recognized there are many variations possible including utilization of the promotional system with standard games, previously known side bets or proprietary games and side bets.

Craps—Easy Prop Games

As previously discussed, the promotional system may be utilized in the game of craps as either the secondary promotional prize or the payout means for the primary bet. Primary payouts are adaptable to games such as Lucky Snake Eyes™, Big Boxcars™, or Double Big Red™, where the object is to obtain two consecutive identical outcomes such as Lucky Snake Eyes where 2 (one on each die) occur in two consecutive rolls. Similarly, Big Boxcars requires a total of 12 on two consecutive rolls of the dice.

Roulette—Numbers Games

The Lucky Zero™, Lucky Double Zero™, and Lucky 7™ roulette games are designed to have a winner approximately every 40 to 60 minutes. The games are easy and straightforward. For instance, in Lucky Zero whenever a player has a wager on 0 and a single 0 occurs, the player gets the chance to play the promotional game of chance. An option for this game is to require double the minimum bet to qualify. Primary payouts are adaptable to games such as Double Double Zero™ which requires which requires two consecutive 00 outcomes or Lucky 77 which requires two consecutive 7s.

Pai Gow—Lucky Four™ Game

When a player obtains any four-of-a-kind, they win a chance to play the Lucky Four promotional game of chance. Depending on play levels, there will be approximately one Lucky Four winner every few hours. An option for this game is to require double the minimum bet to qualify and lower the win threshold with the Lucky Full House™ game, which lowers the win threshold to a full house. Any such game may utilize the promotional system as either a secondary game or utilized as the primary payout means for the game.

Three Card Poker—Straight Fun™ Game

Like craps, promotional games of chance offered with Three Card Poker utilizing the promotional system not only provide added excitement to the game, they are also designed to induce players to make a given bet, where the promotional game of chance is a bonus. Often these may be bets that are less favorable to the player, thereby upping the casino hold percentage. In the case of the Straight Fun™ game, any hand of a straight or better qualifies for the bonus game. In the case of the game Straight Flush Fun™ game, which requires any straight flush to win, the promotional system is utilized as the primary payout means.

In addition, the promotional system can be used in other venues such as a sports book to incentivize current players or to attract current non-players. For example, current players may be rewarded for certain bets or wins, or high tier non-sports book players may be introduced to the sports book by playing promotional games of chance where the winners play promotional games and win certain free bets, i.e., prop bets, parleys, etc. In the alternative, a winning bet may be paid via the promotional system to provide more excitement even though the average pay may be approximately equal to the straight bet payout.

FIGS. 16A, 16B, 16C and 16D illustrate exemplary screen displays of an administrative interface for the promotional event disclosed herein. The exemplary screen displays of FIGS. 16A through 16D are but one possible layout, content, and format for the administrative interface and, as such, it is contemplated that other layouts, content and formats for the administrative interface may be developed without departing from the claims. The promotional system may require ongoing game or system programming for a number of different settings and levels to allow for an array of different promotions and for customization as required. To assist in the proper programming and development of the system and associated games, the administrative interface includes a series of user questionnaires (collectively questions and settings) to assist in programming and set up of the promotional event. These questionnaires may be processed manually with property personnel manually filling out the questionnaires and returning to the programming or to a department or a third-party programmer who prepares the proper games, promotion name, game types, associated prize arrays, graphics, etc.

The questionnaires may also be web based using the administrative interface to further automate the process and in its optimal form, the system is capable of internally or externally receiving user information from the questionnaires, accessing the responses and automatically generating the appropriate games, game type, proper prize arrays, promotion name, graphics, etc. For example, the data may be input by a third-party company, such as Gaming Arts, LLC based in Las Vegas, Nev. or using a web interface or portal, by casino personnel accessing the system through a password or other means of security. This allows casinos or other entities to quickly and easily customize the promotional event to the needs for a particular trigger event, base game, or date/time.

Figure 16C:
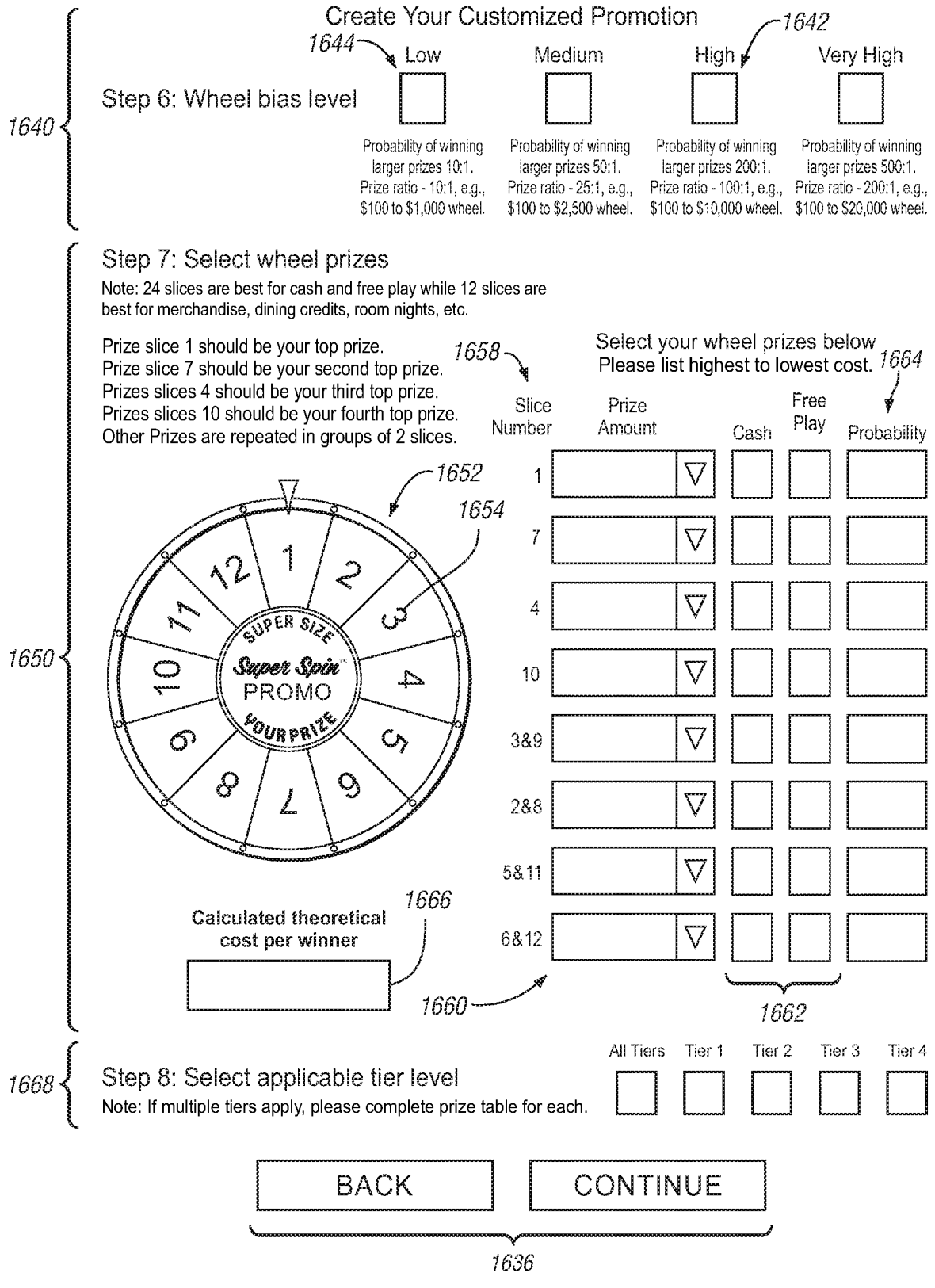

FIGS. 16A through 16D illustrates one possible administrative interface used to obtain the data that can be used by the system to generate the proper game, game type, prize array, promotion name, graphics, etc. based on user input. FIG. 16A illustrates a possible first screen display of the administrative interface that determines game type, provides user information, and promotion type. As shown, advancing from the top toward the bottom, an instruction area 1604 is provided to guide the user in use of the administrative interface. Below the instruction area 1604 is a user information section 1608 that allows the user of the administrative interface to input their name, contact information, and promotion identifier. This allows the user of the administrative interface to be contacted regarding the set up of the promotional event.

A game selection section 1610 allows the user to select which game type to display as the promotional event. As show, the four game options 1610 shown in FIGS. 11A through 11D are provided as options but in other embodiments other game options or layouts may be provided. A graphic is conveniently provided to aid the user of the administrative interface in selecting the game type. Below the game selection section 1610 are check boxes 1612 used by the user to select the game and optionally a sub-game type such as a 12 slice wheel game or a 24 slice wheel game. The check boxes used as selection mechanisms are used throughout the administrative interface and are not described for each instance of use. A promotion selection area 1614 is also provided to allow the user to select the location, timing, or nature of the promotion. This list is not exhaustive and may be changed as new game locations, timing, and types are added to the system. The promotion name button 1618 is provided to allow the user to name and save the promotional event settings. It is contemplated that multiple promotional events may exist for a property, each having different settings. For example, a promotional event may be established for the hotel check in process while another different promotional event may be established for bingo games. A button 1616 or selector is provided to advance to the next screen.

Turning to FIG. 16B, target cost per game section 1620 is provided to establish the cost to the casino for each game. This may be established as an average value or a maximum payout. Within this section is an all tiers field 1622 which sets the same cost across all player tiers (see FIG. 15) or the cost per tier fields 1624 may be used to enter the target cost per game for each of the four tiers. In other embodiment a fewer or greater number of tiers may be established. Adjacent the target cost per game section 1620 is a game graphic 1624 showing the prizes on each segment for an exemplary game wheel for the selected promotional event display. In other embodiments, the number of wheel segments may be adjusted, or the wheel may be replaced with other graphics to match the theme of the event, such as a pie, race car wheel, or any other graphic.

In section 1630 are screen background selection options with associated check boxes. Any type of number of different screen backgrounds may be associated with the promotional event, such as but not limited to the following backgrounds: sky, flag, race track, space, video game, licensed game content, dancing people, or any other theme. In addition, below section 1630 is a holiday or special event section 1634. This section allows the user to select a promotional event them for predetermined holidays or special events. At the bottom of this screen display of the administrative interface are back and continue buttons 1636.

In this example embodiment, a weekly drawing utilizing a 12-slice wheel game is shown and disclosed. As a result, the administrative interface provides the user a series of questions that relate to a weekly drawing, 12-slice wheel promotional event. Similarly, when the first questionnaire indicates other game types or promotion types, the program will take the user to secondary questionnaires related to that particular game or promotion type. Thus, different screens layout and information options are presented to the user based on the type of game selected for the promotional event. In this example embodiment, a wheel based game with segments was selected so these particular data entry fields are provided which correspond to the wheel based event. Persons of ordinary skill in the art will recognize that any game type or theme may be utilized.

The questionnaire that is part of the administrative interface provides fields for data entry to be used in generating the promotion name, proper game, prize arrays, background or holiday theme background graphic, game bias level, prize array (in this case for a 12-slice wheel), calculated theoretical average cost per play, tier level (if applicable), etc. The "Select your wheel prize below" section utilizes pull down menus which are populated by the data shown on FIG. 16D, "customized prizes" list. The "customized prizes" list may be the identical for all game types or in the alternative, be customized for different game types as some games may be more conducive to large value promotions where higher cash or free play amounts are included, some game types for more moderate cost promotions, and some game types for lower value promotions where discount coupons, apparel, and the like comprise the prize list.

As previously discussed, the series of questionnaires may be utilized as part of the administrative interface to manually prepare the appropriate promotional games of chance. The data may be collected on physical forms and returned to the promotional event programming department or third-party provider to develop appropriate games, or the data entry may be fully automated where the system generates the appropriate games and associated prizes based on user entry of data and information into the administrative interface or any level of automation therebetween.

FIG. 16C includes a wheel bias level selection section 1640 which check boxes 1642 for the user to select different bias levels, in this embodiment low, medium, high and very high. The bias level sets the probability of winning larger prices based on a prize ratio. For example, the low bias setting 1644 establishes the probability of winning a larger prize at 10 to 1 while the high bias setting 1642 sets the probability of winning a larger price at 200 to 1. The wheel bias level section 1640 may also set the price ratio on an exemplary wheel, such as the range of prize values.

Below the wheel bias level section 1640 is a wheel price selection section 1650 that provide a user customization options to select wheel segment prices. In section 1650, an exemplary promotion event display is provided, such as a wheel 1652. On the segments 1652 of the wheel are indicators 1654 which correspond to the identifiers 1658 that are associated with prize amount fields 1660. In this case, indicator 4 corresponds to identifier 4 so the user can enter a prize amount for that particular segment in the field 1660 associated therewith. Field 1660 controls what is shown on that segment of the wheel during the promotion. In this manner, the user may enter a prize value for each segment 1652 in each associated field 1660. Adjacent the prize amount fields 1660 are additional fields 1662 so the user can designate the prize amount as a cash prize or free play credits. The right most column is a probability field 1664 that sets the probability of each segments being selected during game play. It is contemplated that the larger prize amounts would have the lowest probability, but any combination or odds are possible. As can be appreciated, the administrative interface shown and described provides outstanding customization capability and flexibility or the user to customize the game visuals, payouts, odds, and type of payout to meet any possible need of the customer. As a further benefit, a theoretical cost per winner field 1666 is provided to display a system calculated cost per win based on the prize amounts entered in field 1658 and the associated probability in field 1664. This allows the user to dynamically adjust the prize amounts and probability to establish a desired cost per game or cost per win.

A tier level selection section 1668 is provided to allow the user to set the applicable tier level. In this example arrangement, five different check boxes are provided, namely, all tiers, tier 1, tier 2, tier 3, tier 4. If all tiers are selected and players will play the identical game type with identical prize offerings, game to game. In the alternative, various player tier levels are provided to increase or decrease the theoretical cost per game. Each tier may be populated manually or automatically based on the player's relative value to the casino. For instance, tier 1 may be selected and populated as the highest theoretical cost per game with each subsequent tier having a lower theoretical cost per game. For example, the theoretical cost per game for tier 1 may be $250, tier 2 may be $150, tier 3 may be $75, and tier 4 may be $50. Such tier prize adjustments may be automatically populated after programming the mathematical relationships between tiers or populated manually. At the bottom of the screen are back and continue buttons 1636.

Figure 16D:
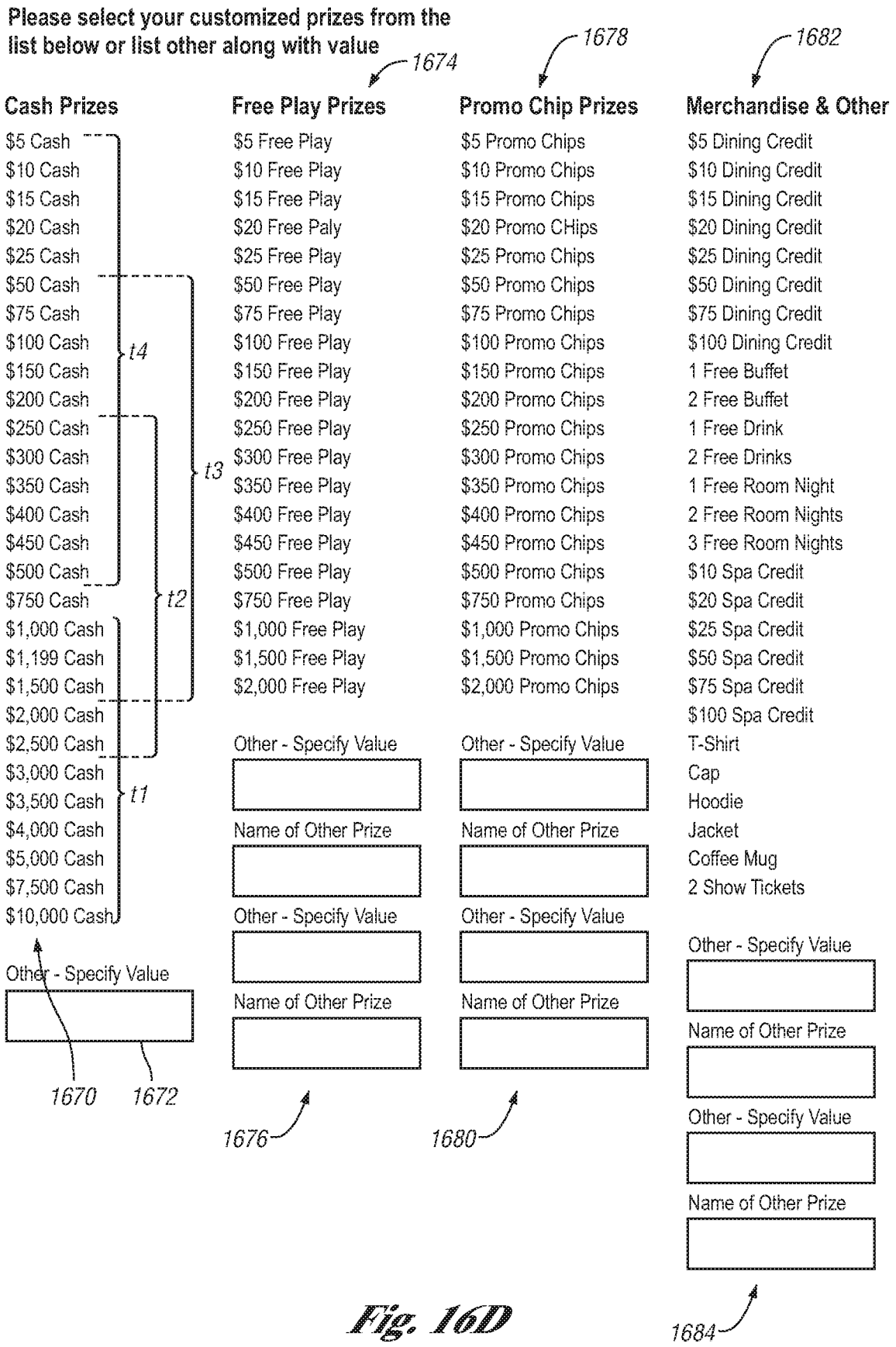

Advancing to FIG. 16D, a selection screen is shown for the user to select customized prices. For cash prizes, designated as the award type earlier in the administrative interface, the user may select the prize amounts listed in cash prize column or enter their own amounts or values. For example, cash prize column 1670 lists cash prize amount options while field 1672 allows the user to input a custom cash prize amount. Similarly, free play column 1674 lists possible free play prize amount, which provide free play on gaming machines or other wagering games. Additional free play fields 1676 are provided for the user to enter custom values. These additional free play fields 1676 include a custom field, a name other prizes field, and an other field. As shown in the 1670 column, differing tier levels groupings such as t1, t2, t3 and t4 are generated either manually or automatically, each representing cash prize ranges for each of four player tier levels with t1 representing players with the lowest value to the casino and thus lowest prize or award range and t4 representing players with the highest value to the casino and thus highest prize or award range. Such tier levels with associated prize or award ranges may be utilized for single prize or award categories such as cash prize or may be utilized for two or more prize or award categories.

Also shown in FIG. 16D is a promo chip prizes column 1678 listing the numeric values for promo chips and below this column are fields 1680 which are the same as or similar to the fields 1676. The right most column is for available merchandise, which is listed in column 1682. Below column 1682 are fields for custom value entry, which are the same as or resemble fields 1676, 1680.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

Exemplary embodiments of the promotional games of chance and associated devices and systems are described above in detail. Consequently, the games, devices, and systems are not limited to the specific embodiments described herein, but rather, components of the games, devices, and/or systems may be utilized independently and separately from other components described herein. For example, the games, devices, and systems may also be used in combination with other games and are not limited in practice.

Although specific features of various embodiments of the disclosure may be shown in some drawings or illustrations and not in others, this is for convenience only. In accordance with the principles of the disclosure, any feature of a drawing may be referenced and/or claimed in combination with any feature of any other drawing.

This written description uses examples to describe embodiments of the disclosure, including the best mode and, also to enable any person ordinarily skilled in the art to practice the embodiments, including making and using any devices or systems and performing any incorporated methods. The patentable scope of the disclosure is defined by the claims, and may include other examples that occur to those ordinarily skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for presenting an award to a selected player based on a promotional event game outcome that is part of a promotional event after the selected player first being selected based on a first game of chance outcome comprising:

a server having a transceiver, a processor and a memory, the memory configured with non-transitory machine executable instructions executable by the processor, to generate the promotional event game outcome;

a mobile computing device, for use by the selected player, having a transceiver, a screen, a processor and a memory, the memory configured with non-transitory machine executable instructions executable by the processor, to:

display a promotional event to the selected player on the mobile computing device screen, the promotional event including a second game of chance having a promotional event game outcome such that the award is determined by the promotional event game outcome;

receive the promotional event game outcome from the server; and present the award to the selected player responsive to the promotional event game outcome; and a remote display configured to show the promotional event or a portion of the promotional event, and any resultant award, concurrently in substantially real-time as the promotional event is being shown to, and/or played by, the selected player on the mobile computing device screen.

2. The system of claim 1, wherein the mobile computing device is tablet computer.

3. The system of claim 1, wherein the promotional event includes an electronic wheel-based game of chance.

4. The system of claim 1, wherein the promotional event includes an electronic matching game of chance.

5. The system of claim 1, wherein the promotional event includes an electronic scratch-off game of chance.

6. The system of claim 1, wherein the promotional event includes an electronic pick and win game of chance.

7. The system of claim 1, wherein selection of the selected player is a based on a drawing from a plurality of players.

8. The system of claim 1, wherein selection of the selected player does not require a wager by the selected player.

9. The system of claim 1, wherein selection of the selected player requires a wager by the selected player.

10. A system for offering a promotional event for a player comprising:

a remote display configured to receive a signal representing the promotional event; and display at least a portion of the promotional event on the remote display;

a promotional event computing device having a processor, a memory, a screen, and a wireless transceiver, the memory configured with non-transitory machine executable instructions executable by the processor to:

responsive to a trigger event, initiate the promotional event;

generate a random outcome, the random outcome representing a promotional event outcome;

display the promotional event and the promotional event outcome to the player on the screen of the promotional event computing device;

award the player a prize, the prize determined by the promotional event outcome; and during the promotional event, transmit at least a portion of the promotional event, and any resultant award, concurrently in substantially real-time as the promotional event is being shown to, and/or played by, the selected player on the mobile computing device screen, to the remote display for display on the remote display, the remote display viewable by additional people.

11. The system of claim 10, wherein the promotional event computing device is tablet computer.

12. The system of claim 10, wherein the promotional event includes an electronic wheel-based game of chance.

13. The system of claim 10, wherein the promotional event includes an electronic matching game of chance.

14. The system of claim 10, wherein the promotional event includes an electronic scratch-off game of chance.

15. The system of claim 10, wherein the promotional event includes an electronic pick and win game of chance.

16. The system of claim 10, wherein the trigger event does not require a purchase by the player to be selected.

17. A method for providing a promotional event to a selected player of a game of chance after a trigger event comprising:

responsive to the trigger event, presenting a promotional event computing device to the selected player and initiating the promotional event, the promotional event including a game of chance;

presenting the promotional event including the game of chance to the selected player on a screen of the promotional event computing device;

generating a game outcome with a random number generator;

presenting an award to the selected player, the award determined by the game outcome; and while presenting the promotional event to the selected player, concurrently in substantially real-time displaying the promotional event, and any resultant award, on one or more additional screens separate from the promotional event computing device for viewing by one or more people in addition to the selected player.

18. The method of claim 17, wherein the promotional event computing device is tablet computer.

19. The method of claim 17, wherein the game of chance is an electronic matching game of chance.

20. The method of claim 17, wherein the game of chance is an electronic scratch-off game of chance.

21. The method of claim 17, wherein the game of chance is an electronic pick and win game of chance.

22. The method of claim 17, wherein the trigger event a drawing selecting at least one player from a plurality of players.

23. The method of claim 17, wherein the trigger event does not require a wager to be the selected player.

24. The method of claim 17, wherein the first game of chance requires a wager to be the selected player.

* * * * *